US007836973B2

(12) United States Patent
Belcher et al.

(10) Patent No.: US 7,836,973 B2
(45) Date of Patent: Nov. 23, 2010

(54) ANNULUS PRESSURE CONTROL DRILLING SYSTEMS AND METHODS

(75) Inventors: Gary Belcher, Calgary (CA); Adrian Steiner, Calgary (CA); Kevin Schmigel, Calgary (CA); David Brunnert, Cypress, TX (US); Darcy Nott, Calgary (CA); Richard Todd, Houston, TX (US); Jim Stanley, Katy, TX (US); Simon Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 250 days.

(21) Appl. No.: 11/850,479

(22) Filed: Sep. 5, 2007

(65) Prior Publication Data

US 2008/0060846 A1 Mar. 13, 2008

Related U.S. Application Data

(63) Continuation-in-part of application No. 11/254,993, filed on Oct. 20, 2005.

(60) Provisional application No. 60/824,806, filed on Sep. 7, 2006, provisional application No. 60/917,229, filed on May 10, 2007.

(51) Int. Cl.
*E21B 21/08* (2006.01)

(52) U.S. Cl. ..... 175/25

(58) Field of Classification Search ..... 166/244.1, 166/250.07; 175/25, 38, 48
See application file for complete search history.

(56) References Cited

U.S. PATENT DOCUMENTS 2,290,408 A 7/1942 Crites
3,362,487 A 1/1968 Lindsey
3,517,553 A 6/1970 Williams
3,552,502 A 1/1971 Wilson, Sr.

(Continued)

FOREIGN PATENT DOCUMENTS

EP 1 048 819 11/2000

(Continued)

OTHER PUBLICATIONS

EP Search Report, Application No. 07115790.3-1266, dated Jan. 21, 2008.

(Continued)

*Primary Examiner*—David J Bagnell
*Assistant Examiner*—James G Sayre
(74) *Attorney, Agent, or Firm*—Patterson & Sheridan, L.L.P.

(57) ABSTRACT

In one embodiment, a method for drilling a wellbore includes an act of drilling the wellbore by injecting drilling fluid through a tubular string disposed in the wellbore, the tubular string comprising a drill bit disposed on a bottom thereof. The drilling fluid exits the drill bit and carries cuttings from the drill bit. The drilling fluid and cuttings (returns) flow to a surface of the wellbore via an annulus defined by an outer surface of the tubular string and an inner surface of the wellbore. The method further includes an act performed while drilling the wellbore of measuring a first annulus pressure (FAP) using a pressure sensor attached to a casing string hung from a wellhead of the wellbore. The method further includes an act performed while drilling the wellbore of controlling a second annulus pressure (SAP) exerted on a formation exposed to the annulus.

27 Claims, 35 Drawing Sheets

U.S. PATENT DOCUMENTS

| | | | | |
|---|---|---|---|---|
| 4,247,312 | A | 1/1981 | Thakur et al. | |
| 4,297,880 | A | 11/1981 | Berger | |
| 4,440,239 | A | 4/1984 | Evans | |
| 4,630,675 | A | 12/1986 | Neipling et al. | |
| 4,771,675 | A | 9/1988 | Grauer et al. | |
| 5,010,966 | A | 4/1991 | Stokley et al. | |
| 5,154,078 | A | 10/1992 | Codazzi | |
| 5,661,402 | A | 8/1997 | Chesnutt et al. | |
| 5,716,910 | A | 2/1998 | Totten et al. | |
| 5,762,143 | A | 6/1998 | Comeau et al. | |
| 5,857,522 | A | 1/1999 | Bradfield et al. | |
| 5,871,052 | A | 2/1999 | Benson et al. | |
| 5,900,137 | A | 5/1999 | Homan | |
| 5,901,064 | A | 5/1999 | Weber et al. | |
| 5,901,964 | A | 5/1999 | Williams et al. | |
| 5,971,072 | A | 10/1999 | Huber et al. | |
| 6,035,952 | A | 3/2000 | Bradfield et al. | |
| 6,138,774 | A | 10/2000 | Bourgoyne, Jr. et al. | |
| 6,234,258 | B1 | 5/2001 | Karigan | |
| 6,263,982 | B1 | 7/2001 | Hannegan et al. | |
| 6,328,118 | B1 | 12/2001 | Karigan et al. | |
| 6,343,649 | B1 | 2/2002 | Beck et al. | |
| 6,352,129 | B1 | 3/2002 | Best | |
| 6,374,925 | B1 | 4/2002 | Elkins et al. | |
| 6,386,288 | B1 | 5/2002 | Snider et al. | |
| 6,427,530 | B1 * | 8/2002 | Krueger et al. | 73/152.46 |
| 6,429,784 | B1 | 8/2002 | Beique et al. | |
| 6,457,540 | B2 | 10/2002 | Gardes | |
| 6,470,975 | B1 | 10/2002 | Bourgoyne et al. | |
| 6,484,816 | B1 | 11/2002 | Koederitz | |
| 6,527,062 | B2 | 3/2003 | Elkins et al. | |
| 6,571,869 | B1 | 6/2003 | Pluchek et al. | |
| 6,575,244 | B2 | 6/2003 | Chang et al. | |
| 6,653,460 | B1 | 11/2003 | Newcomb et al. | |
| 6,655,460 | B2 | 12/2003 | Bailey et al. | |
| 6,668,943 | B1 | 12/2003 | Maus et al. | |
| 6,719,071 | B1 | 4/2004 | Moyes | |
| 6,739,397 | B2 | 5/2004 | Ayling | |
| 6,755,261 | B2 | 6/2004 | Koederitz | |
| 6,805,199 | B2 | 10/2004 | Surjaatmadja | |
| 6,814,142 | B2 | 11/2004 | Paulk et al. | |
| 6,837,313 | B2 | 1/2005 | Hosie et al. | |
| 6,904,981 | B2 | 6/2005 | Van Riet | |
| 6,913,092 | B2 | 7/2005 | Bourgoyne et al. | |
| 6,920,942 | B2 | 7/2005 | Koederitz | |
| 7,004,448 | B2 | 2/2006 | Suter et al. | |
| 7,044,239 | B2 | 5/2006 | Pinckard et al. | |
| 7,158,886 | B2 | 1/2007 | Hou et al. | |
| 7,172,037 | B2 | 2/2007 | Dashevskiy et al. | |
| 7,353,887 | B2 | 4/2008 | Krueger et al. | |
| 7,395,877 | B2 * | 7/2008 | Hosie et al. | 175/25 |
| 7,407,019 | B2 | 8/2008 | Kinder et al. | |
| 2002/0170749 | A1 * | 11/2002 | Hoyer et al. | 175/25 |
| 2003/0079912 | A1 | 5/2003 | Leuchtenberg | |
| 2003/0098181 | A1 | 5/2003 | Aronstam et al. | |
| 2003/0106712 | A1 | 6/2003 | Bourgoyne | |
| 2003/0146001 | A1 | 8/2003 | Hosie et al. | |
| 2003/0196804 | A1 | 10/2003 | Riet | |
| 2003/0217849 | A1 * | 11/2003 | Hosie et al. | 166/373 |
| 2004/0007392 | A1 | 1/2004 | Judge et al. | |
| 2004/0069501 | A1 | 4/2004 | Haugen et al. | |
| 2004/0084189 | A1 | 5/2004 | Hosie et al. | |
| 2004/0129424 | A1 * | 7/2004 | Hosie et al. | 166/332.8 |
| 2004/0178001 | A1 | 9/2004 | Bourgoyne et al. | |
| 2004/0178003 | A1 | 9/2004 | Riet | |
| 2004/0231889 | A1 | 11/2004 | Van Riet | |
| 2004/0238177 | A1 | 12/2004 | Fossli | |
| 2005/0045382 | A1 | 3/2005 | Hosie et al. | |
| 2005/0061546 | A1 | 3/2005 | Hannegan | |
| 2005/0092523 | A1 | 5/2005 | McCaskill et al. | |
| 2006/0011236 | A1 | 1/2006 | Suter et al. | |
| 2006/0086538 | A1 | 4/2006 | Van Riet | |
| 2006/0113110 | A1 * | 6/2006 | Leuchtenberg | 175/38 |
| 2006/0124300 | A1 | 6/2006 | Steiner et al. | |
| 2006/0124352 | A1 * | 6/2006 | Krueger et al. | 175/25 |
| 2006/0157282 | A1 | 7/2006 | Tilton et al. | |
| 2006/0207795 | A1 | 9/2006 | Kinder et al. | |
| 2007/0045006 | A1 * | 3/2007 | Krueger et al. | 175/25 |
| 2008/0029306 | A1 * | 2/2008 | Krueger et al. | 175/210 |

FOREIGN PATENT DOCUMENTS

| | | |
|---|---|---|
| EP | 1 375 817 | 1/2004 |
| EP | 1595057 | 7/2006 |
| GB | 2 423 321 | 2/2005 |
| GB | 2 406 594 | 4/2005 |
| GB | 2 416 559 | 10/2005 |
| WO | WO 00/75477 | 12/2000 |
| WO | WO 02/50398 | 6/2002 |
| WO | WO 03/006778 | 1/2003 |
| WO | WO 03/071091 | 8/2003 |
| WO | WO 2005/017308 | 2/2005 |
| WO | WO 2005/019596 | 3/2005 |
| WO | WO 2006/032663 | 3/2006 |
| WO | WO 2007/092956 | 8/2007 |

OTHER PUBLICATIONS

Properties of Foam (date unknown).
Super Auto Choke, www.miswaco.com (2004).
Foam Frac., BJ-Hughes, Inc. (date unknown).
Blauer et al., SPE 5003, Formation Fracturing with Foam (1974).
Bullen et al., Petroleum Society of CIM, Fracturing with Foam (1975).
David et al., SPE 2544, The Rheology of Foam (1969).
Holditch et al., The Design of Stable Foam Fracturing Treatments (date unknown).
Mack et al., Oil and Gas Journal, New Foams Introduce New Variables to Fracturing (1990).
White et al., World Oil, Aphron-based Drilling Fluid: Novel Technology for Drilling Depleted Formations (2003).
EP Search Report, Application No. EP 07 11 5790, dated Apr. 2, 2008.
Canadian Office Action for Application No. 2,600,602 dated Oct. 7, 2009.

* cited by examiner

FIG. 18A
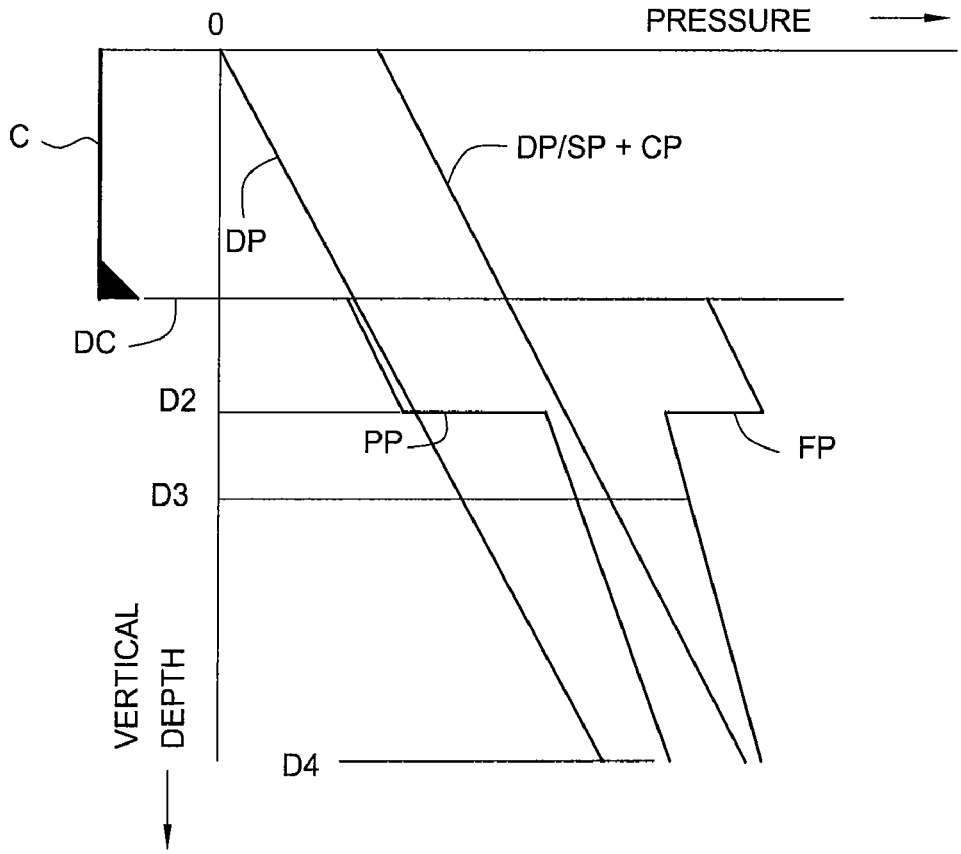
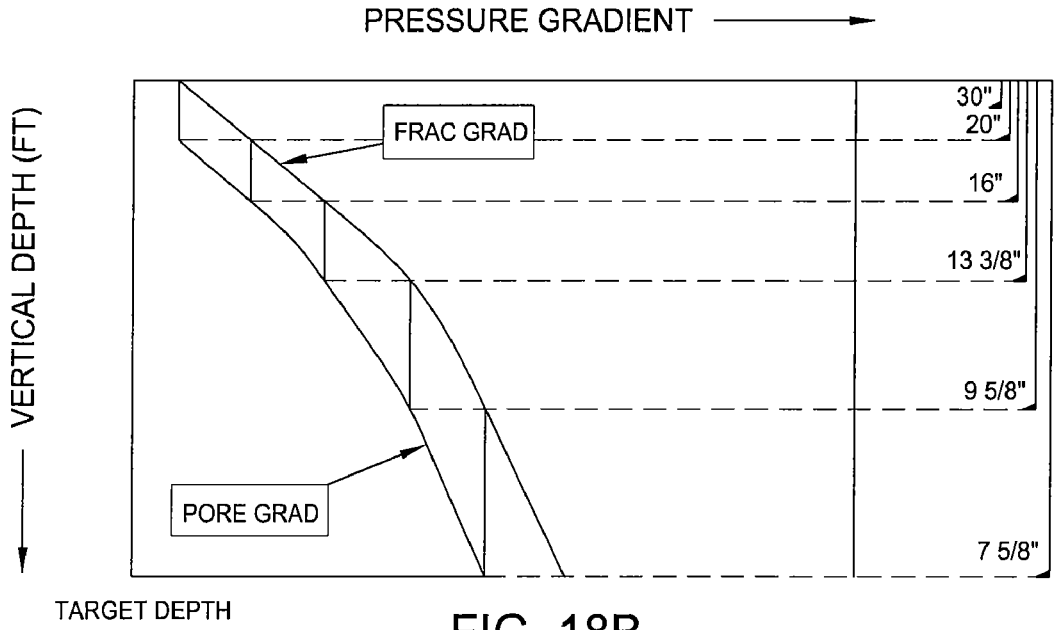
FIG. 18B

ANNULUS PRESSURE CONTROL DRILLING SYSTEMS AND METHODS

CROSS-REFERENCE TO RELATED APPLICATIONS

This application claims the benefit of U.S. Prov. Pat. App. No. 60/824,806, entitled "Annulus Pressure Control Drilling System", filed on Sep. 7, 2006, and U.S. Prov. Pat. App. No. 60/917,229, entitled "Annulus Pressure Control Drilling System", filed on May 10, 2007, which are herein incorporated by reference in their entireties.

This application is a continuation-in-part of U.S. patent application Ser. No. 11/254,993 , filed Oct. 20, 2005.

U.S. Pat. No. 6,209,663, U.S. patent application Ser. No. 10/677,135, filed Oct. 1, 2003, U.S. patent application Ser. No. 10/288,229, filed Nov. 5, 2002, U.S. patent application Ser. No. 10/676,376, filed Oct. 1, 2003 are hereby incorporated by reference in their entireties.

U.S. Pat. Pub. No. 2003/0150621 , U.S. Pat. No. 6,412,554 , U.S. Pat. Pub. No. 2005/0068703, U.S. Pat. Pub. No. 2005/0056419 , U.S. Pat. Pub. No. 2005/0230118 , and U.S. Pat. Pub. No. 2004/0069496 are hereby incorporated by reference in their entireties.

U.S. Prov. App. 60/952,539 , U.S. Pat. No. 6,719,071 , U.S. Pat. No. 6,837,313, U.S. Pat. No. 6,966,367 , U.S. Pat. Pub. No. 2004/0221997, U.S. Pat. Pub. No. 2005/0045337, and U.S. patent application Ser. No. 11/254,993 are herein incorporated by reference in their entireties.

BACKGROUND OF THE INVENTION

1. Field of the Invention

The present invention relates to annulus pressure control drilling systems and methods.

2. Description of the Related Art

The exploration and production of hydrocarbons from subsurface formations ultimately requires a method to reach and extract the hydrocarbons from the formation. This is typically achieved by drilling a well with a drilling rig. In its simplest form, this constitutes a land-based drilling rig that is used to support and rotate a drill string, comprised of a series of drill tubulars with a drill bit mounted at the end. Furthermore, a pumping system is used to circulate a fluid, comprised of a base fluid, typically water or oil, and various additives down the drill string, the fluid then exits through the rotating drill bit and flows back to surface via the annular space formed between the borehole wall and the drill bit. This fluid has multiple functions, such as: to provide pressure in the open wellbore in order to prevent the influx of fluid from the formation, provide support to the borehole wall, transport the cuttings produced by the drill bit to surface, provide hydraulic power to tools fixed in the drill string and cooling of the drill bit.

Clean drilling fluid is circulated into the well through the drill string and then returns to the surface through the annulus between the wellbore wall and the drill string. In offshore drilling operations, a riser is used to contain the annulus fluid between the sea floor and the drilling rig located on the surface. The pressure developed in the annulus is of particular concern because it is the fluid in the annulus that acts directly on the uncased borehole.

The fluid flowing through the annulus, typically known as returns, includes the drilling fluid, cuttings from the well, and any formation fluids that may enter the wellbore. After being circulated through the well, the drilling fluid flows back into a mud handling system, generally comprised of a shaker table, to remove solids, a mud pit and a manual or automatic means for addition of various chemicals or additives to keep the properties of the returned fluid as required for the drilling operation. Once the fluid has been treated, it is circulated back into the well via re-injection into the top of the drill string with the pumping system.

The open wellbore extends below the lowermost casing string, which is cemented to the formation at, and for some distance above, a casing shoe. In an open wellbore that extends into a porous formation, deposits from the drilling fluid will collect on wellbore wall and form a filter cake. The filter cake forms an important barrier between the formation fluids contained in the permeable formation at a certain pore pressure and the wellbore fluids that are circulating at a higher pressure. Thus, the filter cake provides a buffer that allows wellbore pressure to be maintained above pore pressure without significant losses of drilling fluid into the formation.

Both temperature and pressure of subsurface formations increase with depth. Subsurface formations may be characterized by two separate pressures: pore pressure and fracture pressure. The fracture pressure is determined in part by the overburden acting at a particular depth of the formation. The overburden includes all of the rock and other material that overlays, and therefore must be supported by, a particular level of the formation. In an offshore well, the overburden includes not only the sediment of the earth but also the water above the mudline. The pore pressure at a given depth is determined in part by the hydrostatic pressure of the fluids above that depth. These fluids include fluids within the formation below the seafloor/mudline plus the seawater from the seafloor to the sea surface.

In order to maximize the rate of drilling and avoid formation fluids entering the well, it is desirable to maintain the bottom hole pressure (BHP) in the annulus at a level above, but relatively close to, the pore pressure. Maintaining the BHP above the pore pressure is referred to as overbalanced drilling. As BHP increases, drilling rate will decrease, and if the BHP is allowed to increase to the point it exceeds the fracture pressure, a formation fracture can occur. Pressures in excess of the formation fracture pressure FP will result in the fluid pressurizing the formation walls to the extent that small cracks or fractures will open in the borehole wall and the fluid pressure overcomes the formation pressure with significant fluid invasion. Fluid invasion can result in reduced permeability, adversely affecting formation production. Once the formation fractures, returns flowing in the annulus may exit the open wellbore thereby decreasing the fluid column in the well. If this fluid is not replaced, the wellbore pressure can drop and allow formation fluids to enter the wellbore, causing a kick and potentially a blowout. Therefore, the formation fracture pressure defines an upper limit for allowable wellbore pressure in an open wellbore. The pressure margin between the pore pressure and the fracture pressure is known as a window.

The drilling fluid typically has a fairly constant density and thus the hydrostatic pressure in the wellbore versus depth can typically be approximated by a single gradient starting at the top of the fluid column. In offshore drilling situations, the top of the fluid column is generally the top of the riser at the surface platform. The pressure profile of a given drilling fluid varies depending upon whether the drilling fluid is being circulated (dynamic) or not being circulated (static). In the dynamic case, there is a pressure loss as the returns flow up the annulus between the drill string and wellbore wall. This pressure loss adds to the hydrostatic pressure of the drilling fluid in the annulus. Thus, this additional pressure must be taken into consideration to ensure that annulus pressure is maintained in an acceptable pressure range between the pore pressure and fracture pressure profile.

FIG. 1A is an exemplary diagram of the use of fluids during the drilling process in an intermediate borehole section. The borehole has been lined with a string of casing C to a first depth DC. The open hole section to be drilled is thus from the first depth DC to a target depth D4 of the bore hole. The two drilling fluid pressure profiles are represented by the static pressure SP and dynamic pressure DP profiles. The static pressure SP maintained by the fluid during drilling will be safely above the pore pressure PP above a second depth D2. At the second depth D2, the pore pressure PP increases, thereby reducing the differential between the pore pressure PP and the static pressure SP and also decreasing the margin of safety during operations. This may occur where the borehole penetrates a formation interval D2-D4 having significantly different characteristics than the prior formation DC-D2. A gas kick in this interval D2-D4 may result in the pore pressure exceeding the annulus pressure with a release of fluid and gas into the borehole, possibly requiring activation of the surface BOP stack. As noted above, while additional weighting material may be added to the fluid, it will be generally ineffective in dealing with a gas kick due to the time required to increase the fluid density as seen in the borehole.

For the given open hole interval DC-D4, the window for a particular density drilling fluid lies between the pore pressure profile PP and the fracture pressure profile FP. Because the dynamic pressure DP is higher than the static pressure SP, it is the dynamic pressure which is limited by the fracture pressure FP at a third depth D3. Correspondingly, the lower static pressure SP must be maintained above the pore pressure PP at the second depth D2 in the open wellbore. Therefore, the window for the particular density drilling fluid, as shown in FIG. 1, is limited by the dynamic pressure DP reaching fracture pressure FP at the depth D3 and the static pressure SP reaching pore pressure PP at the depth D2. Thus, in common drilling practice, the density of the drilling fluid will be chosen so that the dynamic pressure is as close as is reasonable to the fracture pressure. This maximizes the depth that can then be drilled using that density fluid. Once the dynamic pressure DP pressure approaches fracture pressure at the depth D3, another string of casing will be set and the same process repeated.

Recently, oil exploration and production is moving towards more challenging environments, such as deep and ultra-deepwater. Also, wells are now drilled in areas with increasing environmental and technical risks. In this context, narrow windows between the pore pressure and the fracture pressure of the formation are problematic.

FIG. 1B illustrates a prior art casing program for drilling a narrow-margin wellbore. Since this is a pressure gradient graph, constant density drilling fluids appear as vertical lines. On the right are the number and diameter of the casing strings required to safely drill a wellbore. Typically a safety margin is added to the pore pressure to allow for stopping circulation of the fluid and subtracted from the fracture pressure, reducing even more the narrow window, as shown by the dotted lines. Since the plot shown in FIG. 1B is referenced to the static mud pressure, the safety margin allows for the dynamic effect while drilling also. The pore pressure gradient and fracture pressure gradient curves shown are estimated before drilling. Actual values might never be determined by the current conventional drilling method. It is not difficult to imagine the problems created by drilling in a narrow window, with the requirement of several casing strings, increasing tremendously the cost of the well. Moreover, the current well design shown in FIG. 1B does not reach the required target depth for production, since the last casing size will be too small to allow for a sufficiently sized production tubing string which will deliver oil to the surface at a sufficient flow rate to justify the cost of drilling and completing the well. In many of these cases, the wells are abandoned, leaving the operators with huge losses.

These problems are further compounded and complicated by the density variations caused by temperature changes along the wellbore, especially in deepwater wells. This can lead to significant problems, relative to the narrow window, when wells are shut in to detect kicks/fluid losses. The cooling effect and subsequent density changes can modify the annulus pressure profile due to the temperature effect on mud viscosity, and due to the density increase leading to further complications on resuming circulation. Thus using the conventional method for wells in ultra deep water is rapidly reaching technical limits.

The influx of formation fluids into the wellbore is referred to as a kick. Even when using conservative overbalanced drilling techniques, the wellbore pressure may fall out of the acceptable range between pore pressure and fracture pressure and cause a kick. Kicks may occur for reasons, such as drilling through an abnormally high pressure formation, creating a swabbing effect when pulling the drill string out of the well for changing a bit, not replacing the drilling fluid displaced by the drill string when pulling the drill string out of the hole, and, as discussed above, fluid loss into the formation. A kick may be recognized by drilling fluids flowing up through the annulus after pumping is stopped. A kick may also be recognized by a sudden increase of the fluid level in the drilling fluid storage tanks. Because the formation fluid entering the wellbore ordinarily has a lower density than the drilling fluid, a kick will potentially reduce the hydrostatic pressure within the well and allow an accelerating influx of formation fluid. If not properly controlled, this influx is known as a blowout and may result in the loss of the well, the drilling rig, and possibly the lives of those operating the rig.

There are two commonly used methods for controlling kicks, namely the driller's method and the engineer's method. In both methods the well is shut in and the wellbore pressure allowed to stabilize. The pressure will stabilize when the pressure at the bottom of the hole equalizes with formation pressure. The pressure indicated at the surface in the drill string and the casing annulus can be used to calculate the pressure at the bottom of the wellbore. With the well in the shut-in condition, the pressure at the bottom of the wellbore will be the formation pressure.

When using the driller's method, once the wellbore pressure has stabilized, the pumps are restarted and drilling fluid is circulated through the well. The pressure within the casing is maintained so that no additional formation fluids flow into the well and fluid is circulated until any gas that has entered the wellbore has been removed. A higher density drilling fluid is then prepared and circulated through the well to bring the wellbore pressures back to within the desired pressure range. Thus, when killing a kick using the driller's method, the fluid within the wellbore is fully circulated twice.

When using the engineer's method, as the wellbore pressure stabilizes, the formation pressure is calculated. Based on the calculated formation pressure, a mixture of higher density drilling fluid is prepared and circulated through the well to kill the kick and circulate out any formation fluids in the wellbore. During this circulation, the annulus pressure is maintained until the heavy weight drilling fluid circulates completely through the well. Using the engineer's method, the kick can be killed in a single circulation, as opposed to the two circulation driller's method.

The key parameter for well control is determining the formation pressure and adjusting the annulus pressure profile accordingly. If the annulus pressure is allowed to decrease below the pore pressure at a certain depth, formation fluids will enter the well. If the annulus pressure exceeds fracture pressure at a certain depth, the formation will fracture and wellbore fluids may enter the formation. Conventionally, the BHP is calculated using drill pipe and annulus pressures measured at the surface. To accurately measure these surface pressures; circulation is normally stopped to allow the BHP to stabilize and to eliminate any dynamic component of the annulus pressure. Once this occurs, the well is fully shut in. Shutting the well in uses valuable rig time and involves a drilling stoppage, which may cause other problems, such as a stuck drill string.

Some drilling operations seek to determine a wellbore pressure (i.e., annulus pressure and/or pore pressure) using measurement while drilling (MWD) techniques. One deficiency of the prior art MWD methods is that many tools transmit pressure measurement data back to the surface on an intermittent basis. Many MWD tools incorporate several measurement tools, such as gamma ray sensors, neutron sensors, and densitometers, and typically only one measurement is transmitted back to the surface at a time. Accordingly, the interval between pressure data being reported may be as much as two minutes.

Transmitting the data back to the surface can be accomplished by one of several telemetry methods. One typical prior art telemetry method is mud pulse telemetry. A signal is transmitted by a series of pressure pulses through the drilling fluid. These small pressure variances are received and processed into useful information by equipment at the surface. Mud pulse telemetry systems exhibit low bandwidths, for example between about two-tenths of a bit and about ten bits per second. Further, the velocity of sound through mud varies from about three thousand three hundred feet per second to about five thousand feet per second, meaning that the pulse could take several seconds to travel from the bottom of a deep well to the surface. Further, attenuation is significant for higher frequency pulses. Mud pulse telemetry does not work or does not work well when fluids are not being circulated, are being circulated at a slow rate, and/or when gasified drilling fluid is used. Therefore, mud pulse telemetry and therefore standard MWD tools have very little utility when the well is shut in and fluid is not circulating.

Although MWD tools can not transmit data via mud pulse telemetry when the well is not circulating, many MWD tools can continue to take measurements and store the collected data in memory. The data can then be retrieved from memory at a later time when the entire drilling assembly is pulled out of the hole. In this manner, the operators can learn whether they have been swabbing the well, i.e. pulling fluids into the borehole, or surging the well, i.e. increasing the annulus pressure, as the drill string moves through the wellbore.

Another telemetry method of sending data to the surface is electromagnetic (EM) telemetry. A low frequency radio wave is transmitted through the formation to a receiver at the surface. EM telemetry systems also exhibit low bandwidths, for example about seven bits per second. EM telemetry is depth limited, and the signal attenuates quickly in water. Therefore, with wells being drilled in deep water, the signal will propagate fairly well through the earth but it will not propagate through the deep water. Accordingly, for deep water wells, a subsea receiver would have to be installed at the mud line, which may not be practical. Further, certain formations, i.e., salt domes, also serve as EM barriers.

Thus, there remains a need in the art for methods and apparatuses for measuring and controlling annulus pressure (i.e., BHP) based on real-time pressure data received from a location at or near an open hole section of a wellbore being drilled.

SUMMARY OF THE INVENTION

In one embodiment, a method for drilling a wellbore includes an act of drilling the wellbore by injecting drilling fluid through a tubular string disposed in the wellbore, the tubular string comprising a drill bit disposed on a bottom thereof. The drilling fluid exits the drill bit and carries cuttings from the drill bit. The drilling fluid and cuttings (returns) flow to a surface of the wellbore via an annulus defined by an outer surface of the tubular string and an inner surface of the wellbore. The method further includes an act performed while drilling the wellbore of measuring a first annulus pressure (FAP) using a pressure sensor attached to a casing string hung from a wellhead of the wellbore. The method further includes an act performed while drilling the wellbore of controlling a second annulus pressure (SAP) exerted on a formation exposed to the annulus.

In another embodiment, a method for drilling a wellbore includes an act of drilling the wellbore by injecting drilling fluid into a tubular string comprising a drill bit disposed on a bottom thereof. The drilling fluid is injected at a drilling rig. The method further includes an act performed while drilling the wellbore and at the drilling rig of continuously receiving a first annulus pressure (FAP) measurement measured at a location distal from the drilling rig and distal from a bottom of the wellbore. The method further includes an act performed while drilling the wellbore and at the drilling rig of continuously calculating a second annulus pressure (SAP) exerted on an exposed portion of the wellbore. The method further includes an act performed while drilling the wellbore and at the drilling rig of controlling the SAP.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 18A is a pressure profile, similar to FIG. 1A, showing advantages of one drilling mode that may be performed by any of the drilling systems of FIGS. 2, 2B, and 3-9, 10A, 10B, 10H, 11A, 11B, and 12-14. FIG. 18B is a casing program, similar to FIG. 1B, showing advantages of one drilling mode that may be performed by any of the drilling systems of FIGS. 2, 2B, and 3-9, 10A, 10B, 10H, 11A, 11B, and 12-14.

DETAILED DESCRIPTION

Figure 2:
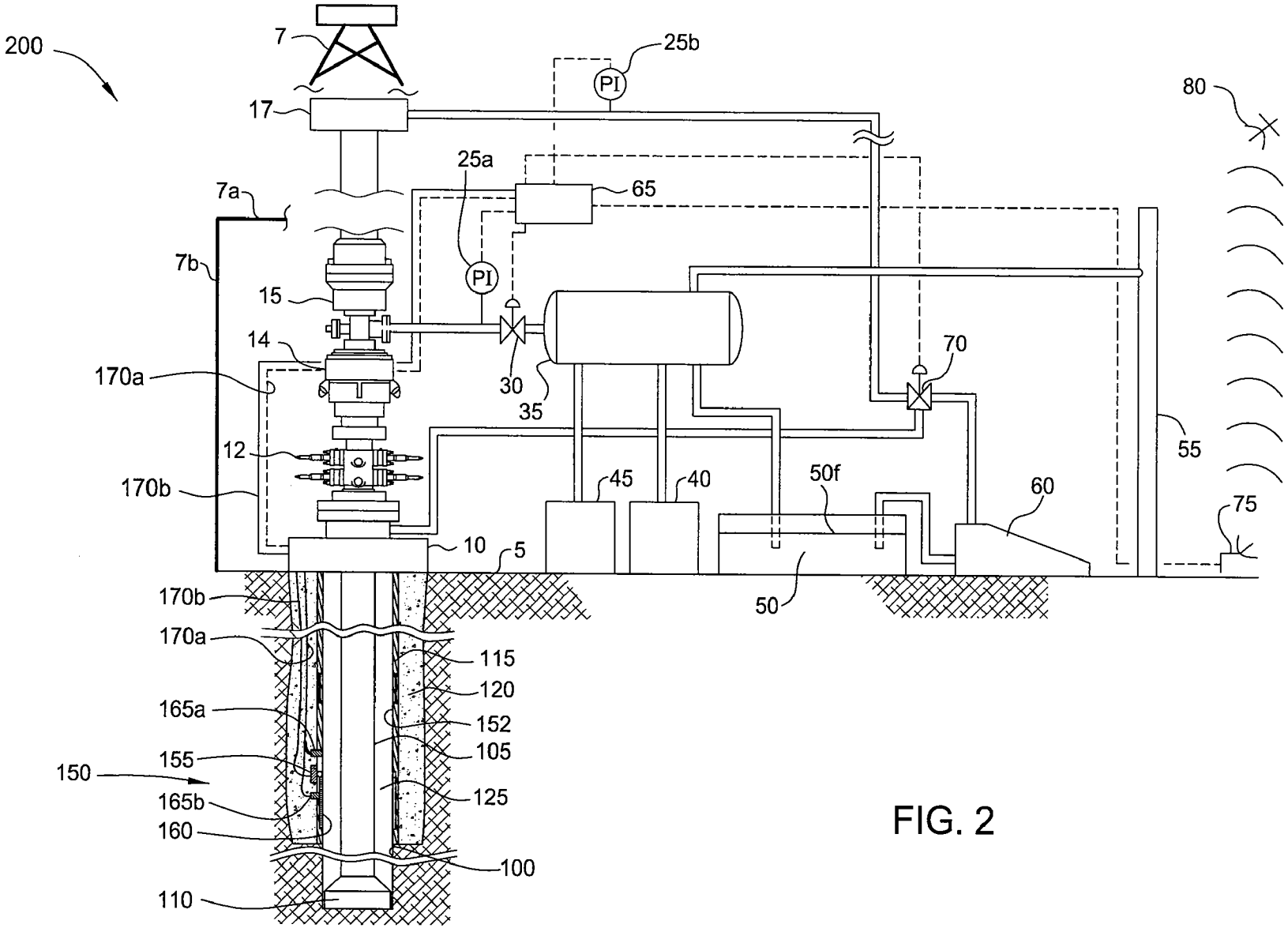
FIG. 2 is a schematic depicting a land-based drilling system, according to one embodiment of the present invention.

FIG. 2 is a schematic depicting a land-based drilling system 200, according to one embodiment of the present invention. Alternatively, the drilling system 200 could be used offshore (see FIG. 2B). The drilling system 200 includes a drilling rig 7,7*a*,7*b* that is used to support drilling operations. The drilling rig 7,7*a*,7*b* includes a derrick 7 supported from a support structure 7*b* having a rig floor or platform 7*a* on which drilling operators may work. Many of the components used on the rig such as an optional Kelly, power tongs, slips, draw works and other equipment are not shown for ease of depiction. A wellbore 100 has already been partially drilled, casing 115 set and cemented 120 into place. The casing string 115 extends from a surface of the wellbore 100 where a wellhead 10 would typically be located. A downhole deployment valve (DDV) 150 is installed in the casing 115 to isolate an upper longitudinal portion of the wellbore 100 from a lower longitudinal portion of the wellbore (when the drillstring 105 is retracted into the upper longitudinal portion).

The drill string 105 includes a drill bit 110 disposed on a longitudinal end thereof. The drill string 105 may be made up of joints or segments of tubulars threaded together or coiled tubing. The drill string 105 may also include a bottom hole assembly (BHA) (not shown) that may include such equipment as a mud motor, a MWD/LWD sensor suite, and a check valve (to prevent backflow of fluid from the annulus), etc. Alternatively, the drill string 105 may be a second casing string or a liner string. Drilling with casing or liner is discussed with FIG. 14, below. As noted above, the drilling process requires the use of a drilling fluid 50*f*, which is stored in a reservoir or mud tank 50. The drilling fluid 50*f* may be water, water based mud, oil, oil-based mud, foam, mist, a gas, such as nitrogen or natural gas, or a liquid/gas mixture. The reservoir 50 is in fluid communication with one or more mud pumps 60 which pump the drilling fluid 50*f* through an outlet conduit, such as pipe. If the drilling fluid 50*f* is oil or oil-based, the mud tank may have a gas line in communication with a flare 55 (see FIG. 3). The outlet pipe is in fluid communication with the last joint or segment of the drill string 105 that passes through a rotating control device (RCD) or rotating blowout preventer (RBOP) 15. A pressure sensor (PI) 25*b* or pressure and temperature (PT) sensor may be disposed in the outlet pipe and in data (i.e., electrical or optical) communication with a surface monitoring and control unit (SMCU) 65.

The RCD 15 provides an effective annular seal around the drill string 105 during drilling and while adding or removing (i.e., during a tripping operation to change a worn bit) segments to the drill string 105. The RCD 15 achieves this by packing off around the drill string 105. The RCD 15 includes a pressure-containing housing where one or more packer elements are supported between bearings and isolated by mechanical seals. The RCD 15 may be the active type or the passive type. The active type RCD uses external hydraulic pressure to activate the sealing mechanism. The sealing pressure is normally increased as the annulus pressure increases. The passive type RCD uses a mechanical seal with the sealing action activated by wellbore pressure. If the drillstring 105 is coiled tubing or segmented tubing using a mud motor, a stripper (not shown) may be used instead of the RCD 15. Also illustrated are conventional blow out preventers (BOPs) 12 and 14 attached to the wellhead 10. If the RCD is the active type, it may be in communication with and/or controlled by the SMCU 65.

The drilling fluid 50*f* is pumped into the drill string 105 via a Kelly, drilling swivel or top drive 17. The fluid 50*f* is pumped down through the drill string 105 and exits the drill bit 110, where it circulates the cuttings away from the bit 110 and returns them up an annulus 125 defined between an inner surface of the casing 115 or wellbore 100 and an outer surface of the drill string 105. The return mixture (returns) 50*r* returns to the surface and is diverted through an outlet line of the RCD 15 and a control valve or a variable choke valve 30. The choke 30 may be fortified to operate in an environment where the returns 50*r* contain substantial drill cuttings and other solids. The choke 30 allows the SMCU to control backpressure exerted on the annulus 125, discussed below (see FIGS. 18A and 18B). A pressure (or PT) sensor 25*a* is disposed in the RCD outlet line and is in data communication with the SMCU 65.

Instead of, or in addition to, the choke 30, the density and/or viscosity of the drilling fluid 50*f* can be controlled by automated drilling fluid control systems. Not only can the density/viscosity of the drilling fluid be quickly changed, but there also may be a computer calculated schedule for drilling fluid density/viscosity increases and pumping rates so that the volume, density, and/or viscosity of fluid passing through the system is known. The pump rate, fluid density, viscosity, and/or choke orifice size can then be varied to maintain the desired constant pressure.

The returns 50*r* are then processed by a separator 35 designed to remove contaminates, including cuttings, from the drilling fluid 50*f*. The separator 35 may be a shaker, a horizontal separator, a vertical separator, or a centrifugal separator and may separate two or more phases. The separator 35 may include an outlet line to a solids tank 45, an outlet line to a water or oil tank 40, an outlet line to a flare or gas recovery line 55 for gas, and an outlet line for recycled drilling fluid 50*f* (i.e., water or oil) to the drilling fluid reservoir 50. Alternatively, a shaker may be used in parallel with a three-phase (or more) separator with an automated diverter valve between the two. During normal operation, the shaker may be selected. If the SMCU 65 detects a kick, the SMCU 65 may switch the returns to the three-phase separator to handle gas until control over the wellbore is restored. Additionally, the separator 35 may be three or more phase and may be used in tandem with a shaker 335 (see FIG. 3).

A three-way valve (or two gate valves) 70 is placed in an outlet line of the rig pump 60 and in communication with the SMCU 65. A bypass conduit fluidly connects the rig pump 60 with the wellhead 10 via the three-way valve 70, thereby bypassing the inlet to the interior of drill string 105. The three-way valve 70 allows drilling fluid 50*f* from the rig pumps 60 to be completely diverted from the drill string 105 to the annulus 125 during tripping operations to provide backpressure thereto. In operation, three-way valve 70 would select either the drill pipe conduit or the bypass conduit, and the rig pump 60 engaged to ensure sufficient flow passes through the choke 30 to be able to maintain backpressure, even when there is no flow coming from the annulus 125. Alternatively, a separate pump (not shown) may be used instead of the three-way valve 70 to maintain pressure control in the annulus 125. Alternatively, a secondary fluid may be pumped or injected into the annulus 125 instead of drilling fluid 50*f*.

Additionally, a single phase (FM) or multi-phase flow meter (MPM) (not shown, see FIG. 6A) may be provided in the RCD outlet line upstream of the choke 30. The FM or MPM may be a mass-balance type or other high-resolution flow meter. Utilizing the FM or MPM, an operator will be able to determine how much drilling fluid 50*f* has been pumped into the wellbore 100 through drill string 105 and the amount of returns 50*r* exiting the wellbore 100. Based on differences in the amount of fluid 50*f* pumped versus returns 50*f* recovered, the operator is able to determine whether returns 50*r* are being lost to a formation surrounding the wellbore 100, which may indicate that formation fracturing has occurred, i.e., a significant negative fluid differential. Likewise, a significant positive differential would be indicative of formation fluid entering into the well bore (a kick). Additionally, an FM/MPM (not shown) may be provided in the outlet line of the rig pump 60. Alternatively, an FM may be placed in each outlet line from the separator 35.

The DDV 150 includes a tubular housing 152, a flapper 160 having a hinge at one end, and a valve seat in an inner diameter of the housing 152 adjacent the flapper 160. Alternatively, a ball valve (not shown) may be used instead of the flapper 160. The housing 152 may be connected to the casing string 115 with a threaded connection, thereby making the DDV 150 an integral part of the casing string 115 and allowing the DDV 150 to be run into the wellbore 100 along with the casing string 115 prior to cementing. Alternatively, see (FIGS. 11A and 11B) the DDV 150 may be run in on a tie-back casing string. The housing 152 protects the components of the DDV 150 from damage during run in and cementing. Arrangement of the flapper 160 allows it to close in an upward fashion wherein pressure in a lower portion of the wellbore will act to keep the flapper 160 in a closed position. The DDV 110 is in communication with a surface monitoring and control unit (SMCU) 65 to permit the flapper 160 to be opened and closed remotely from the surface 5 of the well 100. The DDV 150 further includes a mechanical-type actuator 155 (shown schematically), such as a piston, and one or more control lines 170*a,b* that can carry hydraulic fluid, electrical currents, and/or optical signals. As shown, line 170*a* includes a data line and a power line and line 170*b* is a hydraulic line. Clamps (not shown) can hold the control lines 170*a,b* next to the casing string 115 at regular intervals to protect the control lines 170*a,b*. Alternatively, the casing string 115 may be a wired casing string 215 (see FIG. 2A).

The flapper 160 may be held in an open position by a tubular sleeve (not shown, a.k.a. a flow tube) coupled to the piston. The flow tube may be longitudinally moveable to force the flapper 160 open and cover the flapper 160 in the open position, thereby ensuring a substantially unobstructed bore through the DDV 150. The hydraulic piston is operated by pressure supplied from the control line 170*b* and actuates the flow tube. Alternatively, the flow tube may be actuated by interactions with the drill string based on rotational or longitudinal movements of the drill string, the DDV 150 may include a sensor that detects the drill string 105 or receives a signal from the drill string 105, the flow tube may include a magnetic coupling that interacts with a magnetic coupling on the drill string 105, the DDV 150 may be actuated by pressure in the tie-back annulus in a tie-back installation, or the DDV 150 may include an electric motor instead of a hydraulic actuator. Additionally, the DDV 150 may include a series of slots and pins (not shown) so that the DDV may be selectively locked into an opened or closed position. A valve seat (not shown) in the housing 152 receives the flapper 160 as it closes. Once the flow tube longitudinally moves out of the way of the flapper 160 and the flapper engaging end of the valve seat, a biasing member (not shown) may bias the flapper 160 against the flapper engaging end of the valve seat. The biasing member may be a spring or a gas charge. Alternatively, a second control line may be provided instead of the biasing member to actuate the flow tube. In addition to the biasing member, a second control line may be provided as a balance line.

The DDV 150 may further include one or more pressure (or PT) sensors 165*a, b*. As shown, an upper pressure sensor 165*a* is placed in an upper portion of the wellbore 100 (above the flapper 160) and a lower pressure sensor 165*b* placed in the lower portion of the wellbore (below the flapper 160 when closed). The upper pressure sensor 165*a* and the lower pressure sensor 165*b* can determine a fluid pressure within an upper portion and a lower portion of the wellbore, respectively. Additional sensors (not shown) may optionally be located in the housing 152 of the DDV 150 to measure any wellbore condition or DDV parameter, such as a position of the flow tube and the presence or absence of a drill string. The additional sensors can determine a fluid composition, such as an oil to water ratio, an oil to gas ratio, or a gas to liquid ratio. The sensors may be connected to a controller (not shown) in the DDV 150. Power supply to the controller and data transfer therefrom to the SMCU 65 is achieved by the control line 170*a*.

When the drill string 105 is moved longitudinally above the DDV 150 and the DDV 150 is in the closed position, the upper portion of the wellbore 100 is isolated from the lower portion of the wellbore 100 and any pressure remaining in the upper portion can be bled out through the choke valve 30 at the surface 5 of the wellbore 100. Isolating the upper portion of the wellbore facilitates operations such as inserting or removing a bottom hole assembly of the drill string 105. The BHA may include a bit, mud motor, MWD and/or LWD devices, rotary steering devices, etc. In later completion stages of the wellbore 100, equipment, such as perforating systems, screens, and slotted liner systems may also be inserted/removed in/from the wellbore 100 using the DDV 150. Because the DDV 150 may be located at a depth in the wellbore 100 which is greater than the length of the BHA or other equipment, the BHA or other equipment can be completely contained in the upper portion of the wellbore 100 while the upper portion is isolated from the lower portion of the wellbore 100 by the DDV 150 in the closed position.

Prior to opening the DDV 150, fluid pressures in the upper portion of the wellbore 100 and the lower portion of the wellbore 100 at the flapper 160 in the DDV 150 must be equalized or nearly equalized to effectively and safely open the flapper 160. Usually, the upper portion will be at a lower pressure than the lower portion. Based on data obtained from the pressure sensors 165*a,b* by the SMCU 65, the pressure conditions and differentials in the upper portion and lower portion of the wellbore 100 can be accurately equalized prior to opening the DDV 150, for example, by using the mud pump 60 and the three-way valve 70. Alternatively, instead of the DDV 150, an instrumentation sub including a pressure (or PT) sensor without the valve may be used.

The sensors 165*a, b* may be electro-mechanical sensors that use strain gages mounted on a diaphragm in a Wheatstone bridge configuration or solid state piezoelectric or magnetostrictive materials. Alternatively, the sensors 165*a,b* may be optical sensors, such as those described in U.S. Pat. No. 6,422,084, which is herein incorporated by reference in its entirety. For example, the optical sensors 165*a,b* may comprise an optical fiber, having the reflective element embedded therein; and a tube, having the optical fiber and the reflective element encased therein along a longitudinal axis of the tube, the tube being fused to at least a portion of the fiber. Alternatively, the optical sensor 362 may comprise a large diameter optical waveguide having an outer cladding and an inner core disposed therein. Alternatively, the sensors 165*a, b* may be Bragg grating sensors which are described in commonly-owned U.S. Pat. No. 6,072,567, entitled "Vertical Seismic Profiling System Having Vertical Seismic Profiling Optical Signal Processing Equipment and Fiber Bragg Grafting Optical Sensors", issued Jun. 6, 2000, which is herein incorporated by reference in its entirety. Construction and operation of the optical sensors suitable for use with the DDV 150, in the embodiment of an FBG sensor, is described in the U.S. Pat. No. 6,597,711 issued on Jul. 22, 2003 and entitled "Bragg Grating-Based Laser", which is herein incorporated by reference in its entirety. Each Bragg grating is constructed so as to reflect a particular wavelength or frequency of light propagating along the core, back in the direction of the light source from which it was launched. In particular, the wavelength of the Bragg grating is shifted to provide the sensor.

The optical sensors may also be FBG-based inferometric sensors. An embodiment of an FBG-based inferometric sensor which may be used as the optical sensors 165*a, b* is described in U.S. Pat. No. 6,175,108 issued on Jan. 16, 2001 and entitled "Accelerometer featuring fiber optic bragg grating sensor for providing multiplexed multi-axis acceleration sensing", which is herein incorporated by reference in its entirety. The inferometric sensor includes two FBG wavelengths separated by a length of fiber. Upon change in the length of the fiber between the two wavelengths, a change in arrival time of light reflected from one wavelength to the other wavelength is measured. The change in arrival time indicates pressure measured by one of the sensors.

The SMCU 65 may include a hydraulic pump and a series of valves utilized in operating the DDV 150 by fluid communication through the control line 170*b*. The SMCU 65 may also include a hydraulic, pneumatic, or electical unit for operating the choke 30. The SMCU 65 may also include a programmable logic controller (PLC) based system or a central processing unit (CPU) based system for monitoring and controlling the DDV and other parameters, circuitry for interfacing with downhole electronics, an onboard display, and standard interfaces (not shown), such as RS-232 or USB, for interfacing with external devices, such as a laptop computer and/or other rig equipment. In this arrangement, the SMCU 65 outputs information obtained by the sensors and/or receivers in the wellbore to the display. Using the arrangement illustrated, the pressure differential between the upper portion and the lower portion of the wellbore can be monitored and adjusted to an optimum level for opening the DDV. In addition to pressure information near the DDV, the system can also include proximity sensors that describe the position of the sleeve in the valve that is responsible for retaining the valve in the open position. By ensuring that the sleeve is entirely in the open or the closed position, the valve can be operated more effectively. A satellite, microwave, or other long-distance data transceiver or transmitter 75 may be provided in electrical communication with the SMCU 65 for relaying information from the SMCU 65 to a satellite 80 or other long-distance data transfer medium. The satellite 80 relays the information to a second transceiver or receiver where it may be relayed to the Internet or an intranet for remote viewing by a technician or engineer.

Conventionally, an operator monitors the pressure gauge 25*a* at the surface. However, there is a delay in the surface readings based on bottomhole pressure because the effect of changes in the downhole pressure must propagate to the surface (at the speed of sound). Thus, the adjustment of pumping rates is being performed on a delayed basis relative to the actual pressure changes at the bottom of the hole. However, if the pressure measurements are taken downhole in real-time, the downhole pressure is read substantially instantaneously and the ability to control the well is improved.

Figure 2A:
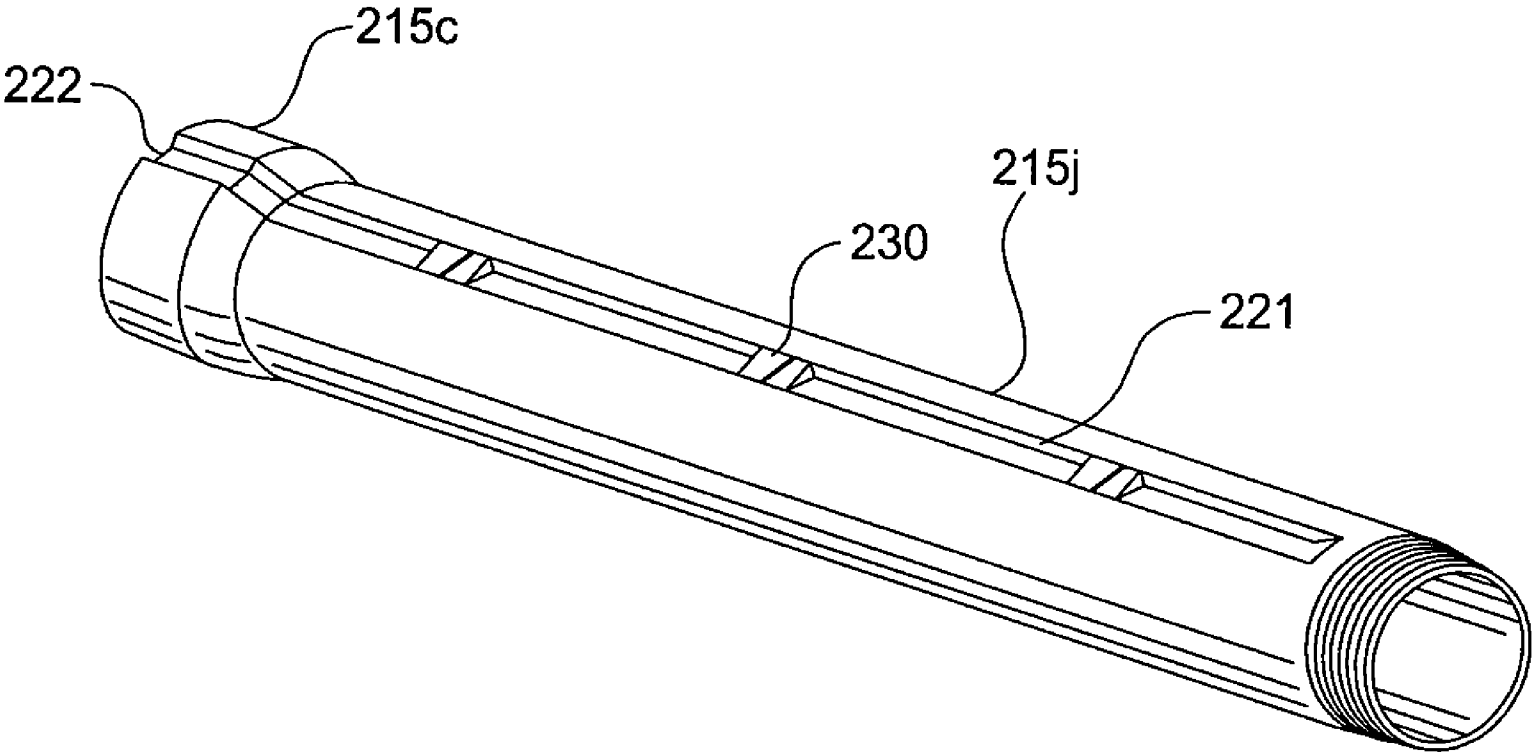
FIG. 2A illustrates a section or joint of wired casing for optional use with the drilling system of FIG. 2.

FIG. 2A illustrates a section or joint 215*j* of wired casing for optional use with the drilling system 200. The joint has a longitudinal groove 221 formed therein. The joint includes a coupling 215*c* at a first end thereof having a longitudinal groove 222 formed therein and threads at a second end thereof for connection to other identical joints. The grooves 221 and 222 may be sub-flushed to the surface of the joint 215*j* and coupling 215*c*, respectively. Additionally, one or more clamps 230 may be disposed in the groove 221. The joint 215*j* and the coupling 215*c* connected by a threaded connection so that the grooves 221, 222 are aligned with one another to form a continuous groove along the length of the joint 215*j* and the coupling 215*c*. Alternatively, the coupling 215*c* may welded to the joint 215*j*. The grooves 221, 222 are designed to receive and house one or more control lines 170*a, b*. The groove 222 of the coupling 215*c* slopes upward from the groove 121 of the joint 215*j* as the coupling 215*c* is larger in diameter than the joint 215*j* so that the male threads of the joint 215*j* may be housed within the female threads of coupling 215*c*. Accordingly, the control lines 170*a, b* ramp upward from the joint 215*j* to the coupling 215*c* when disposed within the grooves 221, 222. Correspondingly, the control lines 170*a, b* will ramp downward into the groove of the second joint. Alternatively, the wired joint may include a bore formed (i.e., gun drilled) longitudinally through the wall of the joint for disposal of an electric line therein. The alternative wired joint would then communicate with other wired joints via inductive couplings, discussed below regarding FIG. 9 (or alternatives discussed therewith).

Figure 2B:
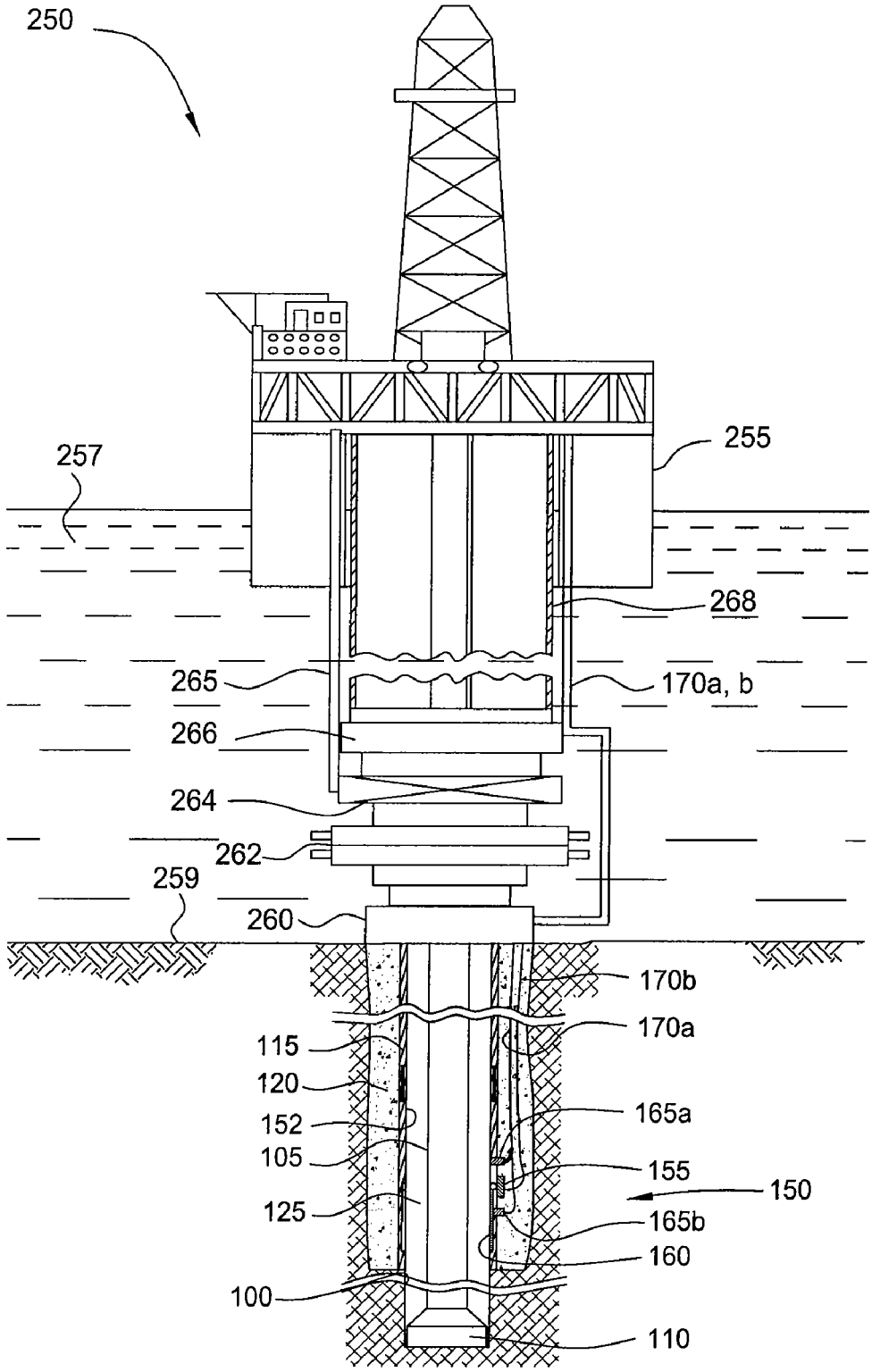
FIG. 2B illustrates an offshore drilling system, according to another embodiment of the present invention.

FIG. 2B illustrates an offshore drilling system 250, according to another embodiment of the present invention. A floating vessel 255 is shown but other offshore drilling vessels may be used. Surface equipment similar to that of drilling system 1 or 200 may be included on the vessel 255. A tubular riser string 268 is normally used to interconnect the floating vessel 255 and a wellhead 260 disposed on the sea floor 259. The riser string 268 conducts returns 50*r* back to the floating vessel 255 during drilling through an annulus created between the riser string 268 and the drillstring 105. The riser string 268 is exaggerated for clarity. Also connected to the wellhead are two or more ram-BOPs 262 and an annular BOP 266. A riser bypass valve 264 is also connected to the wellhead 260. A bypass line 265 extends from the bypass valve 264 to the floating vessel 255. When adding or removing a segment to or from the drill string 105, drilling fluid 50*f* may be injected via the bypass line 265 and bypass valve 264 or via the riser string 268.

Alternatively, instead of disposing the DDV 150 with pressure sensors 165*a, b*, or a pressure sensor in the casing string 115, a pressure (or PT sensor) (not shown) may be attached to the riser string 268 in fluid communication with an annulus defined between the riser string 268 and the drill string 105. A control line may then place the riser pressure sensor in data communication with the SMCU 65. The riser pressure sensor may be attached to the riser 268 at or near a bottom of the riser or instead be disposed in the wellhead 260. Additionally, the riser/wellhead pressure sensor may be used with the DDV 150 (with pressure sensors 165*a, b*) and/or a pressure sensor in the casing string 115.

Figure 3:
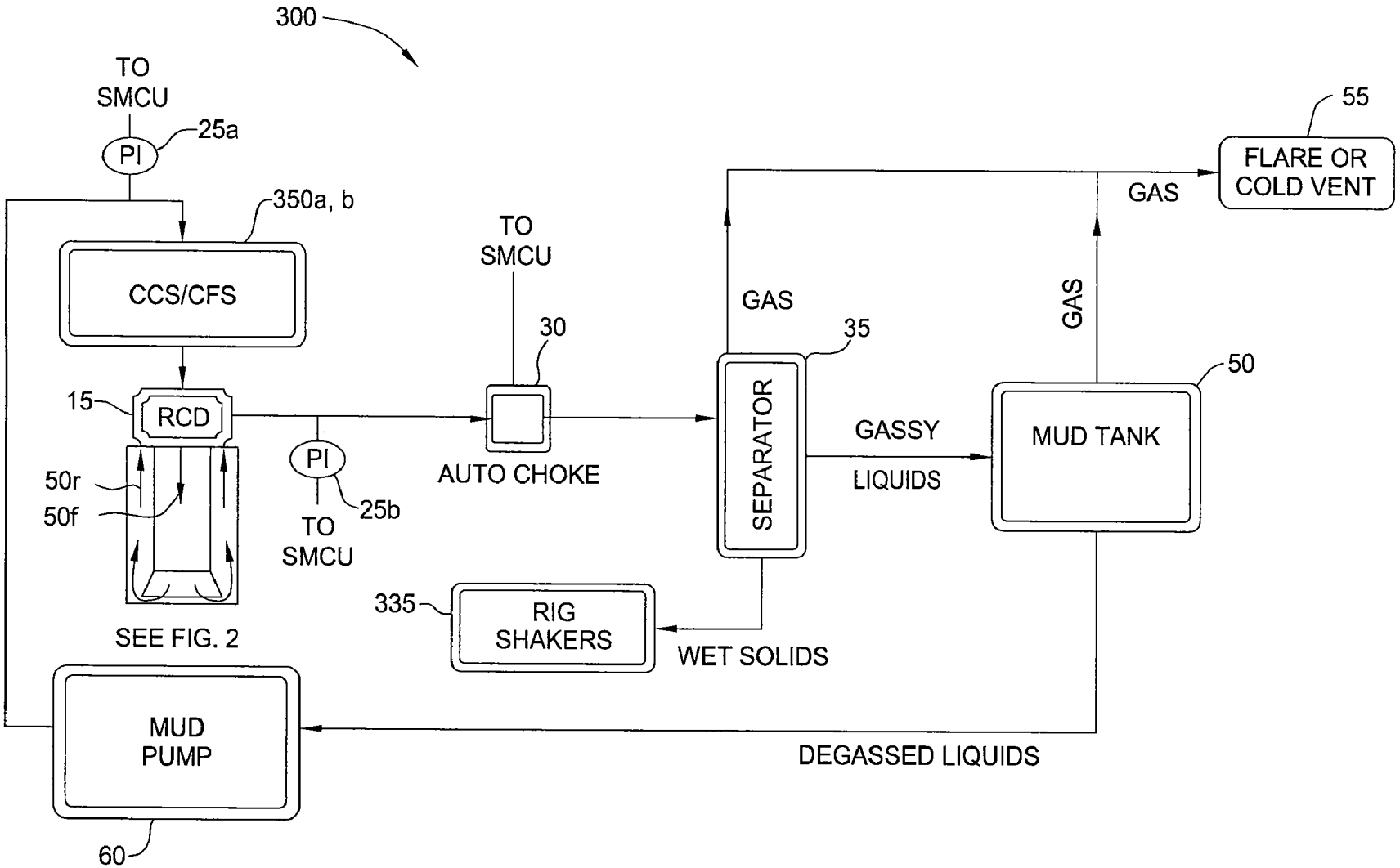
FIG. 3 illustrates a drilling system, according to another embodiment of the present invention.

FIG. 3 illustrates a drilling system 300, according to another embodiment of the present invention. Although shown simply, the downhole configuration may be similar to that of the drilling system 200. As compared to the drilling system 200, a continuous circulation system (CCS) 350 or a continuous flow sub (CFS) 350*b* is used instead of the three-way valve 70 to maintain pressure control of the annulus during tripping of the drill string 105. The CCS 350*a* or the CFS 350*b* allows circulation of drilling fluid through the drill string 105 to be maintained during tripping of the drill string 105. Additionally, the CCS/CFS 350*a, b* may be used with the three-way valve 70. Alternatively, the CCS/CFS 350*a, b* may be used without the choke valve 30. In this alternative, a variable speed drive may be installed in the prime mover or a control valve or variable choke valve (not shown) could be installed on the outlet line of the rig pump 60 to vary an injection rate of the drilling fluid to control annulus pressure during drilling instead of applying back pressure with the choke valve 30.

Figure 3A:
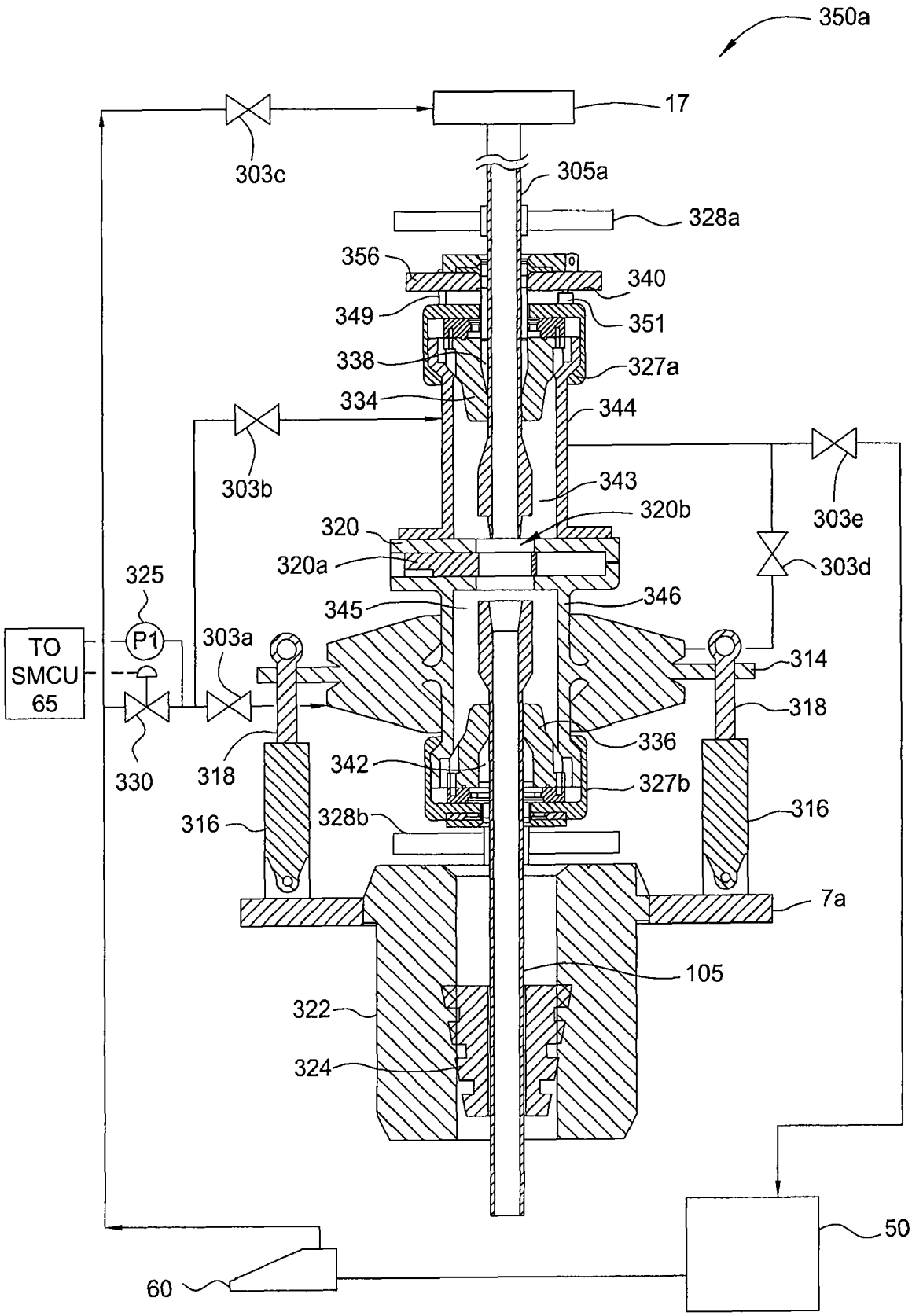
FIG. 3A shows a continuous circulation system (CCS) suitable for use with the drilling system of FIG. 3.

FIG. 3A shows a suitable CCS 350*a*. The CCS 350*a* includes a platform 314 movably mounted to and above the rig floor 7*a*. Each of two cylinders 316 has a movable piston 318 movable to raise and lower the platform 314 to which other components of the CCS 350*a* are connected. Any suitable piston/cylinder may be used for each of the cylinders 316/pistons 318 with suitable known control apparatuses, flow lines, consoles, switches, etc. so that the platform 314 is movable by an operator or automatically. Movement of the platform 314 may be guided and controlled by a bushings secured to the platform 314 which may slide along guide posts attached to the rig floor 7*a*. The top drive or the swivel 17 is connected to a segment 305*a* which will be connected to the drill string 105. An optional saver sub is interconnected between the top drive 17 and the segment 305*a*.

A spider 322 including, but not limited to, known flush-mounted spiders, or other apparatus extends beneath the rig floor 7*a* and accommodates movable slips 324 for releasably engaging and holding the drill string 105 extending down from the rig floor 7*a* into the wellbore 100. The spider 322, in one aspect, may have keyed slips, e.g. slips held with a key that is received and held in recesses in the spider body and slip so that the slips do not move or rotate with respect to the body.

The CCS 350*a* has upper control head 327*a* and lower control head 327*b*. These may be known commercially available rotating control heads. The drill segment 305*a* is passable through a stripper seal 334 of the upper control head 327*a* to an upper chamber 343 and an upper portion of the drill string 105 passes through a stripper seal 336 of the lower control head 327*b* to a lower chamber 345. The segment 305*a* is passable through an upper sabot or inner bushing 338. The upper sabot 338 is releasably held within the upper chamber by an activation device 340. Similarly, the upper portion of the drill string 105 passes through a lower sabot or inner bushing 342.

The CCS 350*a* further includes upper 344 and lower 346 housings. Within housings 344,346 are, respectively, the upper chamber 343 and the lower chamber 345. The stripper seals 334,336 seal around the drill string segment 305*a* and drill sting 105 and wipe them. The sabots or inner bushings 338, 342 protect the stripper seals 334,336 from damage due to the drill string segment 305*a* and drill sting 105 passing through them. The sabots 338,342 also facilitate entry of the drill string segment 305*a* and drill sting 105 into the stripper seals 334,336.

Movement of the upper sabot or inner bushing 338 with respect to the stripper seal 334 is accomplished by the activation device 340 which, in one aspect, involves the expansion or retraction of one or more pistons 349 of one or more cylinders 351. The cylinders 351 are secured to clamp parts (which are releasably clamped together) of the control head 327*a*. The pistons 349 are secured, respectively, to a ring 356 to which the upper sabot 338 is also secured. The pistons 349/cylinders 351 may be any known suitable cylinder/piston assembly with suitable known control apparatuses, flow lines, switches, consoles, etc. so that the sabots are selectively movable by an operator (or automatically) as desired, e.g. to expand and protect the upper stripper seal 334 during drill string 105/segment 305*a* passage therethrough, then to remove the upper sabot 338 to permit the upper stripper seal 334 to seal against the drill string 105/segment 305*a*. A second activation device (not shown) is also provided for the lower control head 327*b*.

Disposed between the housings 344, 346 is a gate valve 320 which includes a movable gate 320*a* therein to sealingly isolate the upper chamber 343 from the lower chamber 345. Joint connection and disconnection may be accomplished in the lower chamber 345 or in the upper chamber 343. The gate valve 320 defines a central chamber 320*b* within which the connection and disconnection the drill string 105/segment 305*a* can be accomplished. A power tong 328*a* may be isolated from axial loads imposed on it by the pressure of fluid in the chamber(s). In one aspect lines, e.g. ropes or cables, or fluid operated (pneumatic or hydraulic) cylinders connect the tong 328*a* to the platform 314. In another aspect of a gripping device such as, but not limited to a typical rotatably mounted snubbing spider, grips the segment 305*a* below the tong 328*a* and above the upper control head 327*a* or above the tong 328*a*, the snubbing spider connected to the platform 314 to take the axial load and prevent the tong 328*a* from being subjected to it. Alternatively, the tong 328*a* may have a jaw mechanism that can handle axial loads imposed on the tong 328*a*. The drill string 105 may be rotationally restrained by a backup tong 328*b*.

FIG. 3A also illustrates a power/control circuit for the CCS 350*a*. Drilling fluid 50*f* is pumped from the reservoir 50 by the pump 60 through a line and is selectively supplied to the lower chamber 345 with valves 303*b-e* closed and a valve 303*a* open. Drilling fluid 50*f* is selectively supplied to the upper chamber 343 with the valves 303*a,c*-e closed and the valve 303*b* open. Fluid 50*f* in both chambers 343, 345 is allowed to equalize by opening valve 303*d* with valves 303*c,e* closed. By providing fluid 50*f* to at least one of the chambers 343, 345 when the chambers are isolated from each other or to both chambers when the gate valve 320 is open, continuous circulation of fluid 50*f* is maintained to the drill string 105 through the upper portion thereof. This is possible with the gate valve 320 opened (when the drill string 105/segment 305*a* ends are separated or joined); with the gate valve 320 closed (with flow through the lower chamber 345 into the upper portion of the drill string 105); or from the upper chamber 343 into the lower chamber 345 when the gate valve 320 is closed. An optional control valve or variable choke valve 330 or fixed choke (not shown) is provided to prevent damage to the CCS 350*a*. The choke valve 330 may be in communication with the SMCU 65. An optional pressure sensor 325 is provided in or near an outlet side of the choke valve 330 and is also in communication with the SMCU 65. The gate valves 303*a-e*, 320 may be automatically actuated by, and in communication with, the SMCU 65.

Operation of the CCS 350*a*, where 17 is the top drive, in a disassembly or break out operation of the drill string 105 is as follows. The top drive 17 is stopped with a joint to be broken positioned within a desired chamber of the CCS 350*a* or at a position at which the CCS 350*a* can be moved to correctly encompass the joint. By stopping the top drive 17, rotation of the drill string 105 string ceases and the string is held stationary. The spider 322 is set to hold the string 105. Optionally, although the continuous circulation of drilling fluid 50*f* is maintained, the rate can be reduced to the minimum necessary, e.g. the minimum necessary to suspend cuttings. If necessary, the height of the CCS 350*a* with respect to the joint to be broken out is adjusted. If the CCS 350*a* includes upper and lower BOPs, they are now set.

The drain valve 303*e* is closed so that fluid may not drain from the chambers of the CCS 350*a* and the balance valve 303*d* is opened to equalize pressure between the upper 343 and lower 345 chambers of the CCS 350*a*. At this point the gate valve 320 is open. The valve 303*b* is opened to fill the upper 343 and lower 345 chambers with drilling fluid 50*f*. Once the chambers 343,345 are filled, the valve 303*b* is closed and the valve 303*a* is opened so that the pump 60 maintains pressure in the system and fluid circulation to the drill string 105. The power tong 328*a* and lower back-up tong 328*b* now engage the string 105 and the top drive 17 and/or power tong 328*a* apply torque to the segment 305*a* (engaged by the power tong 328*a*) to break its joint with the upper portion of the drill string 105 held by the back-up 328*b*). Once the joint is broken, the top drive 17 spins out the segment 305*a* from the upper portion of the drill string 105.

The segment 305*a* (and any other tubulars connected above it) is now lifted so that its lower end is positioned in the upper chamber 343. The gate valve 320 is now closed, isolating the upper chamber 343 from the lower chamber 345, with the upper portion of the drill string 105 held in position in the lower chamber 345 by the back-up 328*b* (and by the slips 322). The valve 303*c* (previously open to permit the pump to circulate fluid to the top drive 17 and from it into the drill string) and the balance valve 303*d* are now closed. The drain valve 303*e* is opened and fluid is drained from the upper chamber 343. The upper BOP's seal (if present) is released. The power tong 328*a* and back-up tong 328*b* are released from their respective tubulars and the segment 305*a* (which may be a plurality of segments) is lifted with the top drive 17 out from the upper chamber 343 while the pump 60 maintains fluid circulation to the drill string 105 through the lower chamber 345.

An elevator (not shown) is attached to the segment 305*a* and the top drive 17 separates the drill stand from a saver sub. The separated segment 305*a* is moved into the rig's pipe rack with any suitable known pipe movement/manipulating apparatus. A typical breakout wrench or breakout foot (not shown) typically used with a top drive 17 is released from gripping the saver sub and is then retracted upwardly. The saver sub or pup joint is then lowered by the top drive 17 into the upper chamber 343 and is engaged by the power tong 328*a*. The upper BOP (if present) is set. The drain valve 303*e* is closed, the valve 303*b* is opened, and the upper chamber 343 is pumped full of drilling fluid 50*f*. Then the valve 303*b* is closed, the valve 303*c* is opened, and the balance valve 303*d* is opened to balance the fluid in the upper 343 and lower 345 chambers.

The gate valve 320 is now opened and the power tong 328*a* is used to guide the saver sub into the lower chamber 343*b* and then the top drive 17 is rotated to connect the saver sub to the upper portion of the drill string 105 (positioned and held in the lower chamber 345). Once the connection has been made, the top drive 17 is stopped, the valve 303*a* is opened, the drain valve 303*e* is opened, and the upper and lower BOPs (if present) and the power tong 328*a* are released. The spider 322 is released, releasing the drill string 105 for raising by the top drive 17. Then the break-out sequence described above is repeated. A make-up operation may be accomplished by reversing the break-out operation.

Figure 3B:
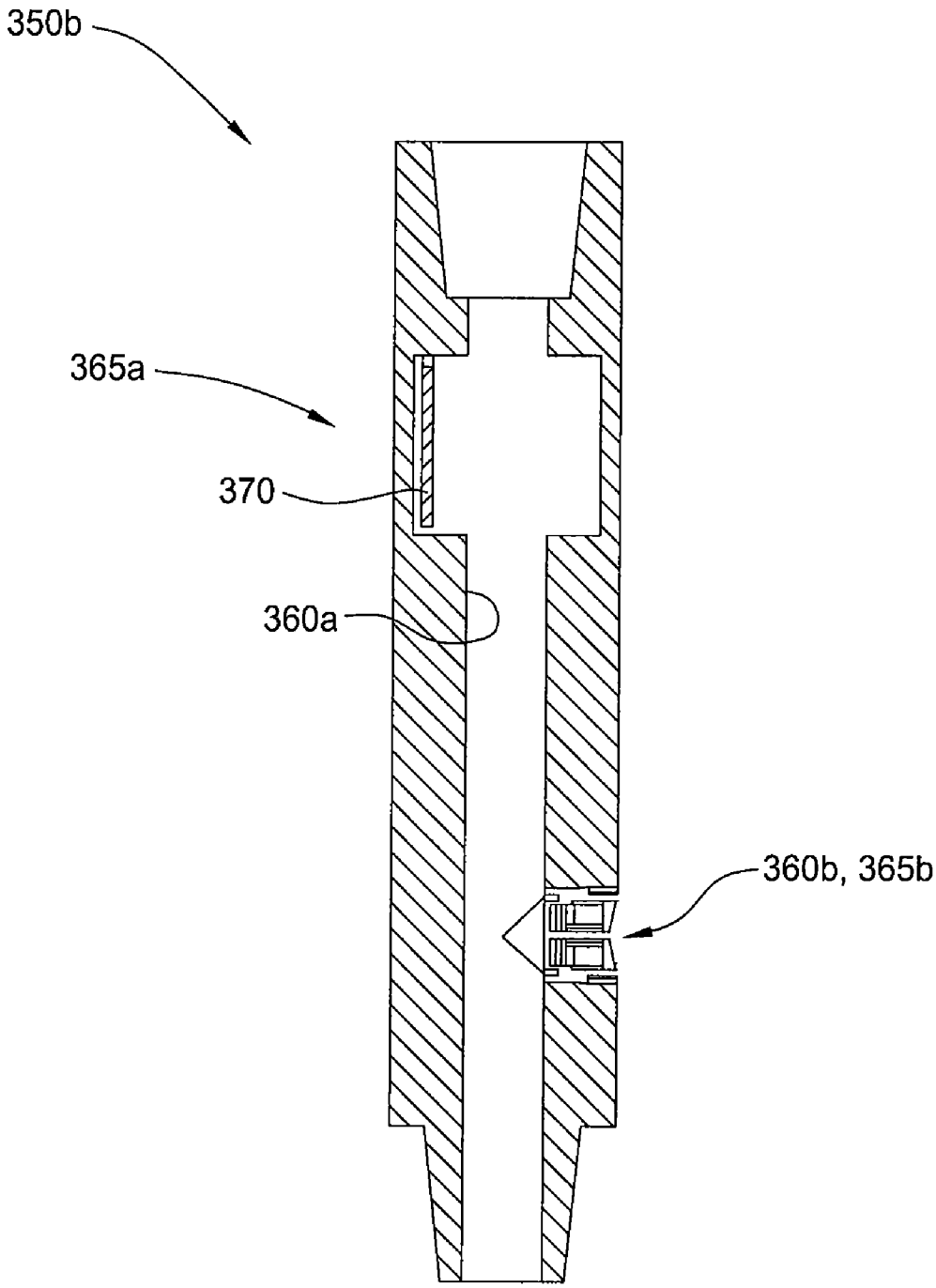
FIG. 3B shows a continuous flow sub (CFS) suitable for use with the drilling system of FIG. 3.

FIG. 3B shows a suitable continuous flow sub (CFS) 350*b*. The CFS 350*b* is installed atop each stand (not shown) of drill string 105 instead of being a single unit stationed on the rig 7 as is the CCS 350*a*. Each stand and CFS 350*b* is then assembled with the drill string 105 and is inserted into the wellbore 100. The CFS 350*b* includes a tubular housing 355 which is similar to the tubulars that make up the drill string 105. A bore 360*a* is formed longitudinally through the housing 355 and a side port 360*b* is formed through a wall of the housing 355. A first valve 365*a* is disposed in the bore 360*a* and a second valve 365*b* is disposed in the port 360*b*. Each valve is movable between an open and a closed position. As shown, the first valve 365*a* is a check valve having a flapper 370 which opens when drilling fluid is injected through the bore 360*a* from the mud pump 60 and which closes in response to fluid injected through the side port 360*b*. Alternatively, the first valve 365*a* may be a ball valve (a.k.a. a Kelly valve).

Also as shown, the second valve 365*b* is a pressure activated poppet valve. A side circulation line (not shown) is connected to the side port 360*b* and the mud pump 60 so that drilling fluid 50*f* may be injected through the side port 360*b* when adding/removing a segment of the drill string 105 (above the CFS 350*b*). When drilling fluid 50*f* is injected through the side port 360*b*, the second valve 360*b* is forced open and allows flow through the side circulation line and into the bore 360*a*, thereby maintaining circulation through the drill string 105. When drilling fluid 50*f* is injected through the bore 360*a* during drilling, the valve second 365*b* closes and seals the side port 360*a*. A valve manifold (not shown) diverts drilling fluid 50*f* from the Kelly/top drive 17 to the side port 360*b* during connections. The valve manifold may be controlled by the SMCU 65 and/or manual control system through hydraulic or pneumatic actuators.

Alternatively, a hydraulically actuated sliding sleeve may be used instead of the poppet valve as discussed in the '539 Provisional. Alternatively, a downhole CCS may be used instead of the CFS 350*b* as also discussed in the '539 Provisional. An alternate configuration of the poppet valve discussed in the '539 Provisional may be used instead of the poppet valve 365*b*. Alternatively, a prior art single flapper sub or single 3-way ball valve as also discussed in the '539 Provisional may be used instead of the CFS 350*b*.

Figure 4:
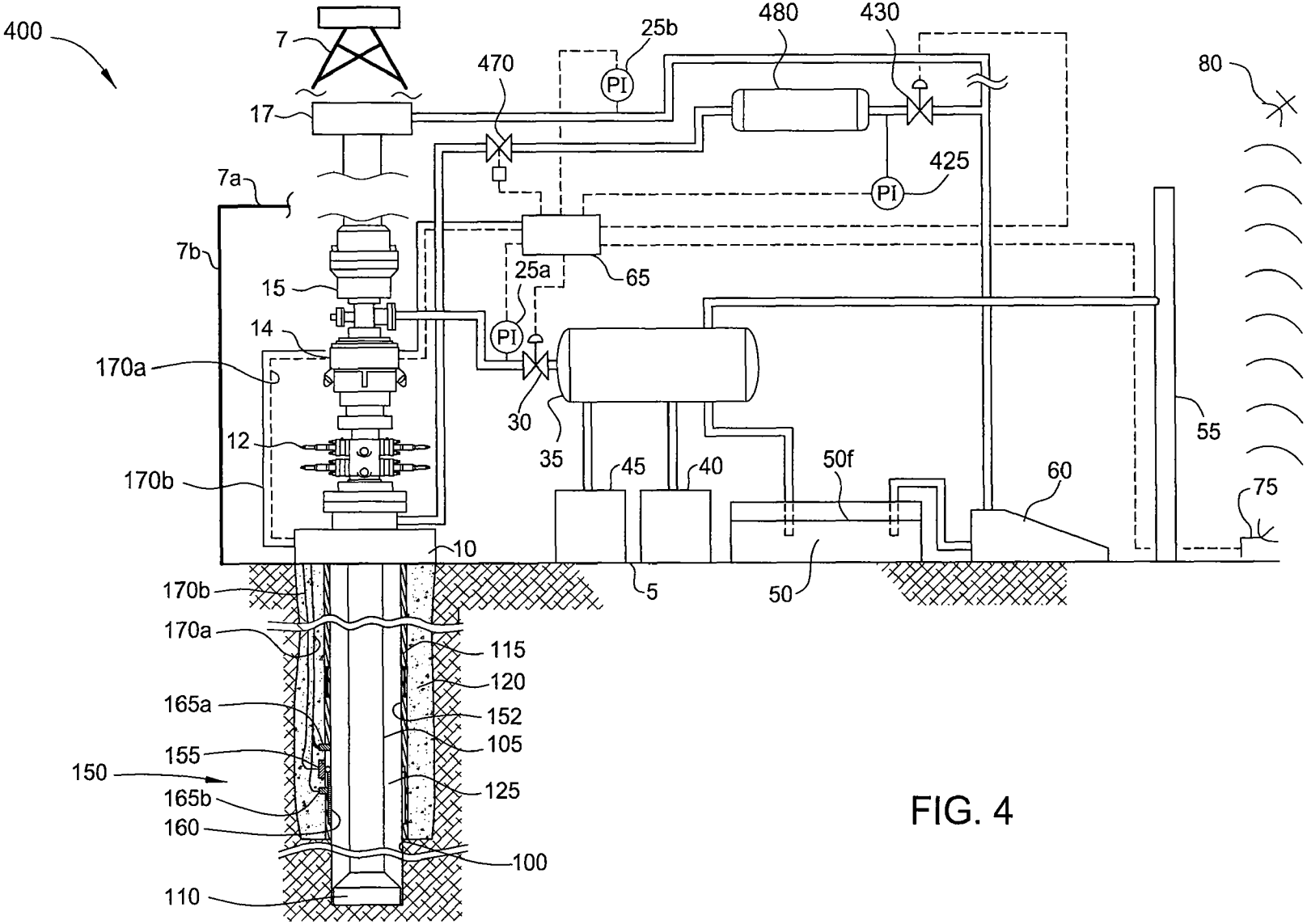
FIG. 4 illustrates a drilling system, according to another embodiment of the present invention.

FIG. 4 illustrates a drilling system 400, according to another embodiment of the present invention. Compared to the drilling system 200 of FIG. 2, an accumulator tank 480 has been added to replace the three-way valve 70. The accumulator tank 480 is in fluid communication with the rig pump outlet line via an inlet line having a control valve or variable choke valve 430 which is in communication with the SMCU 65. A pressure sensor 425 is disposed in the inlet line or on the accumulator and is also in communication with the SMCU 65. An automated gate valve 470 in communication with the SMCU 65 is disposed in an outlet line of the accumulator 480. The accumulator outlet line is in fluid communication with the wellhead 10. In operation, the SMCU 65 charges the accumulator 480 to a set pressure during drilling operations by controlling the choke valve 430. The set pressure is calculated by the SMCU 65 during drilling in order to maintain a desired annulus pressure at a certain downhole depth, i.e. the bottom hole pressure, during tripping of the drill string 105. Once circulation has stopped to add or remove a segment (or just before stopping circulation), the SMCU 65 closes the choke valve 30 and opens the valve 470 to pressurize the annulus 125 to the set pressure. Once circulation is resumed (or just before), the valve 470 is closed and the choke 30 is opened. The timing of opening and closing of each of the valves is coordinated by the SMCU 65 to ensure that deviations from the desired annulus pressure are minimized.

Figure 5:
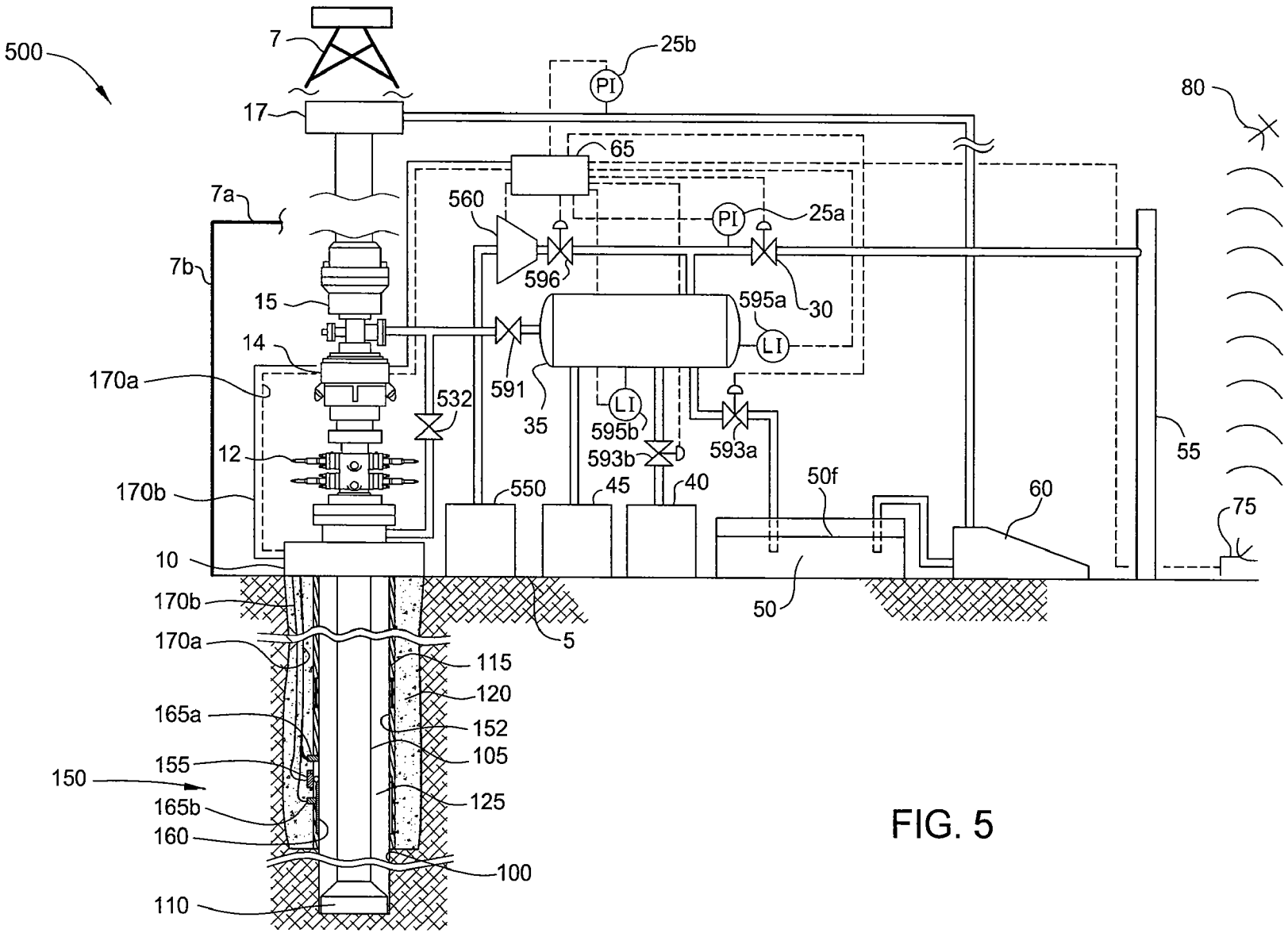
FIG. 5 illustrates a drilling system, according to another embodiment of the present invention.

FIG. 5 illustrates a drilling system 500, according to another embodiment of the present invention. Compared to the drilling system 200 of FIG. 2, the choke valve 30 and pressure sensor 25*a* have been moved to a gas outlet line of the separator 35 and a gate valve 591 has been placed in the RCD outlet. Alternatively, gate valve 591 may be a choke valve and be used for start-up, shut-down, and unpredicted flow operations. The three-way valve 70 and bypass line have been removed. The choke valve 30 maintains a desired pressure in the separator 35. Control valves or variable choke valves 593*a,b* have been placed in the liquid outlet lines of the separator 35 and are in communication with the SMCU 65. Level sensors 595*a,b*, also in communication with the SMCU, have been disposed in liquid chambers of the separator 35. The level sensors 595*a,b* and choke valves 593*a,b* allow the SMCU 65 to monitor and control liquid levels in the separator 35. In this manner, the SMCU 65 may maintain a constant gas volume (for a given desired pressure) in the separator 35 for more precise pressure control. The level sensors 595*a,b* and choke valves 593*a,b* may also be optionally included in the systems 200, 250, 300, and 400 of FIGS. 2, 2B, 3, and 4.

The choke valve 30 applies backpressure to the annulus 125 during drilling by maintaining the desired pressure in the separator 35. Advantageously, since solids have been removed from the returns 50*r*, the choke valve 30 is not subject to erosion as in the drilling system 200. Further, controlling the annulus pressure with a compressible medium dampens transient effects of pressure changes. Additionally, if gas hydrates are present in the return fluid they are separated with the rest of the solids and sublimation may carefully be controlled (i.e., with a heating element in the separator 35 or solids tank 45) instead of uncontrolled through the choke valve 30. An optional compressor 560, gas source/tank 550, and variable choke valve 596 are provided in fluid communication with the gas outlet line of the separator 35 to maintain annulus pressure control during drilling when the formation is not producing gas and/or the drilling fluid is not gas based. Alternatively, the choke valve 596 may be placed in the RCD outlet instead of using the compressor 560 and/or gas tank 550.

The gas source 550 may be a nitrogen tank. Alternatively, the gas source 550 may be a nitrogen generator, exhaust fumes from the prime mover, or a natural gas line. The gas source 550 may be sufficiently pressurized so that the compressor 560 is not required. Annulus pressure control may be maintained during tripping operations by using the compressor 598 and/or the alternative gas source 550, by including the CCS/CFS 350*a,b* or by including the three-way valve 70 (see FIG. 2) and bypass line from/in the outlet line of the rig pump 60. A bypass line, including gate valve 532, is provided to the wellhead 10 for servicing the wellhead equipment. Otherwise, the valve 232 is normally closed.

Figure 6:
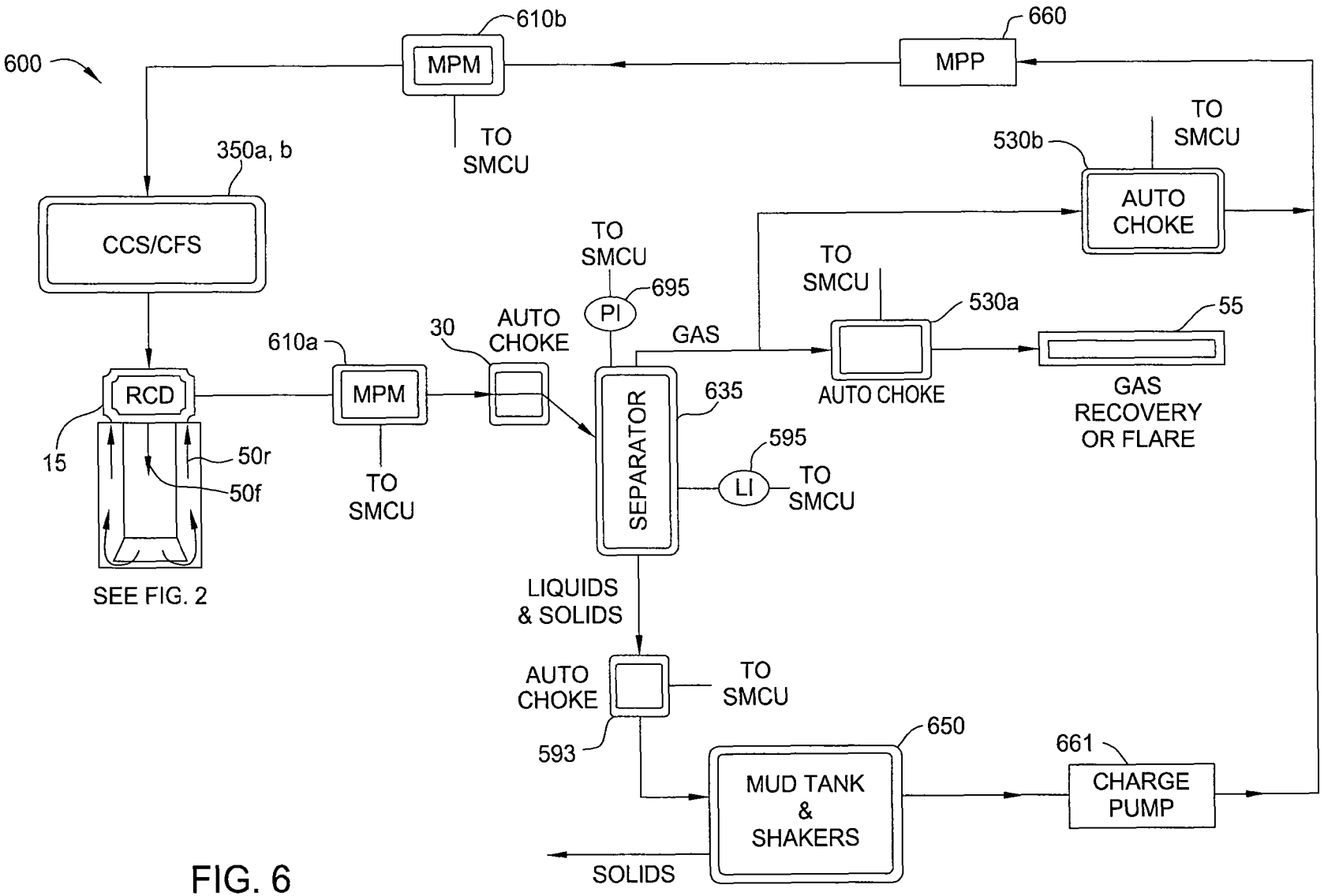
FIG. 6 illustrates a drilling system, according to another embodiment of the present invention.

FIG. 6 illustrates a drilling system 600, according to another embodiment of the present invention. Although shown simply, the downhole configuration may be similar to that of the drilling system 200. The drilling system 600 is capable of injecting a multiphase drilling fluid 50*f*, i.e. a liquid/gas mixture. The liquid may be oil, oil based mud, water, or water based mud, and the gas may be nitrogen or natural gas. Returns 50*r* exiting an outlet line of the RCD 15 are measured by a multi-phase meter (MPM) 610*a*. The MPM 610*a* is in communication with the SMCU 65 and may provide a pressure (or pressure and temperature) at the RCD outlet to the SMCU 65 in addition to component flow rates, discussed below. The returns 50*r* continue through the RCD outlet line through the optional choke 30 which controls back pressure exerted on the annulus 125 and is in communication with the SMCU 65. The returns 50*r* flow through the choke 30 and into a separator 635. As shown, the separator 635 is two-phase. Alternatively, the separator 635 may be three or four phase. The liquid level in the separator is monitored and controlled by the level sensor 595 and choke 593 which are both in communication with the SMCU 65.

The liquid and cuttings portion of the returns 50*r* exits the separator 635 through a liquid outlet line and through the choke 593 disposed in the liquid outlet line. The liquid and cuttings continue through the liquid line to shakers 650 which remove the cuttings and into a mud reservoir or tank 650. The liquid portion of the returns 50*r* may then be recycled as drilling fluid 50*f*. An additional flare or cold vent line (not shown, see FIG. 3) may be provided on the mud tank 650 if the liquid portion of the drilling fluid 50*f* is oil or oil based. Alternatively, the cuttings may be removed at the separator 635. Liquid drilling fluid may be pumped from the mud tank 650 by an optional charge pump 661 into an inlet line of a multi-phase pump (MPP) 660. Alternatively, the MPP 660 or a compressor may be disposed in the gas outlet line of the separator 635 and a conventional mud pump may be disposed in the mud tank outlet line.

The gas portion of the returns 50*r* exits the separator 635 through a gas outlet line. The gas outlet line splits into two branches. A first branch leads to an inlet line of the MPP 660 so that the gas portion of the returns 50*r* may be recycled. The second branch leads to a gas recovery system or flare 55 to dispose or recover excess gas produced in the wellbore 100. Flow is distributed between the two branches using chokes 530*a,b* which are both in communication with the SMCU. The first branch of the gas outlet line and an outlet line of the mud tank 650 join to form the inlet line of the MPP 660. The SMCU 65 controls the amount of gas entering the MPP inlet line, thereby controlling the density of the drilling fluid mixture 50*f*, to maintain a desired annulus pressure profile. A gas storage tank (not shown) may also be provided for start-up and other transient operations. The drilling fluid mixture 50*f* exits the MPP 660 and flows through an MPM 610*b* which is in communication with the SMCU. The CFS/CCS 350*a,b* maintains circulation and thus annulus pressure control during tripping of the drill string.

Figure 6A:
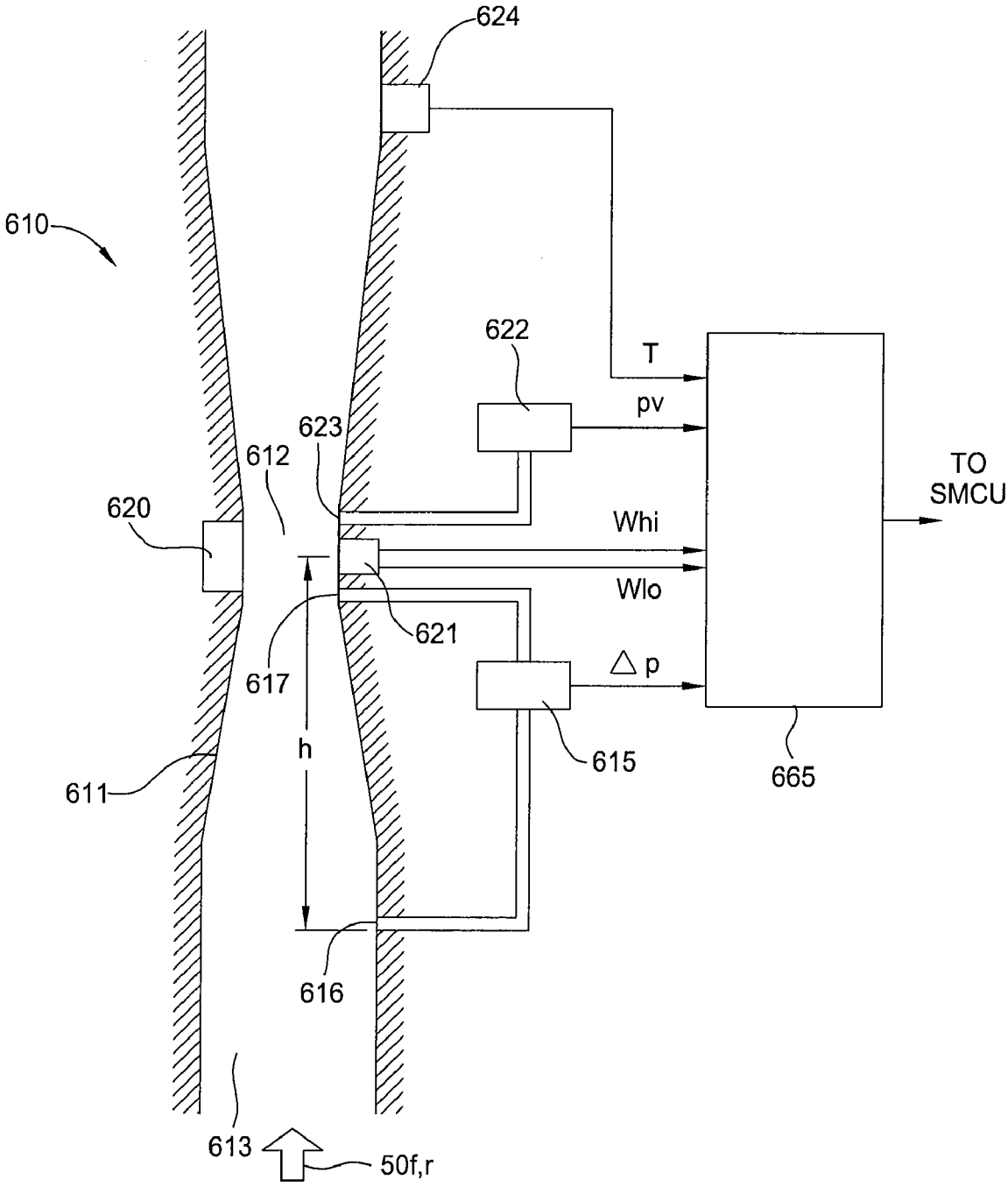
FIG. 6A illustrates a multiphase meter (MPM) suitable for use with the drilling system of FIG. 6.

FIG. 6A illustrates a suitable MPM 610. The MPM 610 is capable of measuring the component mass flow rates of a multiphase fluid, i.e. gas, oil, and water. Additionally, the MPM 610 may be configured to measure a component flow rate of solids, the component flow rate of solids may be neglected, or the flow rate of solids may be calculated by measuring the amount of solids disposed in the solids tank 45, i.e., using a load cell. The MPM 610 includes a pipe section comprising a convergent Venturi 611 whose narrowest portion 612 is referred to as the throat. The constriction of the flow section in the Venturi induces a pressure drop $\Delta p$ between level 613, situated upstream from the Venturi at the inlet to the measurement section, and the throat 612. The pressure drop $\Delta p$ is measured by means of a differential pressure sensor 615 connected to two pressure takeoffs 616 and 617 opening out into the measurement section respectively at the upstream level 613 and in the throat 612 of the Venturi. Additionally/alternatively, as discussed above, absolute pressure measurements may be made at the takeoffs 616 and 617.

The density of the returns/drilling fluid mixture 50*f, r* is determined by a sensor which measures the attenuation of gamma rays, by using a source 620 and a detector 621 placed on opposite sides of the Venturi throat 612. The throat 612 is provided with "windows" of a material that shows low absorption of photons at the energies under consideration. The source 620 produces gamma rays at two different energy levels Whi and Wlo, referred to below as the "high energy" level and as the "low energy" level. The detector 621 which comprises in conventional manner a scintillator crystal such as NaI and a photomultiplier produces two series of signals and referred to as count rates, representative of the numbers of photons detected per sampling period in the energy ranges bracketing the above-mentioned levels respectively.

These energy levels are such that the high energy count rate is essentially sensitive to the density of the fluid mixture, while the low energy count rate is also sensitive to the composition thereof, thus making it possible to determine the water content of the liquid phase. The high energy level may lie in a range 85 keV to 150 keV. For characterizing oil effluent, this energy range presents the remarkable property that the mass attenuation coefficient of gamma rays therein is substantially the same for water, for sodium chloride, and for oil. This means that based on the high energy attenuation, it is possible to determine the density of the fluid mixture without the need to perform auxiliary measurements to determine the properties of the individual phases of the fluid mixture (attenuation coefficients and densities).

A material that is suitable for producing high energy gamma rays in the energy range under consideration, and low energy rays is gadolinium 153. This radioisotope has an emission line at an energy that is approximately 100 keV (in fact there are two lines around 100 keV, but they are so close together they can be treated as a single line), and that is entirely suitable for use as the high energy source. Gadolinium 153 also has an emission line at about 40 keV, which is suitable for the low energy level that is used to determine water content. This level provides good contrast between water and oil, since the attenuation coefficients at this level are significantly different.

A pressure sensor 622 connected to a pressure takeoff 623 opening out into the throat 612 of the Venturi, which sensor produces signals representative of the pressure pv in the throat of the Venturi, and a temperature sensor 624 producing signals T representative of the temperature of the fluid mixture. The data pv and T is used in particular for determining gas density under the flow rate conditions and gas flow rate under normal conditions of pressure and temperature on the basis of the value for the flow rate under the flow rate conditions.

The information coming from the above-mentioned sensors is applied to a data processing unit (DPU) 665 which includes a microprocessor controller running a program to calculate the total mass flow rate of the mixture by: determining a mean value of the pressure drop is over a period t1 corresponding to a frequency f1 that is low relative to the frequency at which gas and liquid alternate in a slug flow regime; determining a mean value for the density of the fluid mixture at the constriction of the Venturi over said period t1; and deducing a total mass flow rate value for the period t1 under consideration from the mean values of pressure drop and of density. Appropriately, the density of the fluid mixture is measured by gamma ray attenuation at a first energy level at a frequency f2 that is high relative to said frequency of gas/liquid alternation in a slug flow regime, and the mean of the measurements obtained in this way over each period t1 corresponding to the frequency f1 is formed to obtain said mean density value. Once the total mass flow rate is calculated, the DPU 665 may proceed to calculate the mass flow rates of the individual components. Alternatively, the SMCU 65 may perform the calculations.

As discussed above, having MPMs 610*a, b* measuring both the drilling fluid injected into the wellbore and returns exiting the wellbore allows for kick detection and/or lost circulation detection when drilling balanced or overbalanced. Further, when drilling underbalanced, the MPM measurements allow for formation evaluation while drilling, discussed more below. Alternatively, instead of MPMs 610*a, b*, the flow rates of the returns/drilling fluid mixtures 50*f, r* may be measured in the liquid outlet and gas outlet lines of the separator 635 and/or in the mud tank outlet and second branch line of the gas outlet using FMs.

Figure 6C:
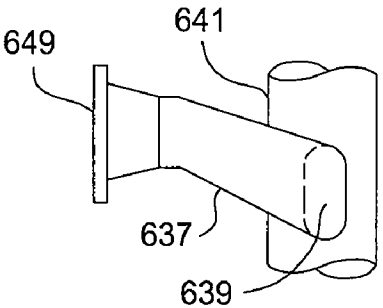
FIGS. 6B-6D illustrate a centrifugal separator suitable for use with the drilling system of FIG. 6.
Figure 6D:
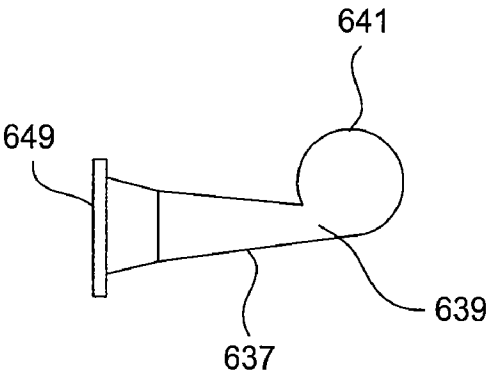
Figure 6B:
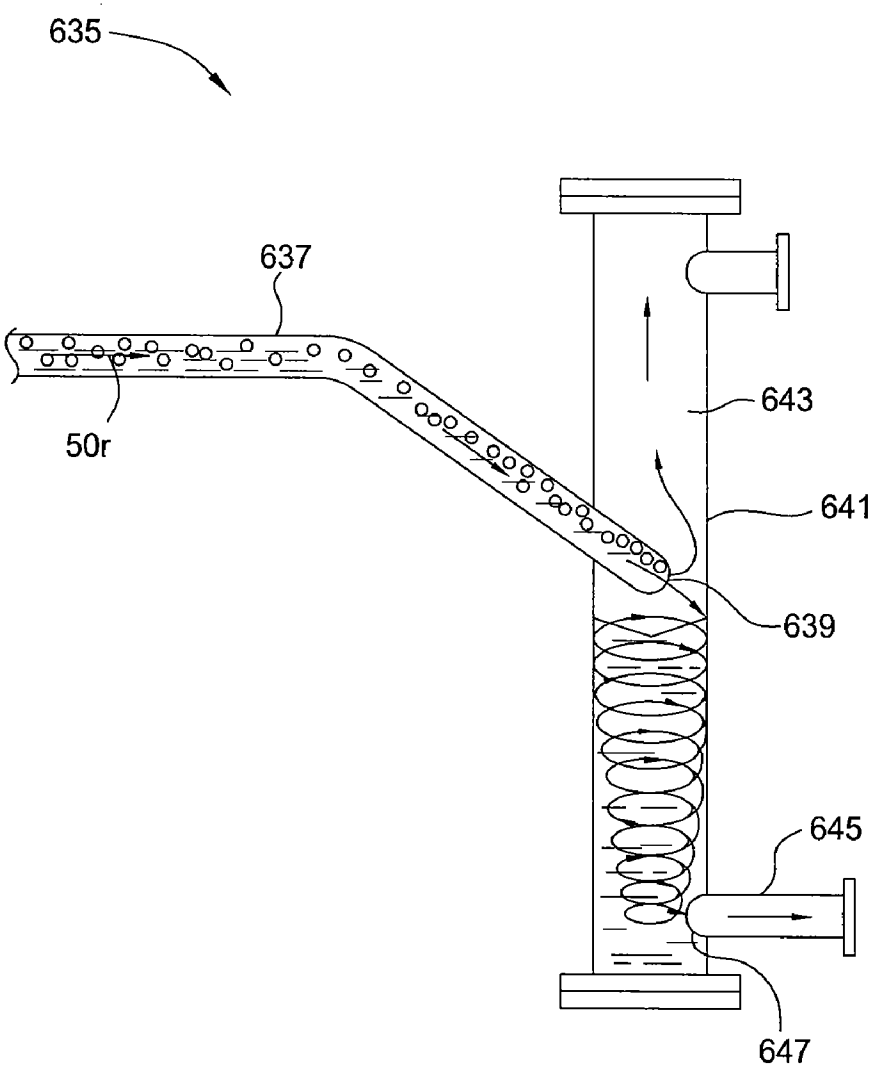

FIGS. 6B-6D illustrate a suitable centrifugal separator 635. Alternatively, the separator 635 may be a conventional horizontal or vertical separator. The returns 50*r* flow through inlet line 6351 arranged at a suitable decline, i.e., 20-30 degrees to horizontal, to cause the returns 650*r* to initially stratify into separated liquid and gas components prior to reaching inlet port 639 of vertical separator tube 641. Maintaining the liquid fluid level below the inlet port 639 ensures that the maximum gas velocity in the gas recovery portion 643 of the separator 635 above inlet port 639 is less than the velocity needed to achieve churn flow, which is generally about 10 ft/sec.

In operation, the multiphase returns 50*r* enter inlet line 637 and are initially stratified into liquid and gas phase components as a result of the declination angle of the inflow line. The inflow line is mounted eccentrically to vertical separator tube 641 having a two-dimensional convergent nozzle 649 at inlet port 639, as shown in FIGS. 6C and 6D, to accelerate the fluid as it enters vertical separator tube 641. Upon entering separator tube 641, the stratified fluid undergoes a flow-splitting separation, where the disassociated gas component rises into the recovery section 643 as the liquid component, having been accelerated in a downward direction as a result of nozzle 649, tangentially enters vertical separator 641 as an accelerated downwardly spiraling ribbon of fluid along the separator wall, thereby creating an efficient vortex enhanced separation mechanism for any gas component remaining in the liquid stream.

Because of the downward spiral of the liquid flow along the separator wall, the liquid does not pass in front of inlet port 639 on subsequent spirals, resulting in the bulk of gas remaining in the liquid stream to pass into and up the separator 641 as a result of the centrifugal force generated by the vortex, unobstructed by the incoming multiphase fluid stream 50*r*. The liquid stream continues to downwardly spiral against the separator wall below inlet port 639, where the stream then centrally converges to an enhanced vortex flow until encountering the tangential exit port 647, where the liquid flow is directed through to liquid line 645. It is to be noted that the tangential exit port 647 allows maintenance of the vortex energy of the fluid stream by allowing the flow to exit the separator without any redirection of the stream.

Figure 6E:
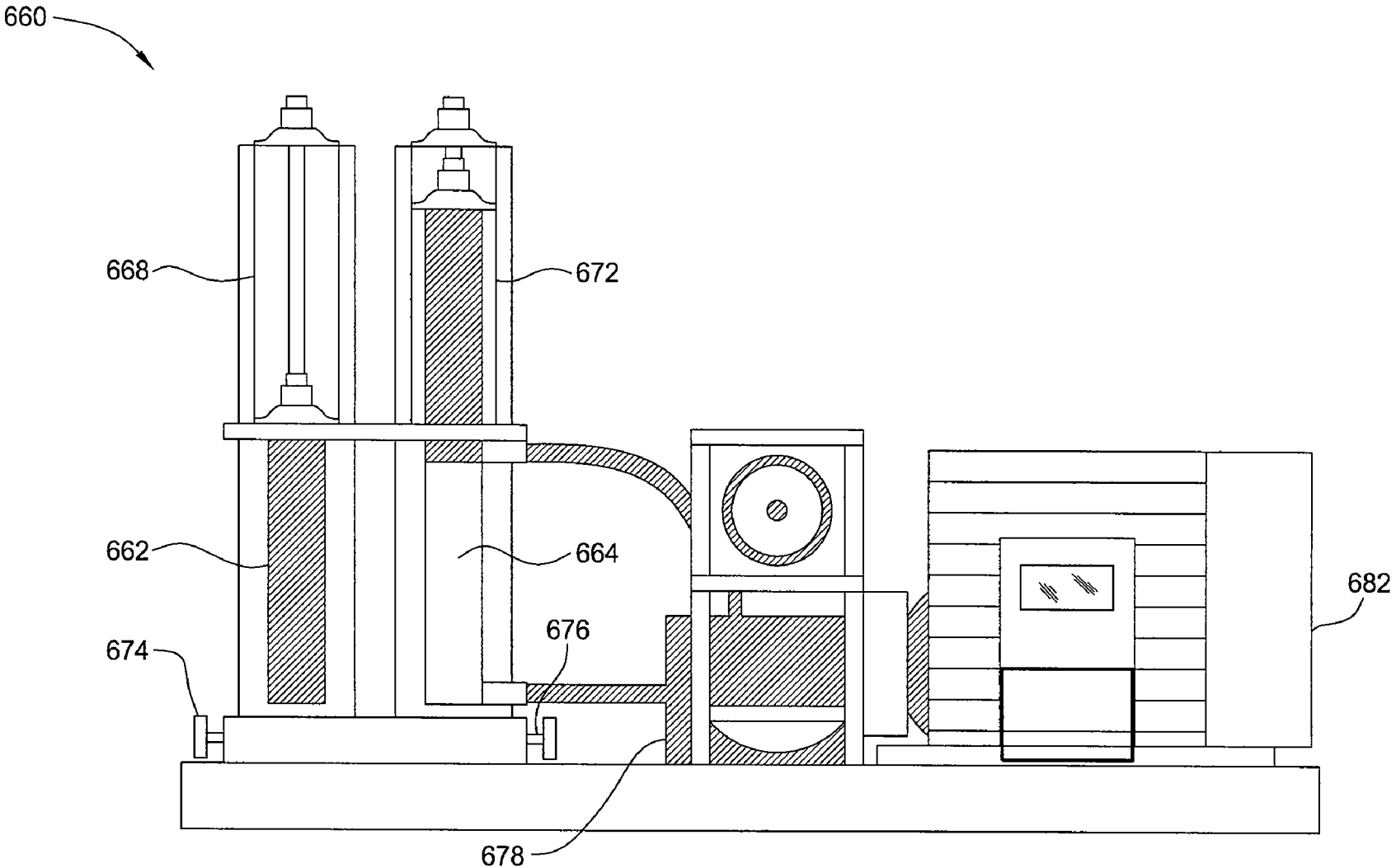
FIG. 6E illustrates a multiphase pump (MPP) suitable for use with the drilling system of FIG. 6.

FIG. 6E illustrates a suitable MPP 660. The MPP 660 is capable of handling fluids containing one or more phases, including solids, water, gas, oil, and combinations thereof. The MPP 660 may be skid mounted and includes a power unit 682. The MPP 660 includes a pair of driving cylinders 662, 664 placed in line with a respective vertically disposed plunger 668, 672. The MPP 660 includes a pressure compensating pump 678 for supplying hydraulic fluid to the pair of cylinders 662, 664 to control the movement of the first and the second plungers 668, 672. The power unit 682 provides energy to the pressure compensated pump 678 to drive the plungers 668, 672.

The plungers 668, 672 are designed to move in alternating cycles. When the first plunger 668 is driven towards its retracted position, a pressure increase is triggered towards the end of the first plunger's movement. This pressure spike causes a shuttle valve (not shown) to shift. In turn, a swash plate (not shown) of the compensated pump 678 is caused to reverse angle, thereby redirecting the hydraulic fluid to the second cylinder 664. As a result, the second plunger 672 in the second cylinder 664 is pushed downward to its retracted position. The second cylinder 664 triggers a pressure spike towards the end of its movement, thereby causing the compensating pump 678 to redirect the hydraulic fluid to the first cylinder 662. In this manner, the plungers 668, 672 are caused to move in alternating cycles.

In operation, a suction is created when the first plunger 668 moves toward an extended position. The suction causes the drilling fluid mixture 50*f* to enter the MPP 660 through a process inlet 674 and fill a first plunger cavity. At the same time, the second plunger 672 is moving in an opposite direction toward a retracted position. This causes the drilling fluid mixture in the second plunger cavity to expel through an outlet 676. In this manner, the multiphase drilling fluid mixture 50*f* may be injected into the drill string 105. Although a pair of cylinders 662, 664 is shown, the MPP 660 may include one cylinder or more than two cylinders.

Figure 7:
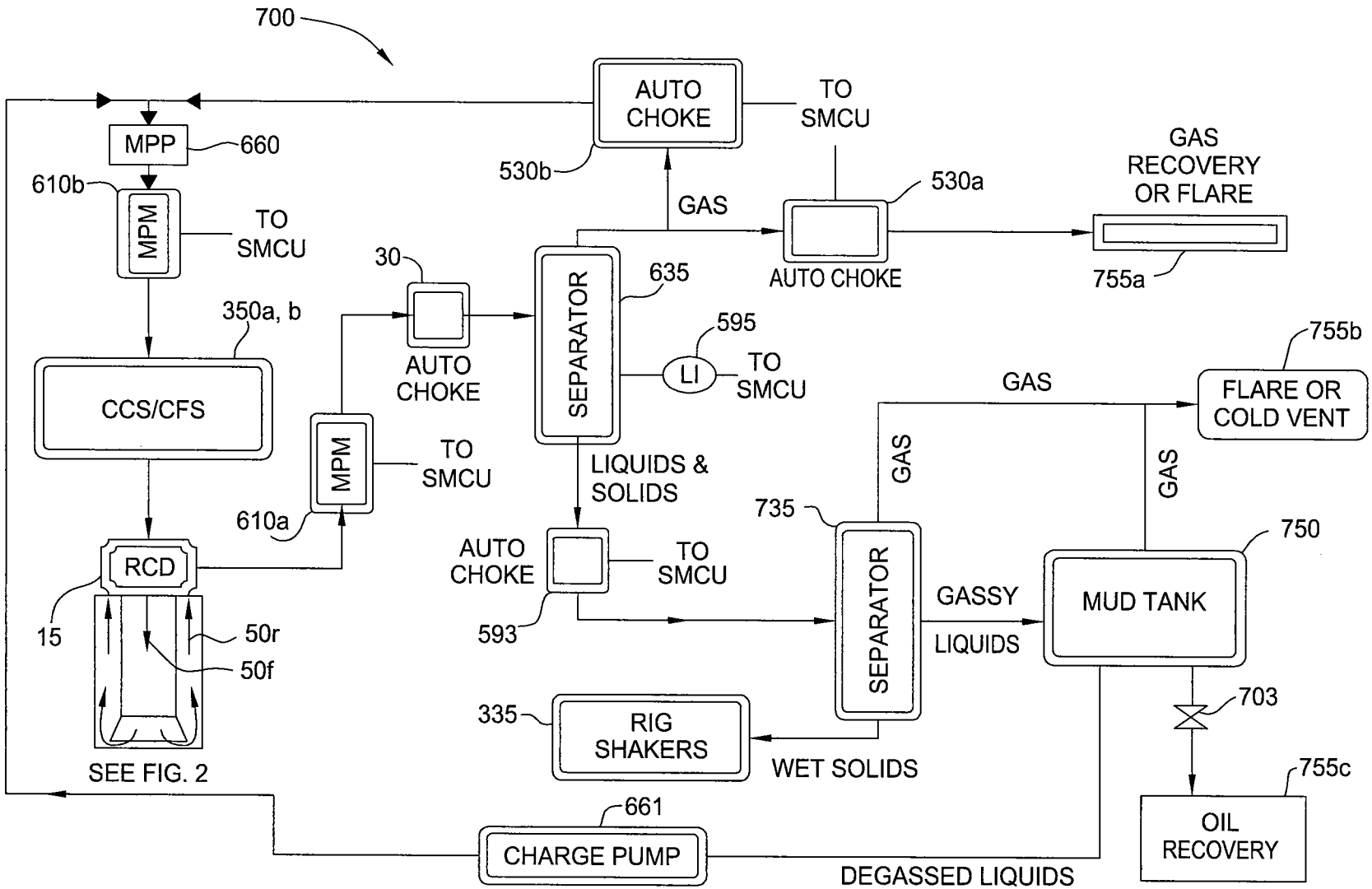
FIG. 7 illustrates a drilling system, according to another embodiment of the present invention.

FIG. 7 illustrates a drilling system 700, according to another embodiment of the present invention. Although shown simply, the downhole configuration may be similar to that of the drilling system 200. Compared to the drilling system 600 of FIG. 6, a low pressure (relative to the separator 635) separator 735 has been added between the liquid level choke 593 and the mud tank 750. As shown, the low pressure separator 735 is a three-phase separator. Alternatively, the low pressure separator 735 may be a two or four phase separator. A second flare or cold vent line 755*b* has also been added for the low pressure separator 735 and the mud tank 750. An oil recovery line 755*c*, gate valve 703, have been added to the mud tank 750 (if the liquid portion of the drilling fluid is oil or oil based) to remove liquid hydrocarbons produced in the wellbore 100. Alternatively, a variable choke and a level sensor in fluid communication with the mud tank 750 an din communication with the SMCU 65 may be used instead/in addition to the gate valve 703. If the liquid portion of the drilling fluid 50*f* is water or water based, then the gate valve 703 (and/or level sensor 795 and choke valve) and oil recovery line 755*c*, may be instead installed on the oil outlet line or oil chamber of the low pressure separator 735. The second flare or cold vent line 55*b* connection to the mud tank 750 may also be omitted.

Figure 8:
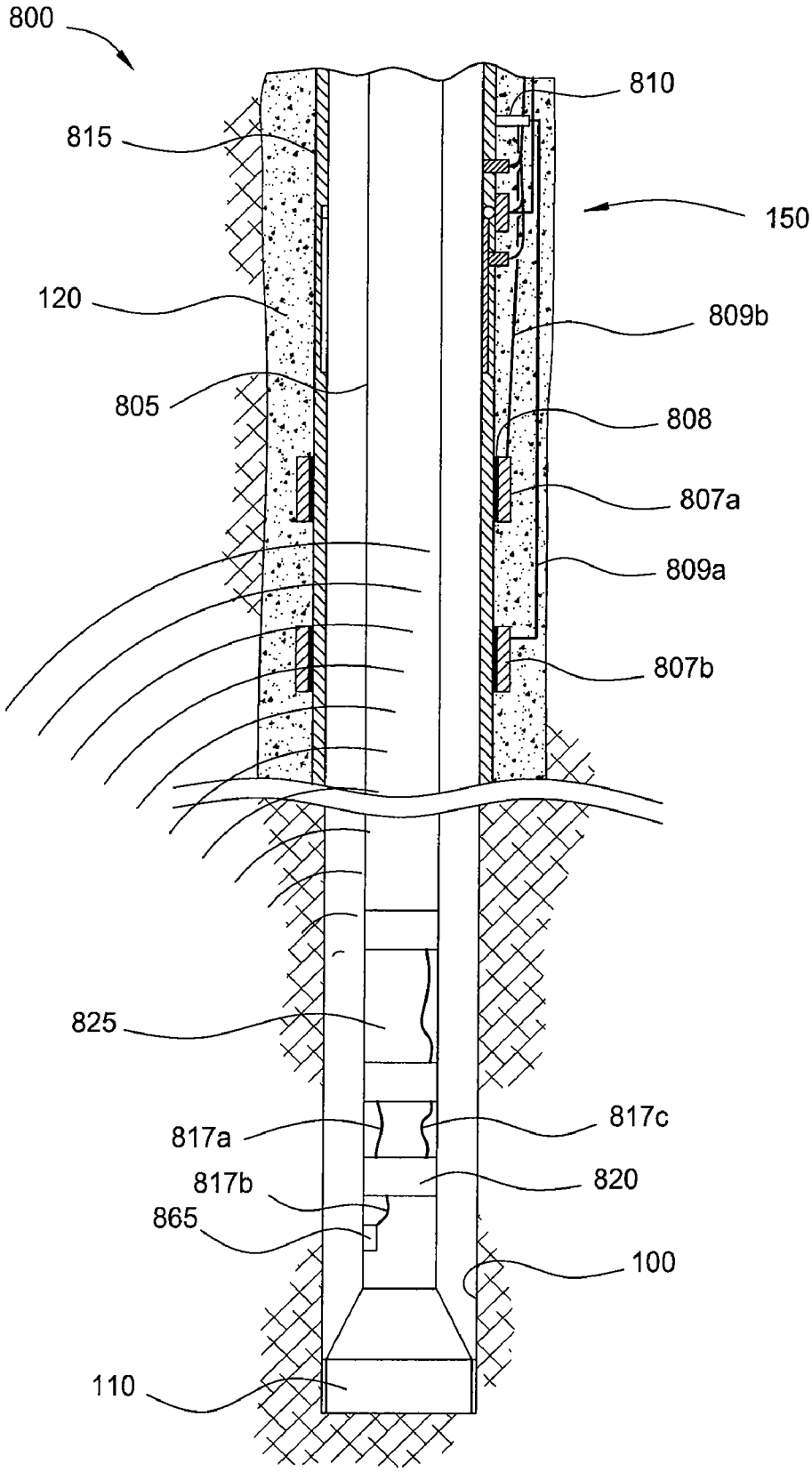
FIG. 8 is an alternate downhole configuration for use with any of the drilling systems of FIGS. 2, 2B, and 3-7, according to another embodiment of the present invention.

FIG. 8 is an alternate downhole configuration 800 for use with surface equipment of any of the drilling systems 200, 250, 300-700 of FIGS. 2, 2B, and 3-7, according to another embodiment of the present invention. A pressure sensor (or PT sensor) 865, controller 820, and EM gap sub 825 have been added to a drillstring 305. The pressure sensor 865 may be similar to the pressure sensors (or PT sensors) 165*a,b* and is in communication with the annulus at or near the bottom of the drill string 805 (BHP). Additionally the pressure sensor (or a second pressure sensor) may be in communication with a bore of the drill string 805. The pressure sensor 865 is in electrical or optical communication with the controller 820 via line 817*b*. The controller 820 receives an analog pressure signal from the sensor 865, samples the pressure signal, modulates the signal, and sends the signal to a casing antenna 807*a,b* via the EM gap sub 825. The controller is in electrical communication with the EM gap sub 825 via lines 817*a,c*. The controller may include a battery pack (not shown) as a power source. The casing antenna 807*a,b* may be disposed in the casing string 815 below the DDV 150. The casing antenna 807*a,b* may be a sub that attaches to the DDV 150 with a threaded connection. Utilizing the EM casing antenna 807*a,b* with the DDV 150 shortens the path over which the radiated EM signal from the gap sub 825 must travel, thus lessening the attenuation of the radiated EM signal. This is particularly advantageous where the DDV system and the associated casing penetrate below certain formations and/or the sea that might otherwise render the EM link ineffective. The EM casing antenna system 807*a,b* includes two annular or tubular members 807*a,b* that are mounted coaxially onto a casing joint. The two antenna members 807*a,b* may be substantially identical and may be made from a metal or alloy. The casing joint may be selected from a desired standard size and thread. A radial gap exists between each of the antenna members 807*a,b* and the casing joint, and is filled with an insulating material 808, such as epoxy.

The arrangement of the antenna members 807*a,b* is used to form an electric dipole whose axis is coincident with the casing string 815. To increase the effectiveness of the dipole, the surface area of the members 807*a,b* and the spacing between them can be increased or maximized. The antenna members 807*a,b* can act as both transmitter and receiver antenna elements. The antenna members 807*a,b* may be driven (transmit mode) and amplified (receive mode) in a full differential arrangement, which results in increased signal-to-noise ratio, along with improved common mode rejection of stray signals. The antenna members 807*a,b* receive the signal and relay the signal to a controller 810 via lines 809*a,b*. The controller 810 demodulates the signal, remodulates the signal for transmission to the SMCU 65, and multiplexes the signal with signals from the pressure sensors 165*a,b*.

Alternatively, the controller 810 may simply be an amplifier and have a dedicated control line to the SMCU 65. Additionally, a second gap sub and casing antenna (not shown) may be provided for transmitting and receiving other MWD/LWD data so as not to slow the transmission of the pressure signal. In this alternative, the second gap sub and casing antenna would operate on a different frequency. Alternatively, wired drill pipe may be used to transmit the pressure measurement to the surface instead of the EM gap sub 825. The wired drill pipe may be similar to the wired casing 215*j* (or alternatives discussed therewith). Alternatively, a mud-pulse generator (not shown) may be used instead of the EM gap sub to transmit the pressure measurement to the surface. Additionally, a second pressure (or PT sensor) may be disposed along the drill string 805 at a longitudinal or substantial longitudinal distance from the pressure sensor 865. The second pressure sensor would also be in communication with the annulus 825 and the second pressure sensor may be transmitted to the surface using the same device used for the first pressure sensor or a different one of the devices. In this manner, the second pressure sensor may serve as a backup in case of failure of the first pressure sensor and/or failure of the transmission device. Having a second pressure sensor may also be advantageous when drilling through irregular formations (see FIG. 16) especially when the pressure sensor 865 has moved a substantial distance from the irregular formation. The second pressure sensor may then be proximate to the irregular formation.

Figure 8A:
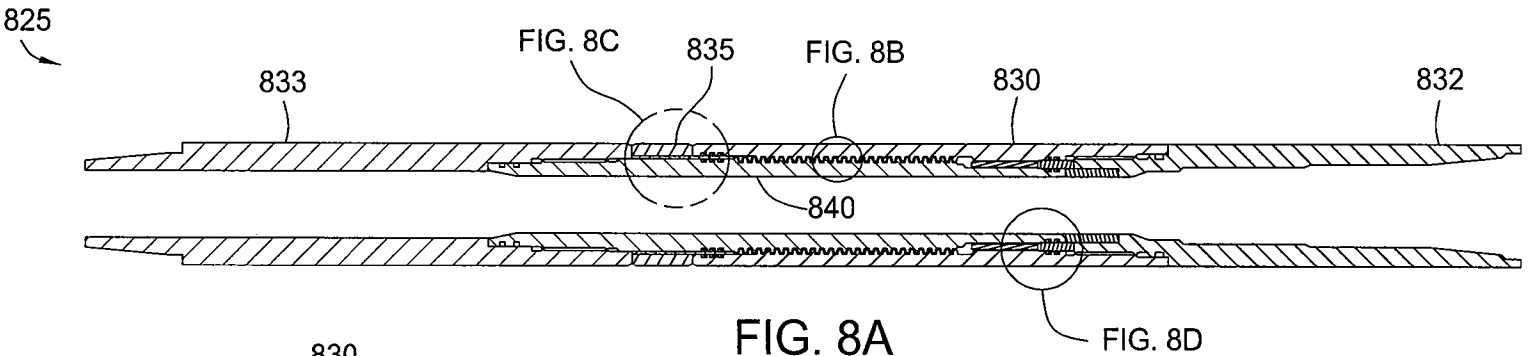
FIG. 8A is a cross-sectional view of a gap sub assembly suitable for use with the downhole configuration of FIG. 8.

FIG. 8A is a cross-sectional view of a suitable gap sub assembly 825. As shown, the gap sub assembly 825 includes a lower thread-saver 833 which mates with a lower portion of the drill string 805 and an upper thread-saver 832 which mates with an upper portion of the drill string 805. Disposed between the upper and lower thread-savers 832, 833 is a tubular mandrel 840, a tubular housing 830, and a first gap ring 835.

Figure 8C:
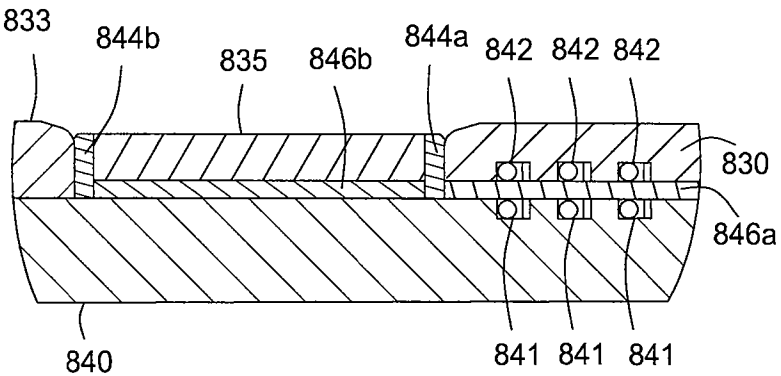
FIG. 8C illustrates an expanded view of an external gap ring disposed in the gap sub assembly.
Figure 8B:
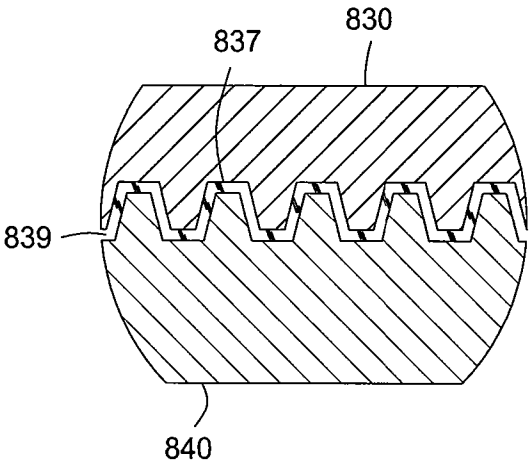
FIG. 8B illustrates an expanded view of dielectric filled threads in the gap sub assembly.

FIG. 8B illustrates an expanded view of dielectric filled threads 837 in the gap sub assembly 825. As shown, the mandrel 840 contains an external threadform that has a larger than normal space between adjacent threads 837. In the same manner, the housing 830 has an internal threadform with widely spaced threads 837. The mandrel 840 and housing 830 are separated from each other by a dielectric material 839, such as epoxy, which is capable of carrying axial and bending loads through the compression between adjacent threads 837. Typically, the load carrying ability of most dielectric materials is much higher in compression than tension and/or shear. In this respect, the total surface area bonded with the dielectric material 839 may also be increased dramatically over a purely cylindrical interface of the same length. Therefore, the increased surface area equates to higher strength in all loading scenarios.

Additionally, if the dielectric material 839 adhesive bonds fail and/or the dielectric material 839 can no longer carry adequate compressive loads due to excessive temperature or fluid invasion, the metal on metal engagement of the threads 837 prevents the gap sub assembly 825 from physically separating. Therefore, the mandrel 840 will remain axially coupled to the housing 830 and may be successfully retrieved from the wellbore.

FIG. 8C illustrates an expanded view of the first gap ring 835 disposed in the gap sub assembly 825. The first gap ring 835 is constructed from a toughened ceramic material, such as yttria stabilized tetragonal zirconia polycrystals, as it is a highly abrasion resistant, as well as an impact resistant material. Zirconia also has an elastic modulus and thermal expansion co-efficient comparable to that of steel and an extremely high compressive strength (i.e. 290 ksi) in excess of the surrounding metal components. These properties allow the first gap ring 835 to support the joint under bending and compressive loading producing a significantly stronger and robust gap sub assembly 835. An optional first compression ring 844*a* is disposed between the housing 830 and the first gap ring 835. Since the first compression ring 844*a* radially extends to the mandrel 840, an optional second compression ring 844*b* is disposed between the first gap ring 835 and the lower thread-saver 833. Preferably, the compression rings 844*a,b* are made from a relatively soft strain hardenable metal or alloy, such as an aluminum or bronze alloy.

A primary external seal is formed by torquing the lower thread-saver 833 onto the mandrel 840 to compress the first gap ring 835 and the compression rings 844*a,b* between the two halves of the gap sub assembly 825, thereby forming the primary external seal. A secondary seal arrangement is disposed adjacent the external gap ring 835. The secondary seal arrangement includes first sleeve segments 846*a,b* made from a high strength, high temperature polymer, such as PEEK and a series of elastomer seals 841, 842 disposed on the interior of the housing 830 and the exterior of the mandrel 840, respectfully. The seals 841, 842 prevent fluid from entering the space between the mandrel 840 and the housing 830 if the primary seal should fail. Furthermore, the first sleeve segment 846*b* supports the first gap ring 835 and provides some shock absorption should the first gap ring 835 experience a severe lateral impact.

Figure 8D:
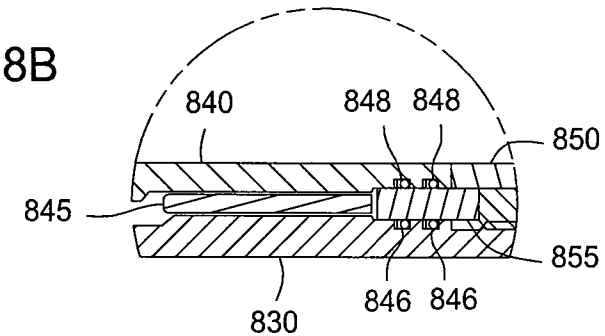
FIG. 8D illustrates an expanded view of a non-conductive seal arrangement in the gap sub assembly.

FIG. 8D illustrates an expanded view of an internal, non-conductive seal arrangement in the gap sub assembly 825. The internal, non-conductive seal arrangement may include a second sleeve 855 formed from a high temperature, high strength dielectric polymer, such as PEEK, and a series of elastomer seals 846, 848 disposed on the mandrel 840 and housing 830 respectively. The elastomer seals 846, 848 prevent drilling fluid from entering the internal space between mandrel 340 and housing 330. A second, non-conductive gap ring 850 is provided in the bore of the gap sub assembly 825 to improve the electrical performance of the system. More specifically, as with the first gap ring 835, the second, non-conductive gap ring 850 increases the path length that the current must flow through, thereby increasing the resistance of that path, and thus decreasing the unwanted current flow in the interior of the gap sub assembly 825. The second gap ring 850 may be formed from a high temperature, high strength dielectric polymer, such as PEEK.

A plurality of non conductive torsion pins 845 are also included in the gap sub assembly 825. The torsion pins 845 are constructed and arranged to ensure that no relative rotation between the mandrel 840 and housing 830 may occur, even if the dielectric material 839 bond fails. The torsion pins 845 are cylindrical pins disposed in matching machined grooves.

Figure 9:
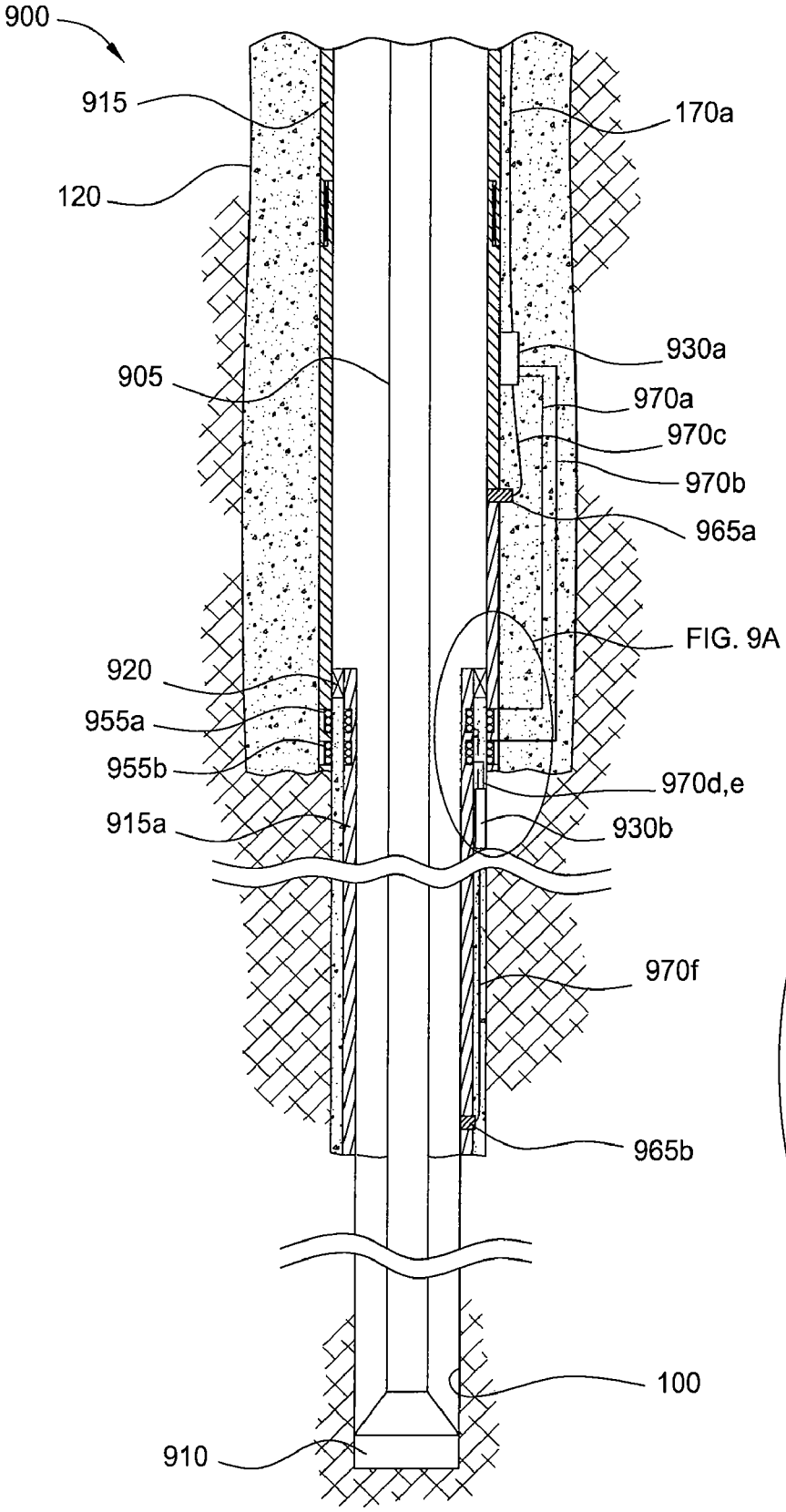
FIG. 9 is an alternate downhole configuration for use with any of the drilling systems of FIGS. 2, 2B, and 3-7, according to another embodiment of the present invention.
Figure 9A:
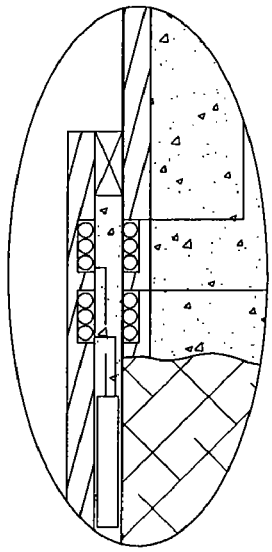
FIG. 9A is an enlargement of a portion of FIG. 9.

FIG. 9 is an alternate downhole configuration 900 for use with surface equipment of any of the drilling systems 200, 250, 300-700 of FIGS. 2, 2B, and 3-7, according to another embodiment of the present invention. A pressure sensor (or PT sensor) 965*a* is included in the casing string 915 instead of the DDV 150. Alternatively, the DDV 150 (with sensor(s)) may be included in the casing string 915. The pressure sensor 965*a* is in electrical or optical communication with a controller 930*a* via line 970*c*. A pressure (or PT sensor) 965*b* is disposed near a longitudinal end of a liner 915*a*. The sensor 965*b* is in electrical or optical communication with the liner controller 930*b* via line 970*f*. The liner 915*a* has been hung from the casing string 915 by anchor 920. The anchor 920 may also include a packing element. The liner 915*a* is cemented 120 in place. A drill string 905 having a bit 910 is disposed through the casing string 915 and the liner 915*a*.

Disposed near a longitudinal end of the casing string 915 is a part of an inductive coupling 955*a* and a part of an inductive coupling 955*b*. The other parts of the inductive couplings 955*a,b* are disposed near a longitudinal end of the liner 915*a*. The casing controller 930*a* is in electrical communication with each part of the couplings 955*a, b* via lines 970*a, b*, respectively. One of the couplings 955*a, b* is used for power transfer and the other coupling 955*a, b* is used for data transfer. The liner controller 930*b* is in electrical communication with each part of the couplings 955*a, b* via lines 970*d, e*, respectively. The controller 930*b* and the lines 970*d-f* may be disposed along an outer surface of the liner 915*a* or within a wall of the liner 915*a*.

Alternatively, only one inductive coupling may be used to transmit both power and data. In this alternative, the frequencies of the power and data signals would be different so as not to interfere with one another. Additionally, the liner 915*a* may include one or more additional inductive couplings (not shown) for data and power communication with a second liner (not shown) which may be disposed along an inner surface of the liner 915*a*. The casing parts and the liner parts of the inductive couplings 955*a, b* may each be disposed in separate subs made from a non-magnetic material (i.e., austenitic stainless steel) that are joined to the respective casing 915 and liner 915*a* by a threaded connection to avoid interference. Additionally, there may be several sets of the casing part of the inductive couplings 955*a, b* disposed in the casing 915, each set longitudinally spaced to create a window (i.e., 90 feet) to allow for tolerance in the setting depth of the liner 915*a*. Alternatively, the casing 915 may include a profile formed on an inner surface thereof and the liner 915*a* may include a mating drag block received by the profile to ensure proximal alignment of the parts of the inductive couplings 955*a, b*.

The couplings 955*a, b* are an inductive energy/data transfer devices. The couplings 955*a, b* are devoid of any mechanical contact between the two parts of each coupling. Each part of each of the couplings 955*a,b* include either a primary coil or a secondary coil. Each of the coils may be strands of wire made from a conductive material, such as aluminum, copper, or alloys thereof. The wire may be jacketed in an insulating polymer, such as a thermoplastic or elastomer. The coils may then be encased in a polymer, such as epoxy. In general, the couplings 955*a,b* each act similar to a common transformer in that they employ electromagnetic induction to transfer electrical energy/data from one circuit, via a primary coil, to another, via a secondary coil, and does so without direct connection between circuits. In operation, an alternating current (AC) signal generated by a sine wave generator included in each of the controllers 930*a,b*.

For the power coupling, the AC signal is generated by the casing controller 930*a* and for the data coupling the AC signal is generated by the liner controller 930*b*. When the AC flows through the primary coil the resulting magnetic flux induces an AC signal across the secondary coil. The liner controller 930*b* also includes a rectifier and direct current (DC) voltage regulator (DCRR) to convert the induced AC current into a usable DC signal. The casing controller 930*a* may then demodulate the data signal and remodulate the data signal for transmission along the line 170*a* to the SMCU (multiplexed with the signal from the pressure sensor 965*a*). The couplings 955*a,b* are sufficiently longitudinally spaced to avoid interference with one another. Alternatively, conventional slip rings, capacitive couplings, roll rings, or transmitters using fluid metal may be used instead of the inductive couplings 955*a,b*.

Adding another pressure sensor 965*b* in the liner 915*a* minimizes the distance between the sensing depth and the open-hole section of the wellbore 100, thereby providing a more accurate indication of the pressure profile in the open-hole section. By using the couplings 955*a,b*, a high bandwidth data (and power) connection may be maintained between the sensor 965*b* and the SMCU 65 without otherwise having to run a second data (and power) line from the surface 5. Running a second data line from the surface would expose the data line to drilling fluid returning in the annulus 125 and, in the case that a DDV 150 is installed in the casing 915, prevent closure of the DDV.

Figure 10A:
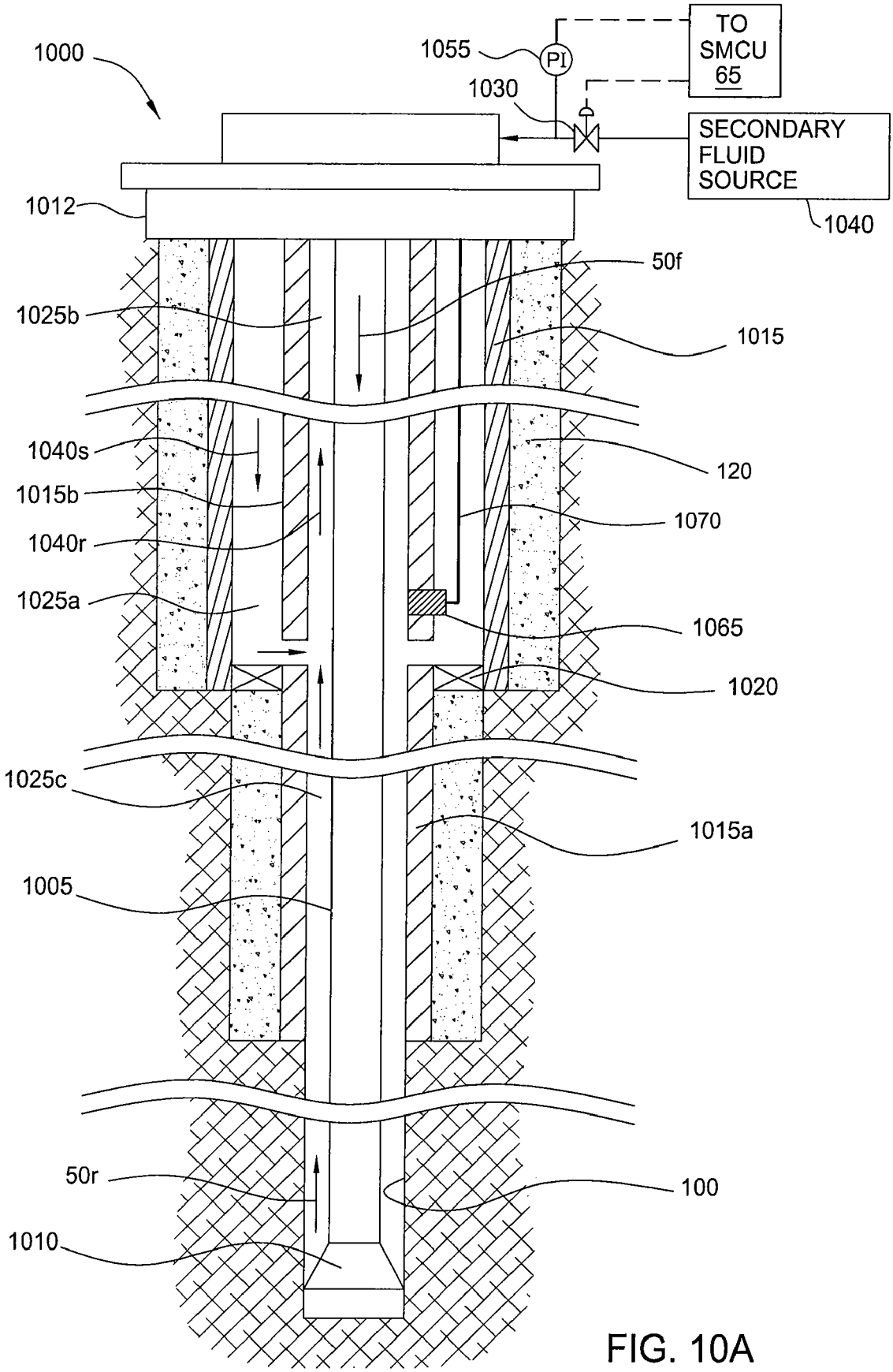
FIG. 10A is an alternate downhole configuration for use with any of the drilling systems of FIGS. 2, 2B, and 3-7, according to another embodiment of the present invention.

FIG. 10A is an alternate surface/downhole configuration 1000 for use with any of the drilling systems 200, 250, 300-700 of FIGS. 2, 2B, and 3-7, according to another embodiment of the present invention. The drilling system 1000 provides the capability to reduce (or increase) the density of the drilling fluid 50*f*, for example during underbalanced or near underbalanced drilling operation.

The drilling system 1000 includes a modified wellhead 1012. Additionally, a secondary fluid 1040*s* is injected from a secondary fluid source 1040, such as a nitrogen tank or nitrogen generator, is connected to the modified wellhead 1012. Alternatively, the secondary fluid 1040*s* could be natural gas, exhaust fumes from a prime mover (not shown), a liquid having a lower density than the drilling fluid 50*f*, or a liquid having a higher density than the drilling fluid 50*f*. An injection rate from the secondary fluid source 1040 may be regulated by a control valve or variable choke valve 1030 which is in communication with the SMCU 65. The injection rate may be monitored by providing a pressure (or PT) sensor 1055 and/or FM in data communication with the SMCU 65. A string of casing 1015 is hung from the wellhead 1012 and cemented 120 to the wellbore 100. A liner 1015*a* has been hung from the casing string 1015 by anchor 1020. The anchor 1020 may also include a packing element. The liner 1015*a* is also cemented 120 in place.

A tieback casing string 1015*b* is also hung from the modified wellhead 1012 and disposed within the casing string 1015. A pressure sensor (or PT sensor) 1065 is included in the tieback casing 1015*b*. Alternatively, the DDV 150 (with sensor(s)) may be included in the tieback casing 1015*b*. Alternatively, the liner 1015*a* may also have a pressure sensor (or PT sensor) (not shown) connected to the surface using inductive couplings between the liner and the casing 1015, similar to the drilling system 900. The pressure sensor 1065 is in electrical or optical communication with the SMCU 65 via control line 1070. Annuluses 1025*a-c* are defined between: an outer surface of the tieback casing 1015*b* and an inner surface of the casing 1015, an inner surface of the tieback casing 1015*b* and an outer surface of the drill string 1005, and the outer surface of the drill string 1005 and an inner surface of the liner 1015*a*, respectively. The secondary fluid source 1040 is in fluid communication with the annulus 1025*a*.

In operation, drilling fluid 50*f*, such as conventional oil or water-based mud, is injected through the drill string 1005 and exits from the drill bit 1010. The returns 50*r* return to the surface 5 via annulus 1025*c*. A flow rate of the secondary fluid 1040*s*, determined by the SMCU 65, is injected through the annulus 1025*a*. The secondary fluid mixes with the returns 50*r* at a junction between annulus 1025*a* and 1025*c*. The secondary fluid mixes with the returns 50*r*, thereby lowering (or raising) the density of the returns/secondary fluid mixture 1040*r* as compared to the density of the returns 50*r*. The resulting lighter mixture lowers (or increases) the annulus pressure that would otherwise be exerted by the column of the returns 50*r*. Thus, by adjusting the injection rate, the annulus pressure can be controlled. Additionally, a second (or more) injection location may be provided in the tieback casing string 1015*b*, for example, midway between the end of the tieback casing 1015*b* and the wellhead 1012. Alternatively, injection of the secondary fluid may be used to maintain annulus pressure control during tripping of the drill string 1005 instead of (or in addition to) applying back pressure to the annulus 1025*b* from the surface or using the CCS/CFS 350*a, b*.

Figure 10B:
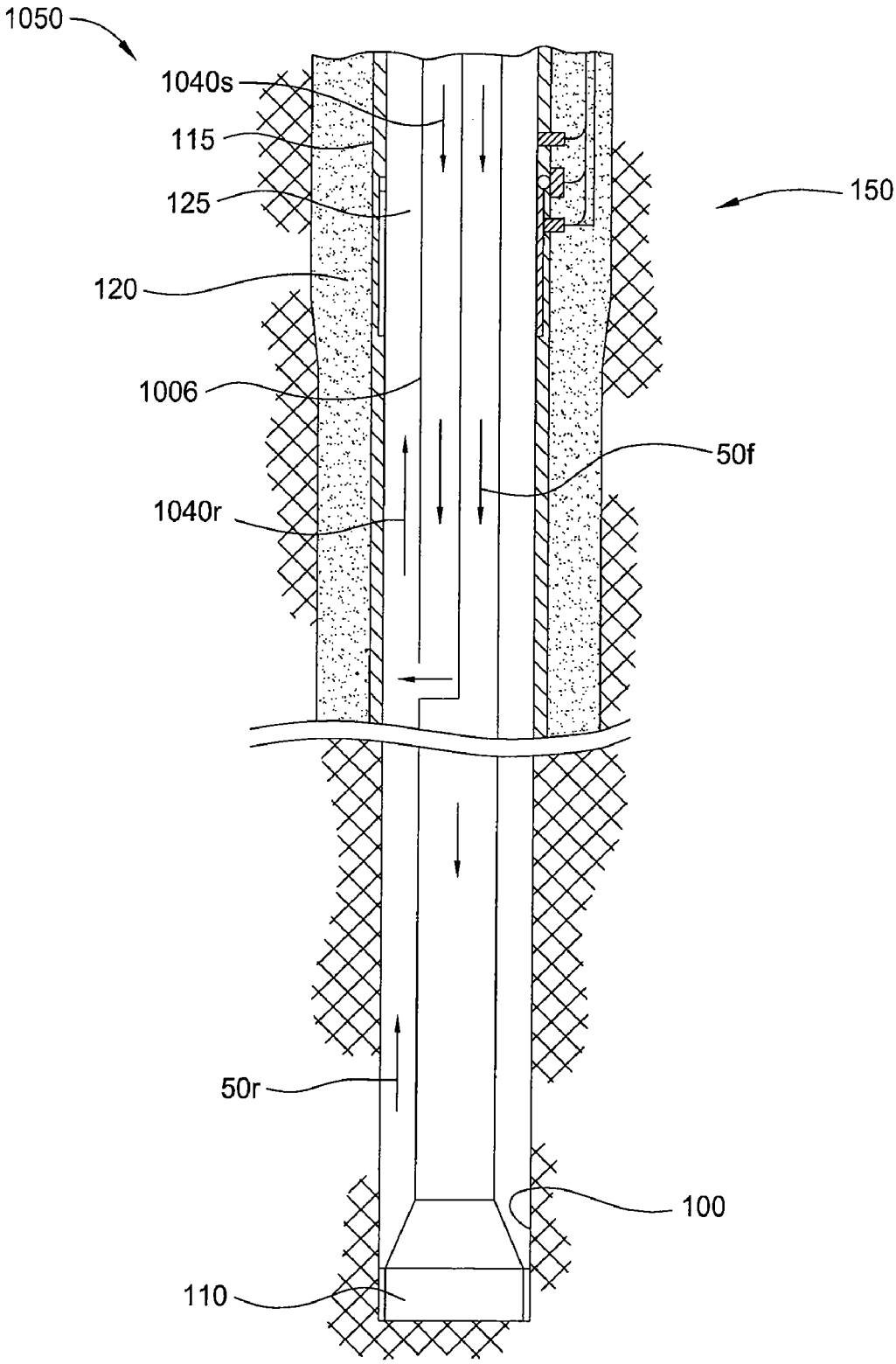
FIG. 10B is an alternate downhole configuration for use with any of the drilling systems of FIGS. 2, 2B, and 3-7, according to another embodiment of the present invention.

FIG. 10B is an alternate surface/downhole configuration 1050 for use with any of the drilling systems 200, 250, 300-700 of FIGS. 2, 2B, and 3-7, according to another embodiment of the present invention. The drilling system 1050 is similar to the drilling system 1000 except that the secondary fluid 1040*s* is injected through one of the chambers 1006*a, b* of a dual-flow drill string 1006 instead of the tie-back annulus 1025*a*. Drilling fluid is injected through the other one of the chambers 1006*a, b*. Alternatively, the secondary fluid 1040*s* may be injected through the annulus 125 and the return mixture 1040*r* would flow through one of the chambers 1006*a, b*.

Figure 10C:
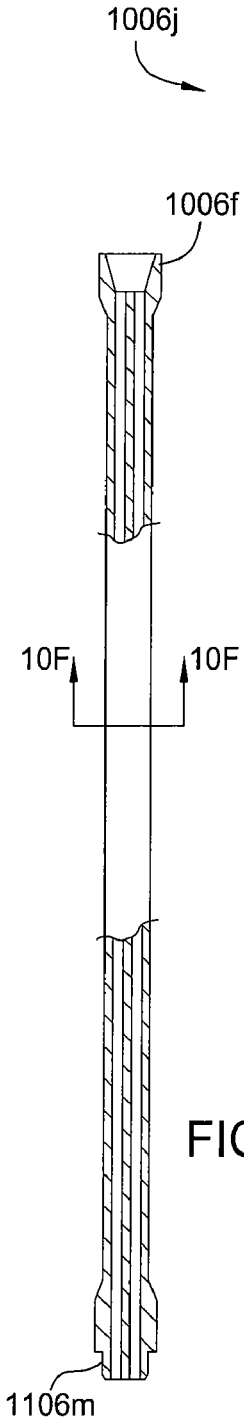
FIG. 10C is a partial cross section of a joint of the dual-flow drill string suitable for use with the downhole configuration of FIG. 10B.
Figure 10E:
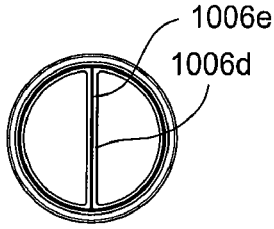
FIG. 10E is an enlarged top view of FIG. 10C.
Figure 10F:
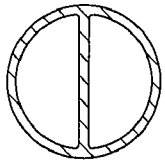
FIG. 10F is cross section taken along line 10F-10F of FIG. 10C.
Figure 10G:
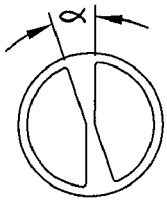
FIG. 10G is an enlarged bottom view of FIG. 10C.
Figure 10D:
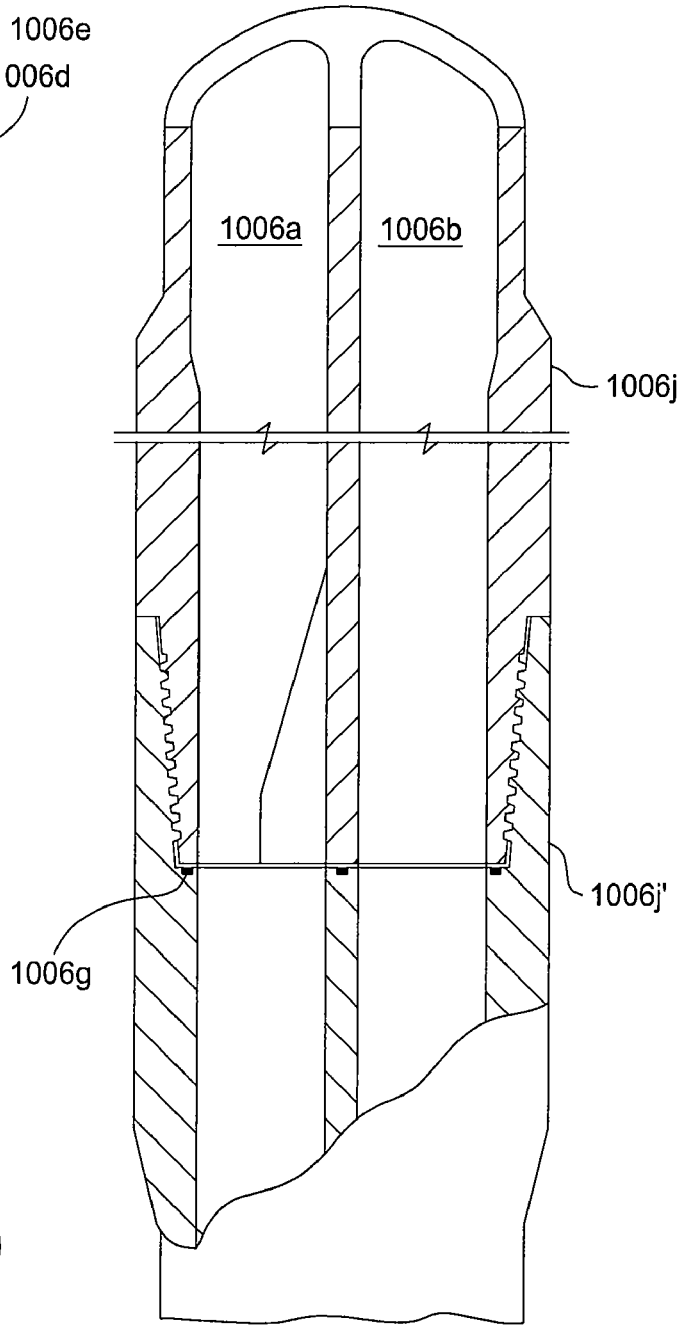
FIG. 10D is a cross section of a threaded coupling of the dual-flow drill string illustrating a pin of the joint mated with a box of a second joint.

FIG. 10C is a partial cross section of a joint 1006*j* of the dual-flow drill string 1006. FIG. 10D is a cross section of a threaded coupling of the dual-flow drill string 1006 illustrating a pin 1006*m* of the joint 1006*j* mated with a box 1006*f* of a second joint 1006*j*'. FIG. 10E is an enlarged top view of FIG. 10C. FIG. 10F is cross section taken along line 10F-10F of FIG. 10C. FIG. 10G is an enlarged bottom view of FIG. 10C. A partition is formed in a wall of the joint 1006*j* and divides an interior of the drill string 1006 into two flow paths 1006*a* and 1006*b*, respectively. A box 1006*f* is provided at a first longitudinal end of the joint 1006*j* and the pin 1006*m* is provided at the second longitudinal end of the joint 1006*j*. A face of one of the pin 1006*m* and box 1006*f* (box as shown) has a groove formed therein which receives a gasket 1006*g*. The face of one of the pin 1006*m* and box 1006*f* (pin as shown) may have an enlarged partition to ensure a seal over a certain angle $\alpha$. This angle $\alpha$ allows for some thread slippage. Alternatively, a concentric dual drill string (not shown) may be used instead of the dual-flow drill string 1006.

Figure 10H:
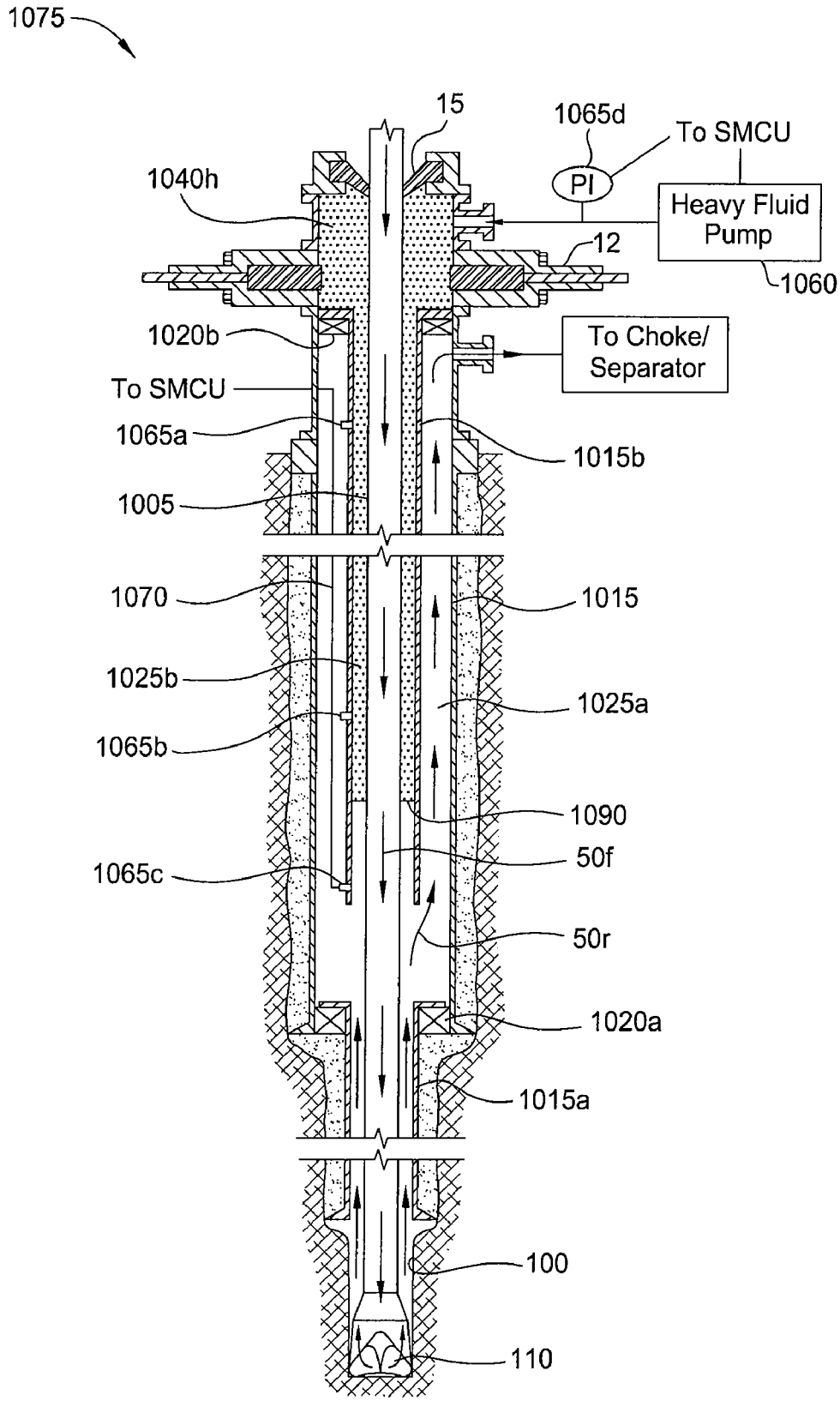
FIG. 10H is an alternate surface/downhole configuration for use with any of the drilling systems of FIGS. 2, 2B, and 3-7, according to another embodiment of the present invention.

FIG. 10H is an alternate surface/downhole configuration 1075 for use with any of the drilling systems 200, 250, 300-700 of FIGS. 2, 2B, and 3-7, according to another embodiment of the present invention. The drilling system 1075 includes the tieback casing string 1015*b* hung from the wellhead 1012 by hanger 1020*b* and the liner 1015*a* hung from the casing 1015 by hanger 1020*a*. A column of high density fluid (relative to the density of the returns 50*r*) 1040*h*, a.k.a. a mudcap, is maintained in the annulus 1025*b* between the drillstring 1005 and the tieback casing string 1015*b*. Alternatively, the mudcap may be maintained in the annulus 1025*a* between the tieback casing string 1015*b* and the casing string 1015. The returns 50*r* exit the wellbore 100 through the tieback annulus 1025*a* and an outlet of the wellhead 1012.

The mudcap 1040*h* provides a pressure barrier so that minimal pressure is exerted on the RCD 15, thereby increasing the service life of the RCD 15 and reducing leakage across the RCD 15. The mudcap 1040*h* also discourages any gas migration therethrough which, in combination with reduced leakage across the RCD 15, is beneficial when drilling through hazardous formations (i.e., hydrogen sulfide). The mudcap 1040*h* is injected into the tieback annulus 1025*a* and the depth of the pressure barrier 1090 is maintained by a pump 1060 in communication with the RCD outlet. One or more pressure (or PT) sensors 1065*a-c* are disposed in the tieback string 1015*b* and in fluid communication with both the tieback annulus 1025*a* and the drillstring annulus 1025*a*. The pressure sensors 1065*a-c* are in electrical/optical communication with the SMCU 65 via control line The sensors 1065*a-c* may be incrementally spaced so that the SMCU 65 may determine and control a level of an interface 1090 between the mudcap 1040*h* and the returns 50*r* by activating and/or controlling a flow rate of the pump 1060, by reversing the pump 1060, and/or not activating and/or reducing the flow rate of the pump (the mudcap 1040*h* may gradually mix with the returns 50*r* so that by not activating and/or reducing a flow rate of the pump 1060, the SMCU 65 may let the level of the interface 1090 decrease (up in the FIG.)). A pressure (or PT) sensor 1065*d* may also be provided in fluid communication with the RCD outlet to monitor the pressure exerted on the RCD 15 and in data communication with the SMCU 65.

Additionally, the DDV 150 (with sensor(s)) may be included in the tieback casing 1015*b*. Additionally, the casing 1015 may have a pressure sensor (or PT sensor) installed therein and the liner 1015*a* may also have a pressure sensor (or PT sensor) (not shown) connected to the surface 5 using inductive couplings between the liner and the casing 1015, similar to the drilling system 900. Alternatively, the tieback casing 1015*b* may extend to a polished bore receptacle (see FIG. 11) on the hanger 1020*a* and may include first and second valves and a second RCD between the valves. This alternative is disclosed in U.S. Pat. No. 6,732,804 , which is hereby incorporated by reference in its entirety.

Figure 11A:
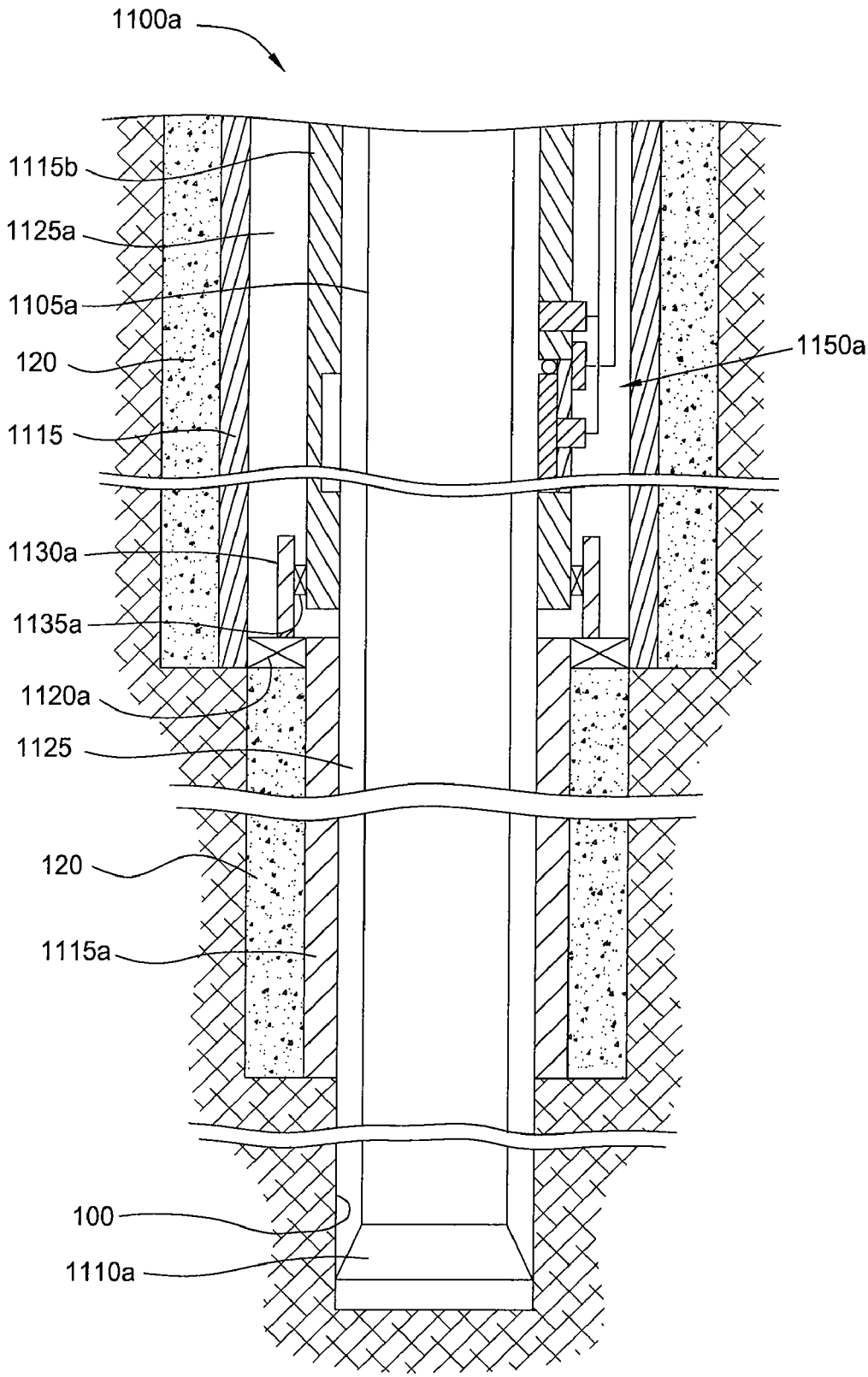
FIG. 11A is an alternate downhole configuration for use with surface equipment of any of the drilling systems of FIGS. 2, 2B, and 3-7, according to another embodiment of the present invention.
Figure 11B:
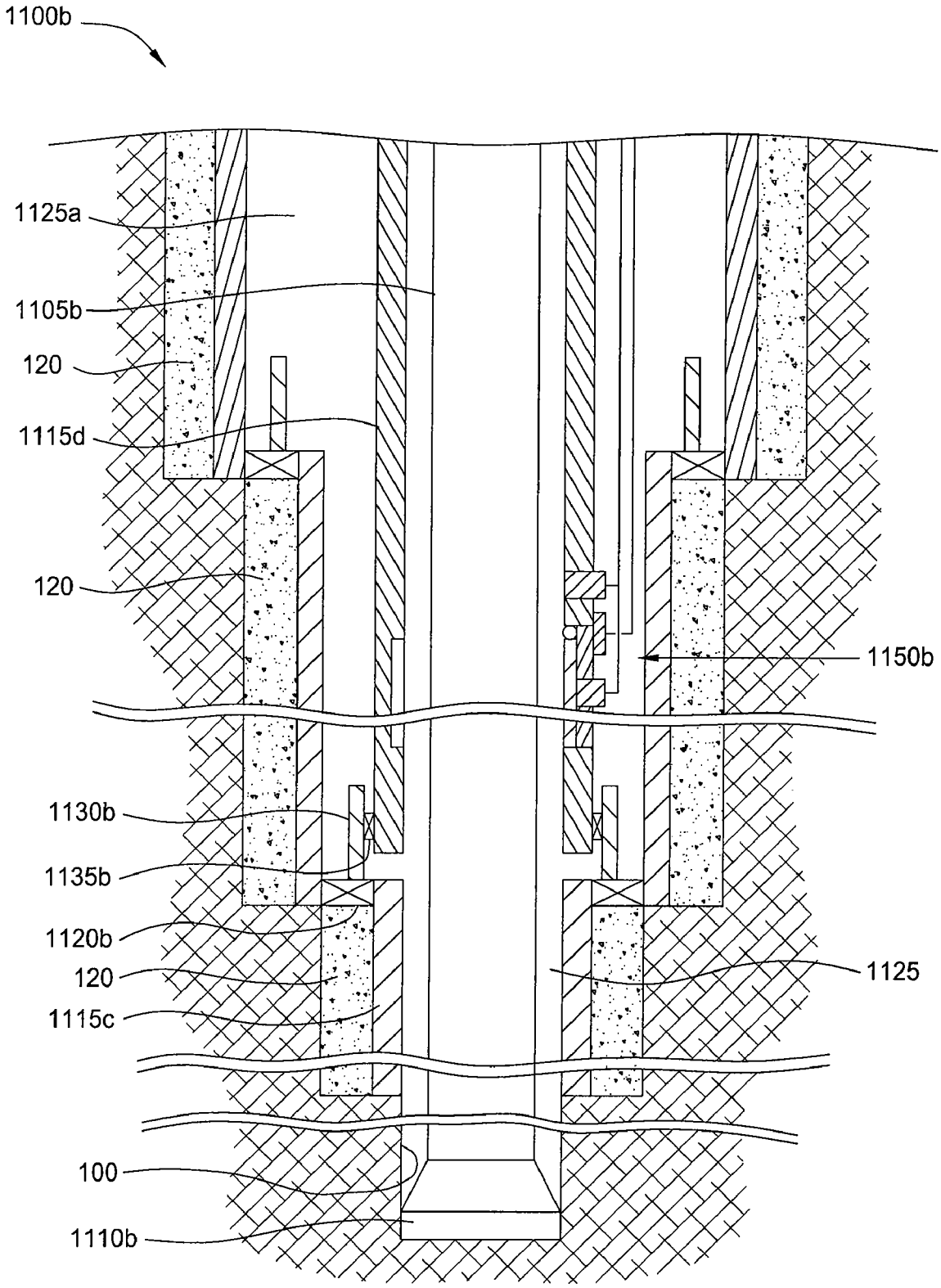
FIG. 11B illustrates a downhole configuration in which the wellbore has been further extended from the downhole configuration of FIG. 11A.

FIG. 11A is an alternate downhole configuration 1100*a* for use with surface equipment of any of the drilling systems 200, 250, 300-700 of FIGS. 2, 2B, and 3-7, according to another embodiment of the present invention. FIG. 11B illustrates a downhole configuration 1100*b* in which the wellbore has been further extended from the downhole configuration 1100*a*.

Referring to FIG. 11A, a string of casing 1115 is hung from a wellhead (not shown) and cemented 120 to the wellbore 100. A liner 1115*a* has been hung from the casing string 1115 by anchor 1120*a*. The anchor 1120*a* may also include a packing element. The liner 1115*a* is also cemented 120 in place. Attached to the anchor 1120*a* is a polished bore receptacle (PBR) 1130*a*. A tieback casing string 1115*b*, including a DDV 1150 (similar to the DDV 150) is also hung from the wellhead and disposed within the casing string 1115. Alternatively, a pressure sensor (or PT sensor) (without the valve) may be disposed in the tieback casing 1115*b*. Disposed along an outer surface near a longitudinal end of the tieback casing string 1115*b* is a sealing element 1135*a*. As the casing string 115*a* is inserted into the PBR, the sealing element 1135*a* engages an inner surface of the PBR, thereby forming a seal therebetween and isolating an annulus 1125*a* defined between an inner surface of the casing string 1115 and an outer surface of the tieback string 1115*b* from an annulus defined between an inner surface of the tieback casing 1115*b*/liner 1115*a* and an outer surface of the drill string 1105*a*. The DDV 1150 is able to isolate (with the drillstring 1105*a* removed) a bore of the tieback casing 1115*b* from a bore of the liner 1115*a*, thereby effectively isolating an upper portion of the wellbore from a lower portion of the wellbore (the annulus 1125*a* need not be isolated by the DDV since it isolated by the seal 1135*a*). The return mixture travels to the surface 5 via the annulus 1125. This configuration 1100*a* is advantageous over the embodiment of FIG. 1 in that the DDV 1150 is not fixed to the casing 1115. When adding another casing string to the configuration of FIG. 1, the DDV 150 ends up being cemented between the casing string 115 and the next casing string. In this configuration 1100*a*, after drilling the next section of wellbore 100, the tieback casing string 1115*b*, along with the DDV 1150, may be removed.

Referring to FIG. 11B, a second liner 1115*c* has been hung from the first liner 1115*a*, via a second anchor 1120*b*, and cemented 120 to the wellbore. A second PBR 1130*b* is attached to the second anchor 1120*b*. A second tieback casing 1115*d*, having a second DDV 1150*b*, is hung from a wellhead and disposed within the casing string 1115 and first liner 1115*a*. A seal 1135*b* disposed along an outer surface of the tieback casing 1115*c* near a longitudinal end thereof engages an inner surface of the second PBR 1130*b*, thereby isolating the annulus 11125 from the annulus 1125*a*. Analogously to the drilling system 900 of FIG. 9, running the second DDV 1150*b* (with sensor(s)), minimizes the distance between the sensing depth and the open-hole section of the wellbore 100, thereby providing a more accurate indication of the pressure profile in the open-hole section. Further, using a tie-back casing string instead of liner may be advantageous in that the drilling fluid annulus 1125 is mono-bore to the surface, whereas if a liner were used the drilling fluid annulus would increase in area (see FIG. 9) which causes a reduction in fluid velocity of the return mixture, thereby reducing the cuttings carrying capability of the return mixture.

Figure 12:
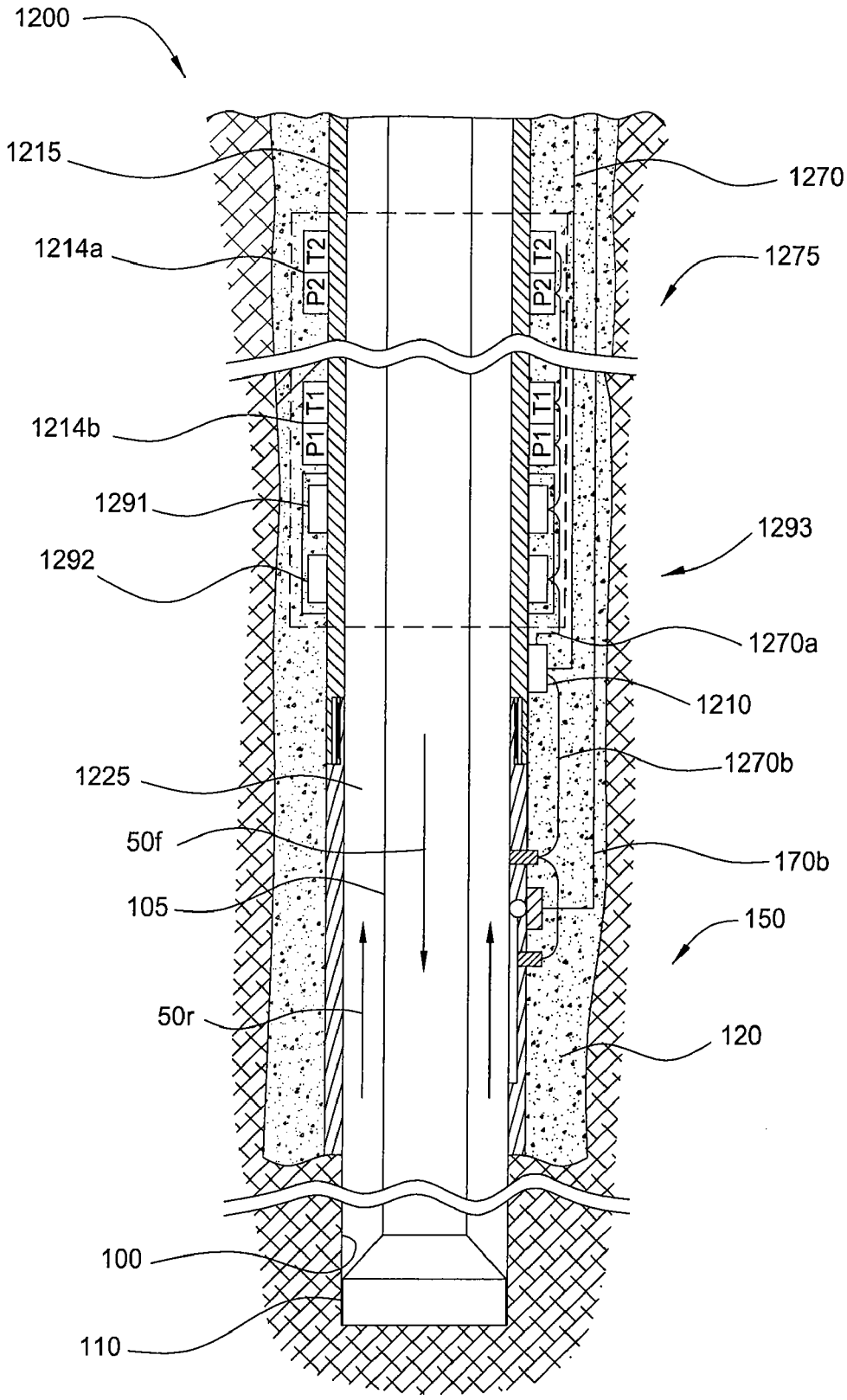
FIG. 12 is an alternate downhole configuration for use with surface equipment of any of the drilling systems of FIGS. 2, 2B, and 3-7, according to another embodiment of the present invention.

FIG. 12 is an alternate downhole configuration 1200 for use any of the drilling systems 200, 250, 300-700 of FIGS. 2, 2B, and 3-7, according to another embodiment of the present invention. A flow meter 1275 may be included as part of the casing string 1215 to measure volumetric fractions of individual phases of the returns 50*r* flowing through the casing string 1215, as well as to measure flow rates of components in the returns 50*r*. Obtaining these measurements allows monitoring of the substances being added or removed from the wellbore while drilling, as described below. The flow meter 975 may provide mass flow rate or volumetric flow rate of components in the multiphase mixture.

The flow meter 1275 may be substantially the same as the flow meter disclosed in U.S. Pat. No. 6,945,095 which is herein incorporated by reference in its entirety. The flow meter 1275 allows volumetric fractions of individual phases of the returns 50*r* flowing through the casing string 1215, as well as flow rates of individual phases of the returns 50*r*, to be found. The volumetric fractions are determined by using a mixture density and speed of sound of the returns 50*r*. The mixture density may be determined by direct measurement from a densitometer or based on a measured pressure difference between two vertically displaced measurement points (shown as P1 and P2) and a measured bulk velocity of the mixture, as disclosed in the '095 patent. Various equations are utilized to calculate flow rate and/or component fractions of the fluid flowing through the casing string 915 using the above parameters, as disclosed in the '095 patent.

The flow meter 1275 may include a velocity sensor 1291 and speed of sound sensor 1292 for measuring bulk velocity and speed of sound of the fluid, respectively, up through the inner surface of the casing string 1215, which parameters are used in equations to calculate flow rate and/or phase fractions of the fluid. As illustrated, the sensors 1291 and 1292 may be integrated in single flow sensor assembly (FSA) 1293. In the alternative, sensors 1291 and 1292 may be separate sensors. The velocity sensor 1291 and speed of sound sensor 1292 of FSA 1293 may be similar to those described in commonly-owned U.S. Pat. No. 6,354,147, entitled "Fluid Parameter Measurement in Pipes Using Acoustic Pressures", issued Mar. 12, 2002 and incorporated herein by reference.

The flow meter 1275 may also include PT sensors 1214*a,b* around the outer surface of the casing string 1215, the sensors 1214*a,b* similar to those described in detail in commonly-owned U.S. Pat. No. 5,892,860, entitled "Multi-Parameter Fiber Optic Sensor For Use In Harsh Environments", issued Apr. 6, 1999 and incorporated herein by reference. In the alternative, the pressure and temperature sensors may be separate from one another. Further, for some embodiments, the flow meter 1275 may utilize an optical differential pressure sensor (not shown). The sensors 1291, 1292, and/or 1214*a,b* may be attached to the casing string 1215 using the methods and apparatus described in relation to attaching the sensors 30, 130, 230, 330, 430 to the casing strings 5, 105, 205, 305, 405 of FIGS. 1-5 of U.S. patent application Ser. No. 10/676,376 and entitled "Permanent Downhole Deployment of Optical Sensors", filed on Oct. 1, 2003, which is herein incorporated by reference in its entirety.

Optical line 1270*b* is provided for optical communication between the sensors 1291, 1292, and 1214*a,b* and an optional downhole controller 1210. An optical or electrical line is provided between the downhole controller 1210 and the sensors of the DDV 150. The downhole controller 1210 is in data/power communication with the SMCU 65 via line 1270. The downhole controller provides amplification, modulation, and multiplexing capabilities for communication between the sensors 1291, 1292, and 1214*a,b* and the SMCU 65.

Optionally, a conventional densitometer (e.g., a nuclear fluid densitometer) may be used to measure mixture density as illustrated in FIG. 2B of the '095 patent. However, for other embodiments, mixture density may be determined based on a measured differential pressure between two vertically displaced measurement points and a bulk velocity of the fluid mixture, also disclosed in the '095 patent.

While the returns 50*r* are circulating up through the annulus 1225, the flow meter 1275 may be used to measure the flow rate of the returns 50*r* in real time. Furthermore, the flow meter 1275 may be utilized to measure in real time the component fractions of oil, water, mud, gas, and/or particulate matter including cuttings, flowing up through the annulus in the returns 50*r*. Specifically, the optical sensors 1291, 1292, and 1214*a,b* send the measured wellbore parameters up through the control line 1270 to the SMCU 65. The optical signal processing portion of the SMCU 65 calculates the flow rate and component fractions of the returns 1225 utilizing the equations and algorithms disclosed in the '095 patent.

By utilizing the flow meter 1275 to obtain real-time measurements while drilling, the composition of the drilling fluid 50*f* may be altered to optimize drilling conditions, and the flow rate of the drilling fluid 50*f* may be adjusted to provide the desired composition and/or flow rate of the returns 50*r*. Additionally, the real-time measurements while drilling may prove helpful in indicating the amount of cuttings making it to the surface 5 of the wellbore 100, specifically by measuring the amount of cuttings present in the returns 50*r* while it is flowing up through the annulus using the flow meter 1275, then measuring the amount of cuttings present in the fluid exiting to the surface 5. The composition and/or flow rate of the drilling fluid 50*f* may then be adjusted during the drilling process to ensure, for example, that the cuttings do not accumulate within the wellbore 100 and hinder the path of the drill string 105 through the formation.

Utilizing the flow meter 1275 may be advantageous for slimhole drilling. In slimhole drilling the monitoring of flow rates becomes very important because a small change in fluid volume in the well translates into a significant change in height and hence pressure head in the annulus. Generally, if the mass flow in equals the mass flow out, then the well is in control. If the mass flow out is greater than the mass flow in then there is an influx of well fluids into the borehole. If the mass flow in is greater than the mass flow out, then drilling fluid is flowing into the formation, i.e., leaking of fluid into the formation. This may be used for a detection of a kick or a detection of lost circulation. Real-time monitoring of the mass flow rates into and out of the well using the flow meter 1275 provides an alternative to the traditional liquid level monitoring techniques of the prior art. Further, having the flow meter 1275 in the wellbore 100 reduces the delay time of liquid level changes propagating to the surface.

Alternatively, measuring a parameter of the return mixture (i.e., the oil to water ratio) using the flow meter 1275 or a flow meter in the outlet line of the RCD 15 may be used to determine a formation threshold pressure (i.e., pore pressure). For example, if the drilling fluid is an oil based mud and the wellbore is intersecting a water bearing formation (or vice versa), a change in the oil to water ratio would indicate either that drilling fluid is entering the formation or that formation fluid is entering the wellbore. From this behavior, a drilling condition (i.e., overbalanced or underbalanced) may be determined and the bottom hole pressure may be adjusted accordingly. Further, if the change in the oil to water ratio is drastic, then a kick or formation fracture would be indicated and the appropriate steps taken to remedy the situation.

Figure 13:
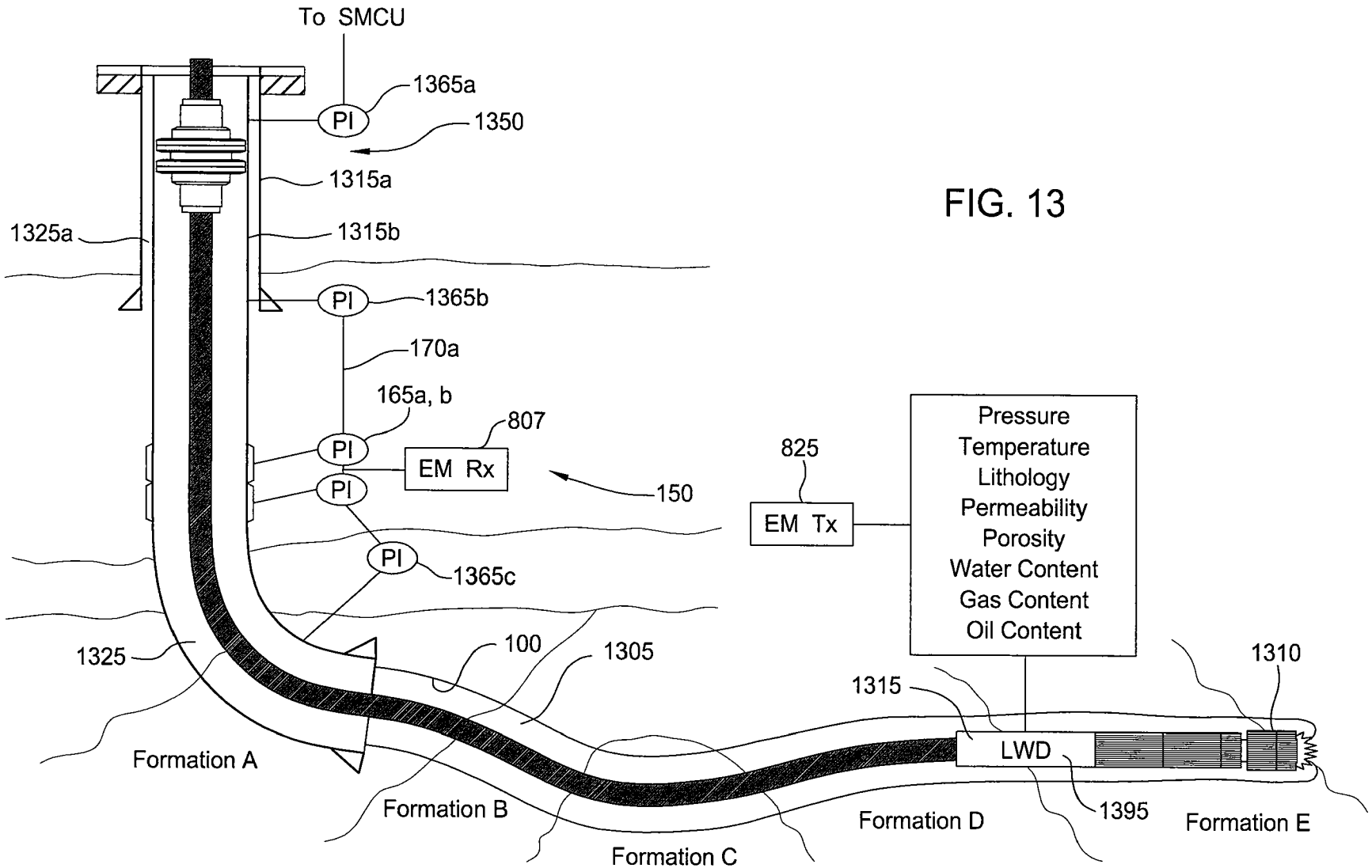
FIG. 13 is an alternate downhole configuration for use with surface equipment of any of the drilling systems of FIGS. 2, 2B, and 3-7, according to another embodiment of the present invention.
Figure 13A:
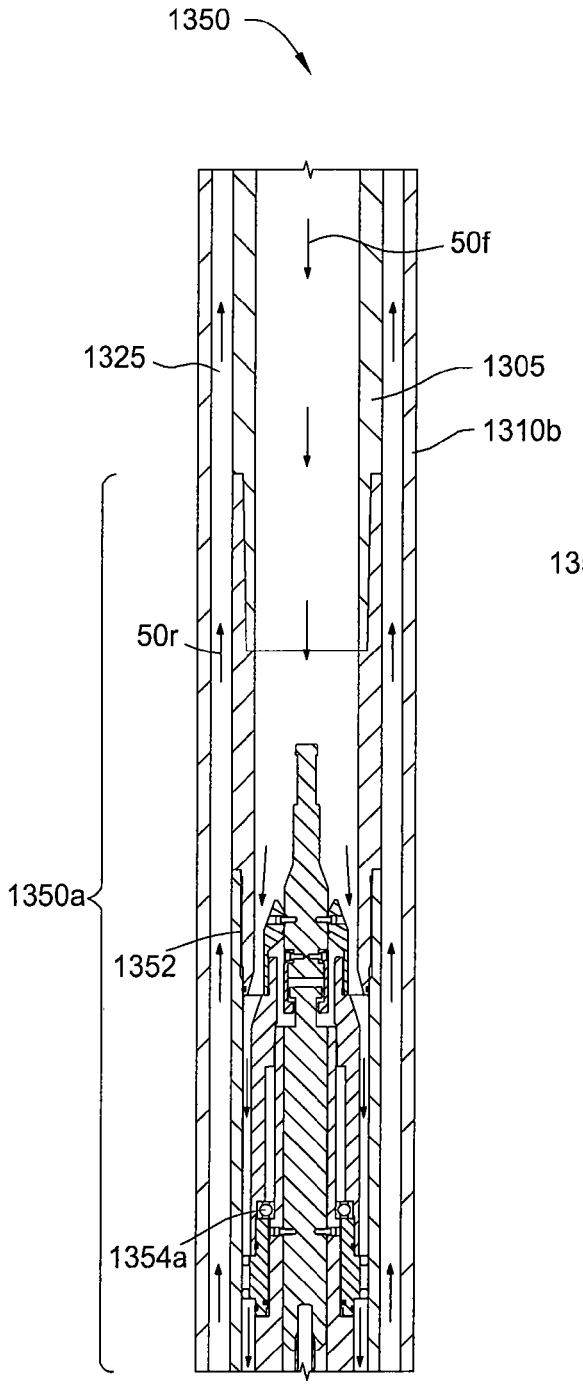
FIGS. 13A-13F are cross-sectional views of an ECDRT 1350 suitable for use with the downhole configuration of FIG. 13.
Figure 13B:
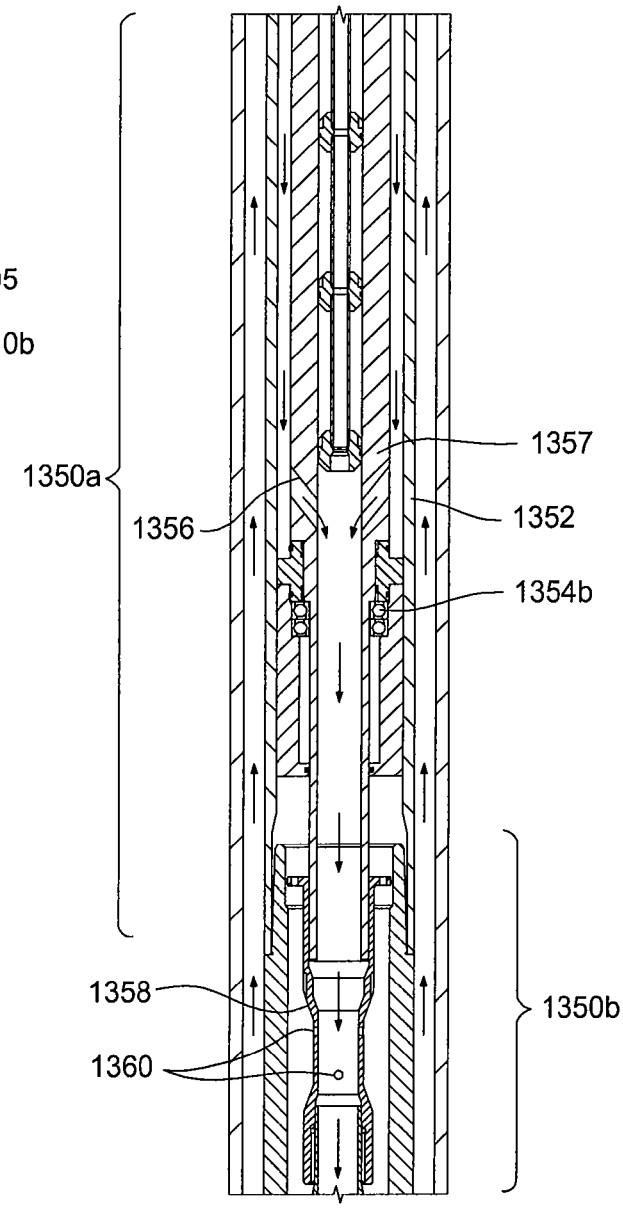
Figure 13C:
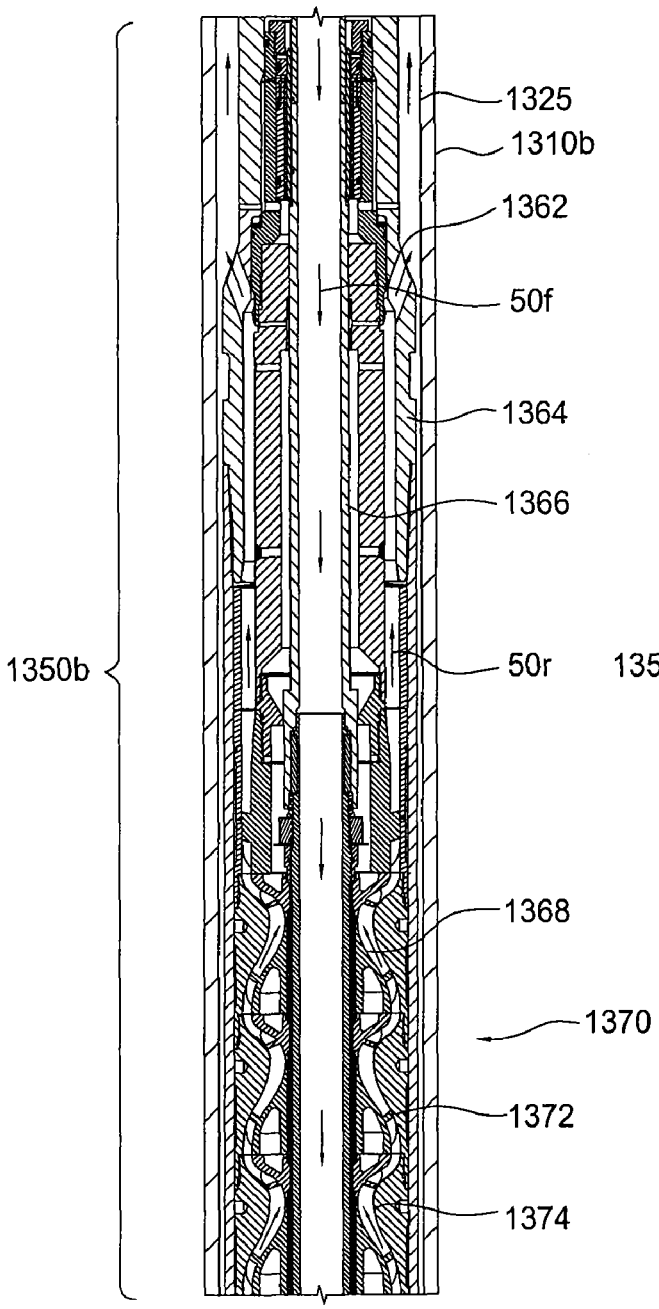
Figure 13D:
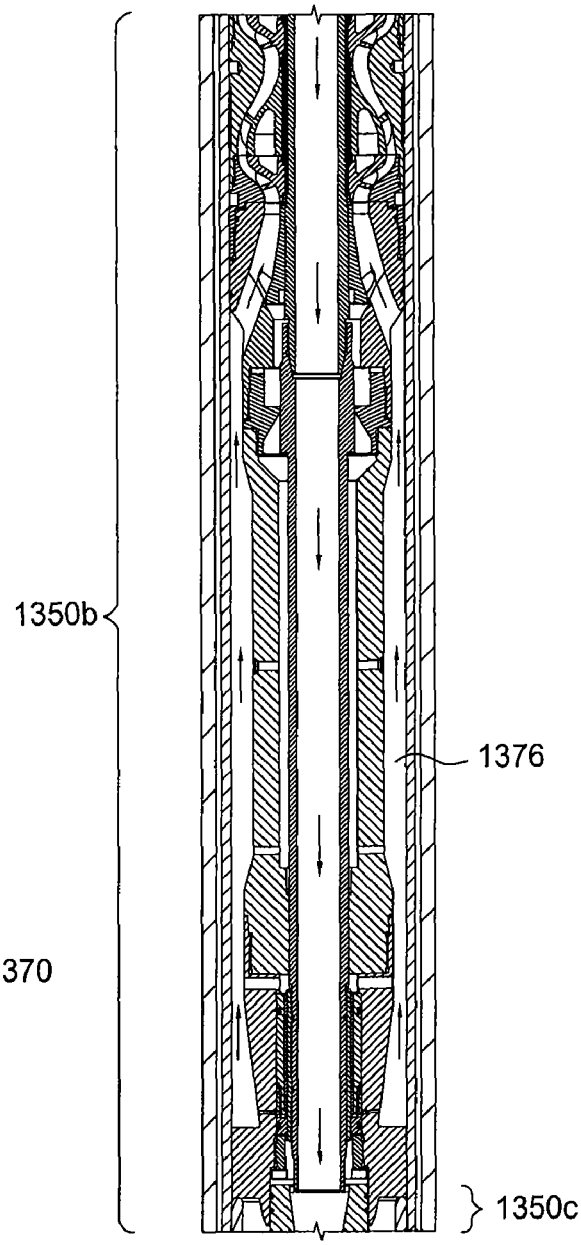
Figure 13E:
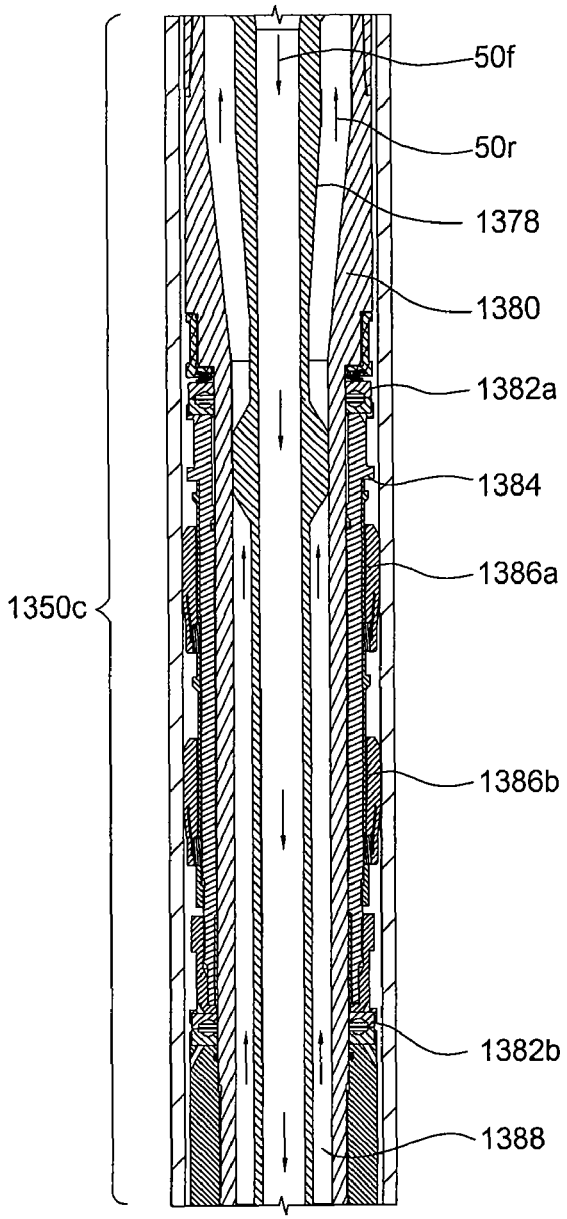
Figure 13F:
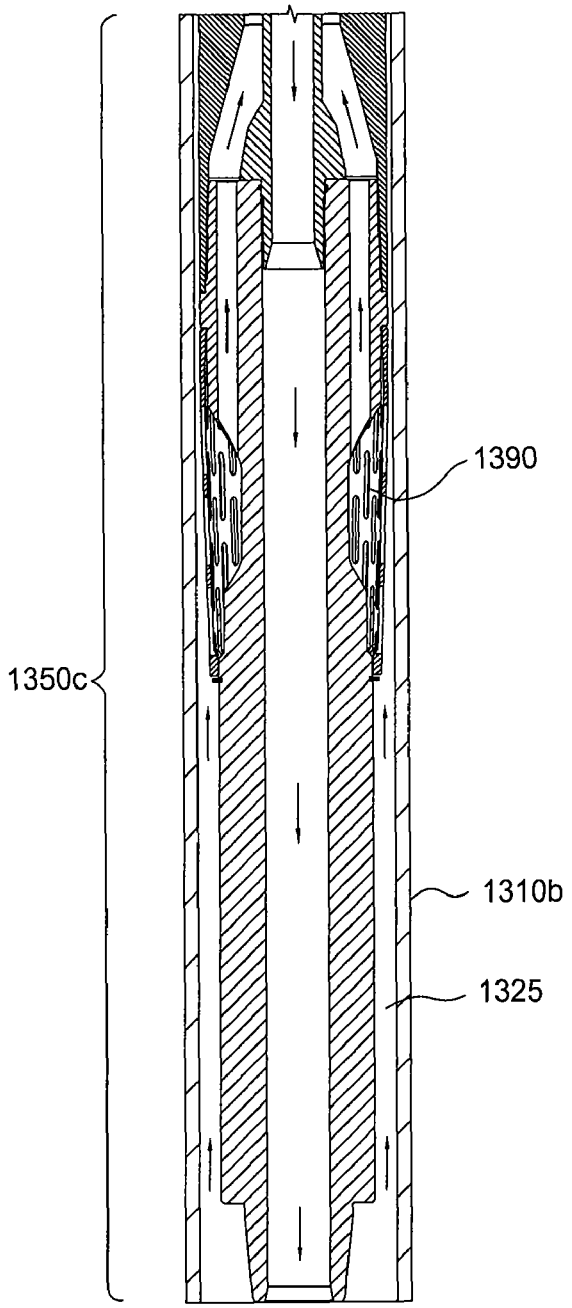

FIG. 13 is an alternate downhole configuration 1300 for use with surface equipment of any of the drilling systems 200, 250, 300-700 of FIGS. 2, 2B, and 3-7, according to another embodiment of the present invention. A first casing string 1315*a* may be cemented to the wellbore 100. A second casing string 1315*b* may be disposed in the wellbore and cemented to the wellbore and the first casing string 1315*a*. The DDV 150 may be assembled as part of the second casing string 1315*b*. The DDV 150 may include the pressure (or PT) sensors 165*a, b* and a casing antenna 807 (assembled with or near the DDV 150). Data communication may be provided between the DDV 150 and the SMCU 65 via control line 170*a* which may be disposed along (or within) an outer surface of the second casing string 1315*b*. For clarity, the control line 170*a* is shown outside the wellbore 100 but would actually be in an annulus 1325*a* formed between the second casing string 1315*b* and the wellbore 100/first casing string 1315*a* or within a wall of the second casing string 1315*b*. As discussed above, a hydraulic line 170*b* (not shown) may also be run with the control line 170*a* for operating the DDV 150. The second casing string 1315*b* may also include one or more additional pressure (or PT) sensors 1365*a-c* longitudinally spaced therealong for monitoring the performance of an equivalent circulation density (ECD) reduction tool (ECDRT) 1350 disposed in the drill string. Additionally, the MPM 1275 (not shown) may also be disposed in the second casing string 1315*b*. Alternatively, the second casing string 1315*b* may be a liner hung from the first casing string 1315*a* or a tie-back casing string seated in a PBR disposed in a liner hung from the first casing string 1315*a*. Alternatively, the first casing string 1315*a* may be omitted.

The drill string 1305 includes the ECDRT 1350 and a drill bit 1310 disposed at a longitudinal end thereof. The ECDRT 1350, discussed more below, provides hydraulic lift to the returns 50*r* in the annulus 1325 in order to offset the effect of friction loss on the BHP. The pressure sensors 165*a, b*/1365*a-c* may be used to monitor the performance of the ECDRT in real time. The pressure sensors 165*a,b*/1365*a-c* may be longitudinally spaced so that at least one pressure sensor is proximate to the ECDRT inlet 1390 and at least one pressure sensor is proximate to the ECDRT outlet 1362 as the ECDRT 1350 travels along the second casing string 1315*b*. The SMCU 65 may then vary one or more operating parameters of the ECDRT 1350 (i.e. injection rate of drilling fluid 50*f* through the drill string 1305 and/or the surface choke 30) to maintain a desired annulus pressure. Additionally, the SMCU 65 may detect failure of the ECDRT 1350 and signal a need to trip the ECDRT 1350 for maintenance. Alternatively, only one pressure sensor may be disposed in the second casing string 1315*b* and the performance of the ECDRT 1350 may be monitored by calculating inlet 1390 and/or outlet 1362 pressures using an annulus flow model, discussed more below.

The drill string 1305 may further include LWD sonde 1395. The LWD sonde 1395 may include one or more instruments, such as spontaneous potential, gamma ray, resistivity, neutron porosity, gamma-gamma/formation density, sonic/acoustic velocity, and caliper. The LWD sonde 1395 may also include a pressure (or PT) sensor. Raw data from these instruments may be transmitted to the casing antenna 807 using an EM gap sub 825 in communication with the LWD sonde 825. The raw data may then be relayed to the SMCU 65 via the control line 170*a*. The SMCU may then process the raw data to calculate lithology, permeability, porosity, water content, oil content, and gas content of Formations A-E as they are being drilled through (or shortly thereafter). Alternatively, the LWD sonde may include a controller to process or partially process the data on-board and then transmit the processed data to the SMCU. Alternatively, the logging data may be transmitted via mud-pulse or wired drill pipe. The drill string 1305 may further include an MWD sonde (not shown) for providing orientation of the drill bit 1310. The drill string 1305 may further include a mud motor (not shown) and/or a steering tool (not shown) for controlling the direction of the bit 1310.

FIGS. 13A-13F are cross-sectional views of a suitable ECDRT 1350. The ECDRT 1350 includes three sections 1350*a-c*. The first section is a turbine motor 1350*a*, which harnesses fluid energy from drilling fluid 50*f* pumped through the drill string 1305 and converts the fluid energy into rotational energy. The second section is a multi-stage mixed flow pump 1350*b* driven by the turbine motor 1350*a*. The pump 1350*b* pumps the returns 50*r* returning from the drill bit 110 through the annulus 1325, toward the surface 5. The lower section 1350*c* includes seals 1386*a, b* that engage the inner surface of the casing 1310*b* to prevent the returns 50*r* from bypassing the pump 1350*b* through the annulus 1325.

The turbine 1350*a* is schematically shown. A more detailed illustration may be found in FIGS. 8-12 of U.S. Pat. No. 6,527,513, which is incorporated by reference in its entirety. The turbine motor 1350*a* includes a housing 1352 defining a chamber therein. A rotor 1357 is disposed in the housing chamber and is supported by bearings 1354*a,b* to allow rotation relative to the housing 1352. The rotor 1357 includes at least one wheel blade array with an annular array of angularly distributed blades. Nozzles are provided for directing jets of drilling fluid 50*f* onto the blades for imparting rotational energy to the rotor 1357. Drilling fluid 50*f* is diverted from the motor chamber to a bore of the rotor 1357 via an outlet 1356 of the motor 1350*a*. At a lower end, the rotor 1357 is rotationally coupled by a hexagonal, spline-like coupling 1358 to a shaft 1366 of the pump 1350*b*. The hexagonal coupling 1358 allows for some longitudinal movement between the rotor 1357 and the pump shaft 1366 within the connection 1358. The motor housing 1352 is connected to an upper end of a housing 1364 of the pump 1350*b* with a threaded connection.

The pump shaft 1366 is mounted at upper and lower ends thereof by bearing cartridges to center the pump shaft 1366 within the pump housing 1364. A bore of the pump shaft 1366 provides a conduit for drilling fluid 50*f* exiting the motor 1350*a* through the pump 1350*b* to the seal section 1350*c*. An impeller section 1370 of the pump 1350*b* includes outwardly formed undulations 1368 rotationally coupled to an outer surface of the pump shaft 1366 and matching, inwardly formed undulations 1374 rotationally coupled to an inner surface of the pump housing 1364. In order to add energy to the fluid, each shaft undulation 1368 includes helical blades 1372 formed thereupon. As the pump shaft 1366 rotates, the returns 50*r* are acted upon by the blades 1372 as the returns 50*r* travel through the impeller section 1370, thereby transferring rotational energy generated by the motor 1350*a* to the returns 50*r*.

The lower section 1350*c* includes a seal shaft 1378 disposed within a seal housing 1380. A bore of the seal shaft 1378 provides a conduit for drilling fluid 50*f* exiting the pump 1350*b* through the seal section 1350*c* to the drill string 1305. The seal housing 1380 is connected to a lower end of the pump housing 1364 with a threaded connection. A seal sleeve 1384 is disposed along an outer surface of the seal housing 1380. The seal sleeve 1384 is supported from the seal housing 1380 by bearings 1382*a, b* so that the seal housing 1380 may rotate relative to the seal sleeve 1384. Disposed along an outer surface of the seal sleeve 1384 are two annular seals 1386*a, b*. The annular seals 1386*a, b* engage the inner surface of the casing 1310*b*, thereby isolating an inlet 1390 from a portion of the annulus 1325 above the annular seals 1386*a,b* and preventing the returns 50*r* from bypassing the pump 1350*b* via the annulus 1325. The pump inlet 1390 includes a screen for filtering large particulates from the returns 50*r* to prevent damage to the pump 1350*b*.

The returns 50*r* returning from the drill bit 110 through the annulus 1325 enter the seal section 1350*c* through the inlet 1390. The returns 50*r* are transported through the seal section 1350*c* via an annulus 1388 formed between an inner surface of the seal housing 1380 and an outer surface of the seal shaft 1378. The annulus 1388 is in fluid communication with a pump annulus 1376 which transports the returns 50*r* to the impeller section 1370 where energy is added to the returns 50*r*. The returns 50*r* exit the pump 1350*b* at an outlet 1362 and return to the surface 5 via the annulus 1325.

Figure 14:
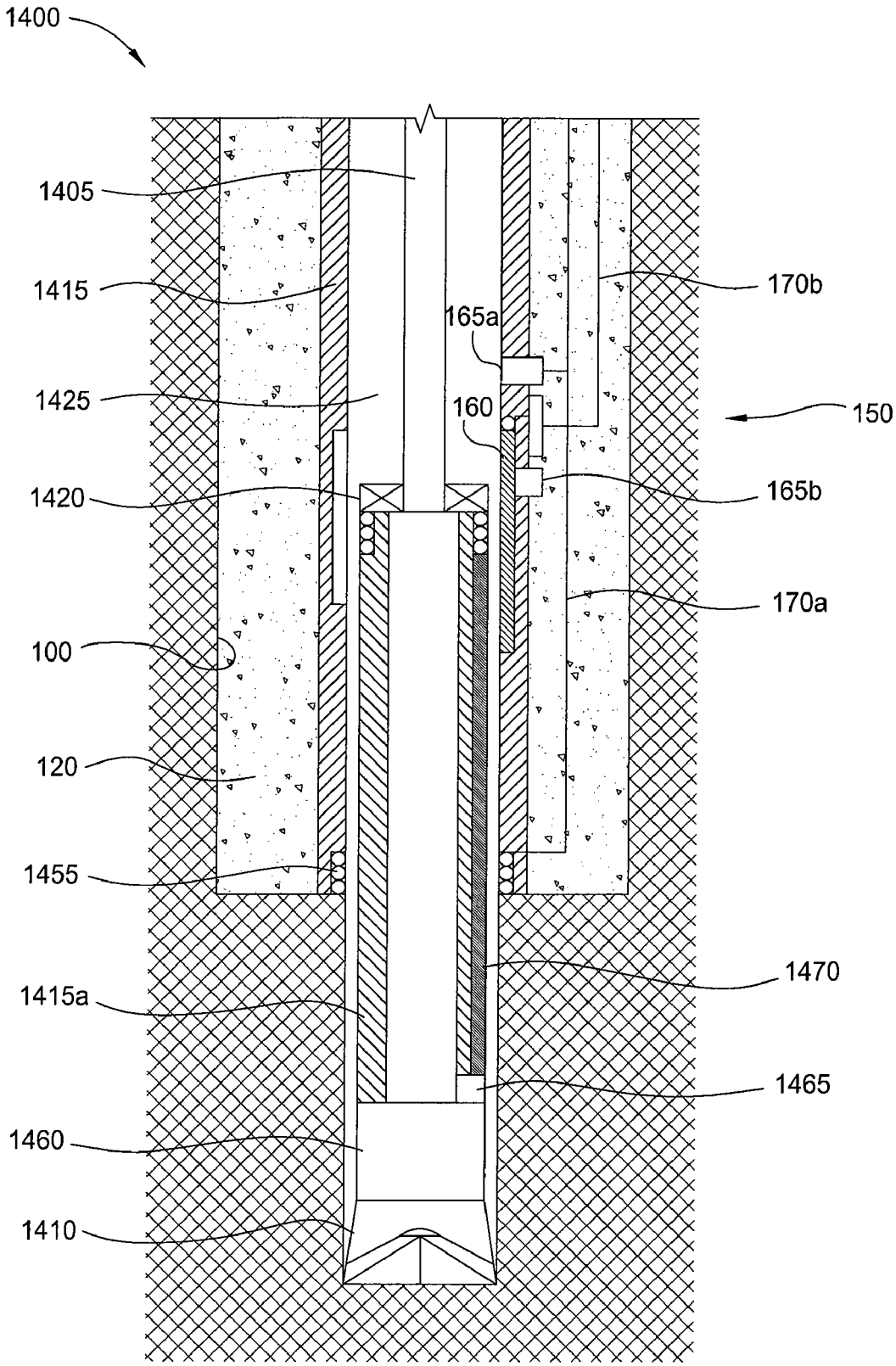
FIG. 14 is an alternate downhole configuration for use with surface equipment of any of the drilling systems of FIGS. 2, 2B, and 3-7, according to another embodiment of the present invention.

FIG. 14 is an alternate downhole configuration 1400 for use with surface equipment of any of the drilling systems 200, 250, 300-700 of FIGS. 2, 2B, and 3-7, according to another embodiment of the present invention. A casing string 1415 has been run-in and cemented 120 to the wellbore. The portion of the wellbore 100 for casing string 1415 may have been drilled with a conventional drill string 105. The casing string 1415 includes the DDV 150 and part of an inductive coupling 1455. The casing part of the inductive coupling 1455 is in data communication with the SMCU 65 via control line 170*a*.

A liner string 1415*a* may be being drilled into the wellbore using a run-in string 1405 (i.e., a drill string). The liner string 1415*a* may be rotationally and longitudinally coupled to the run-in string 1405 via crossover 1420. The crossover 1420 may also provide fluid communication between a bore of the run-in string 1405 and a bore of the liner 1415*a*. The crossover 1420 may also serve as an anchor (or anchor and packer) to hang the liner 1415*a* from the casing 1415 once drilling is completed. Alternatively, a separate anchor may be included. Whether the run-in string 1405 is required depends on whether a length of the liner string 1415*a* is longer than that of the casing string 1415 (plus any sea depth, if applicable).

A drill bit 1410 and mud motor 1460 are disposed on a longitudinal end of the liner string 1415*a*. The drill bit 1410 and mud motor 1460 may be drillable or may be latched to the liner string and removable (or one drillable and the other removable). A pressure (or PT) sensor 1465 is disposed near the longitudinal end of the liner string. The pressure sensor 1465 is in fluid communication with the annulus 1425 and a bore of the liner 1415*a*. The pressure sensor 1465 is in signal communication with part of the inductive coupling 1455 via control line 1470. The control line 1470 may be disposed in a groove formed in an outer surface of the liner similar to the wired casing 215*j* (or any alternatives discussed therewith). Although only one inductive coupling 1455 is shown, a second inductive coupling may be installed as discussed above in reference to FIG. 9 (or any other alternatives discussed therewith). Surface equipment for assembling segments of the wired liner 1415*a* while drilling is disclosed in U.S. Pub. No. 2004/0262013, which is incorporated by reference. The pressure sensor 1465 may have been in data communication with the SMCU 65 while segments were still being added to the liner string 1415*a*. Additionally, the run-in string 1405 may include a gap sub 825 (and another part of the inductive coupling) for transmitting a signal from the pressure sensor 1465 while drilling or the run-in string 1405 may be wired (if the run-in string 1405 is needed).

Once drilling is completed (i.e., the liner part of the inductive coupling 1455 is longitudinally aligned with the casing part of the inductive coupling 1455), the liner 1415*a* may be cemented in the wellbore 100. The mud motor 1460 and drill bit 1410 may be removed before cementing (if the latch is used). A cementing tool (not shown) may be included to facilitate the cementing operation. After injection of the cement, the run-in string 1405 may be removed. Drilling may be continued by drilling through the drill bit and/or mud motor (if the latch was not used). The pressure sensor 1465 will be in data/power communication with the SMCU 65 via the inductive coupling 1455. Alternatively, one or more concentric liners may be disposed in the liner 1415*a* and each have another drill bit connected thereto. In this alternative, the run-in string would be connected to the innermost concentric liner. A releasable connection, i.e. a shear pin, would hold the liners together. Once the outermost liner was drilled in, one of the shear pins would be broken and drilling would continue with the next inner liner. Each of the liners may include a pressure sensor and an inductive coupling. Alternatively, the casing string 1415 may have been drilled in (with the DDV 150 or with just a pressure sensor).

Figure 15:
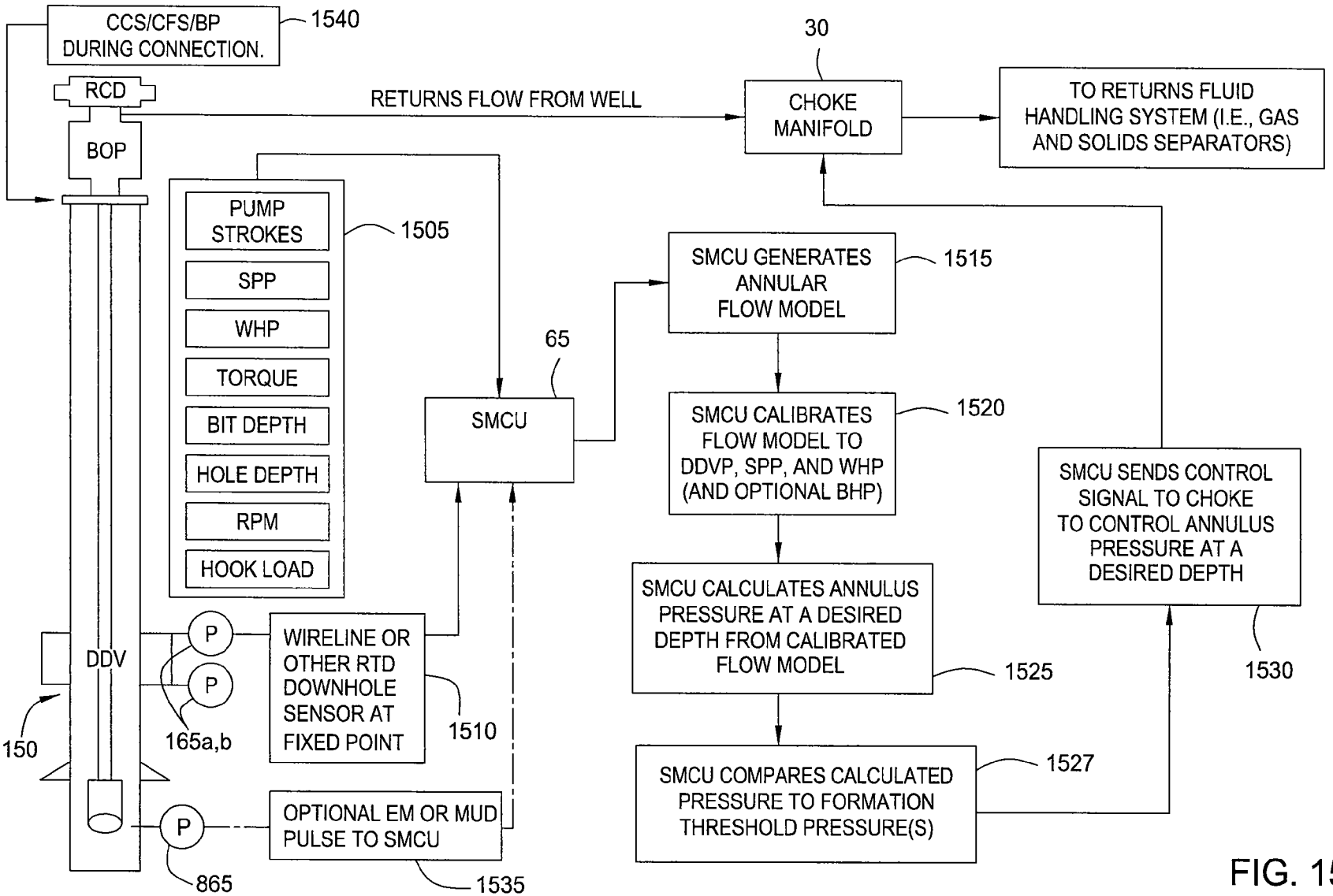
FIG. 15 is a flow diagram illustrating operation of the surface monitoring and control unit (SMCU), according to another embodiment of the present invention.

FIG. 15 is a flow diagram illustrating operation 1500 of the surface monitoring and control unit (SMCU) 65, according to another embodiment of the present invention. The SMCU operation 1500 may be for any of the drilling systems 200, 250, 300-1000, 1050, 1075, and 1100-1400. During act 505, the SMCU 65 inputs conventional drilling parameters, such as rig pump strokes (and/or stroke rate), stand pipe pressure (SPP) (from pressure sensor 25*b*), well head pressure (WHP) (from pressure sensor 25*a*), torque exerted by top drive 17 (or rotary table), bit depth and/or hole depth, the rotational velocity of the drill string 105, and the upward force that the rig works exert on the drill string 105 (hook load). The drilling parameters may also include mud density, drill string dimensions, and casing dimensions. Minimally, the SMCU 65 may input at least one of SPP and WHP and at least one of drilling fluid flow rate (rig pump rate) and returns flow rate (if a flow meter is used).

Simultaneously, during act 1510, the SMCU 65 inputs a pressure measurement from the DDV 150 sensor(s) 165*a,b* (may only be a pressure sensor, i.e. 465*a*). The communication between the SMCU 65 and the drilling parameters sources and the DDV sensors 165*a,b* is a high bandwidth (i.e., greater than or equal to one-thousand bits per second) connection. Depending on various factors, such as the type of data line used, channel widths, etc., bandwidths of ten-thousand, one-hundred thousand, one-million bits per second, or even higher, may be achieved. These high bandwidth connections support high or continuous sampling rates of data (i.e., greater than or equal to ten times per second). Depending on various factors, such as bandwidth, hardware speeds, etc., sampling rates of one-hundred, one-thousand times per second, or even higher may be achieved. Further, the data travels through the connection mediums at the speed of light so the data travel time is negligible. Therefore, the drilling parameters and the DDV pressure measurement are provided to the SMCU 65 in real time (RTD).

During act 1515, from at least some of the drilling parameters, the SMCU 65 may calculate an annulus flow model or pressure profile. During act 1520, the SMCU 65 may then calibrate the annulus flow model using at least one of (or at least two of or all of) the DDV pressure 1510, the stand pipe pressure 25*b*, and the well head pressure 25*a*. During act 1525, using the calibrated annulus flow model, the SMCU 65 determines an annulus pressure at a desired depth. Additionally, there may be two or more desired depths between the sensor depth and the BHD. As is discussed in further detail below, the desired depth may be a depth of a formation (or portion thereof) that may generate a kick if the pressure is not carefully controlled in a balanced or overbalanced drilling operation or the desired depth may be a depth of a formation (or portion thereof) that is susceptible to collapse if the pressure is not carefully controlled in an underbalanced drilling operation.

During act 1527, the SMCU 65 compares the calculated annulus pressure to one or more formation threshold pressures (i.e., pore pressure, stability pressure, fracture pressure, and/or leakoff pressure) to determine if a setting of the choke valve 30 needs to be adjusted. Alternatively, as discussed above, the SMCU 65 may instead alter the injection rate of drilling fluid 50*f* and/or alter the density of the drilling fluid 50*f*. Alternatively, SMCU 65 may determine if the calculated annulus pressure is within a window defined by two of the threshold pressures. The window may include a safety margin from each of the threshold pressures. If the choke 30 setting needs to be adjusted, during act 1530, the SMCU 65 determines a choke setting that maintains the calculated annulus pressure within a desired operating envelope or at a desired level (i.e., greater than or equal to) with respect to the one or more threshold pressures at the desired depth. The SMCU 65 then sends a control signal to the choke valve 30 to vary the choke so that the calculated annulus pressure is maintained according to the desired program. The acts 1505-1527 may be iterated continuously (i.e., in real time). This is advantageous in that sudden formation changes or events (i.e., a kick) can be immediately detected and compensated for (i.e., by increasing the backpressure exerted on the annulus by the choke 30).

The SMCU 65 may also input a BHP (i.e., from sensor 825) during act 1535. Since this measurement is transmitted to the SMCU 65 using EM or mud-pulse telemetry, the measurement is not available in real time. This is a consequence of the low bandwidth of both EM and mud pulse systems. Further, as discussed above, travel time of the mud-pulse signal becomes significant for deeper wells. The sampling rate of the BHP signal is thus limited. However, the BHP measurement may still be valuable especially as the distance between the DDV 150 and the BHD becomes significant. Since the desired depth will be below the DDV 150, the SMCU 65 extrapolates the calibrated flow model to calculate the desired depth. Regularly calibrating the annular flow model with the BHP will thus improve the accuracy of the annulus flow model notwithstanding the slow sampling rate. Alternatively, if the drill string 105 is a coiled tubing string (with embedded conductors) or wired drill pipe, then a high bandwidth connection may be established for the BHP measurement.

Alternatively, act 1505 may be performed by a separate rig data acquisition system (not shown) which may be in communication with the SMCU 65. Alternatively, or in addition to the first alternative, acts 1515 and/or 1520 may be performed by an engineer having a separate computer (i.e., a laptop) who may then manually enter or upload the necessary parameters from the annulus flow model (and/or calibrated flow model) to the SMCU 65. The engineer's computer may be in communication with the SMCU 65 and/or rig data acquisition system for downloading the necessary data to generate and/or calibrate the annulus flow model. Alternatively, or in addition to the first and second alternatives, acts 1525, 1527, and/or 1530 may be performed manually.

During act 1540, adding or removing drill string segments, the SMCU 65 also maintains the calculated annulus pressure greater than or equal to the formation threshold pressure at the desired depth by i.e., actuating the three-way valve 70, operating the CCS 350*a* or CFS 350*b*, or operating the accumulator 480.

Figure 16:
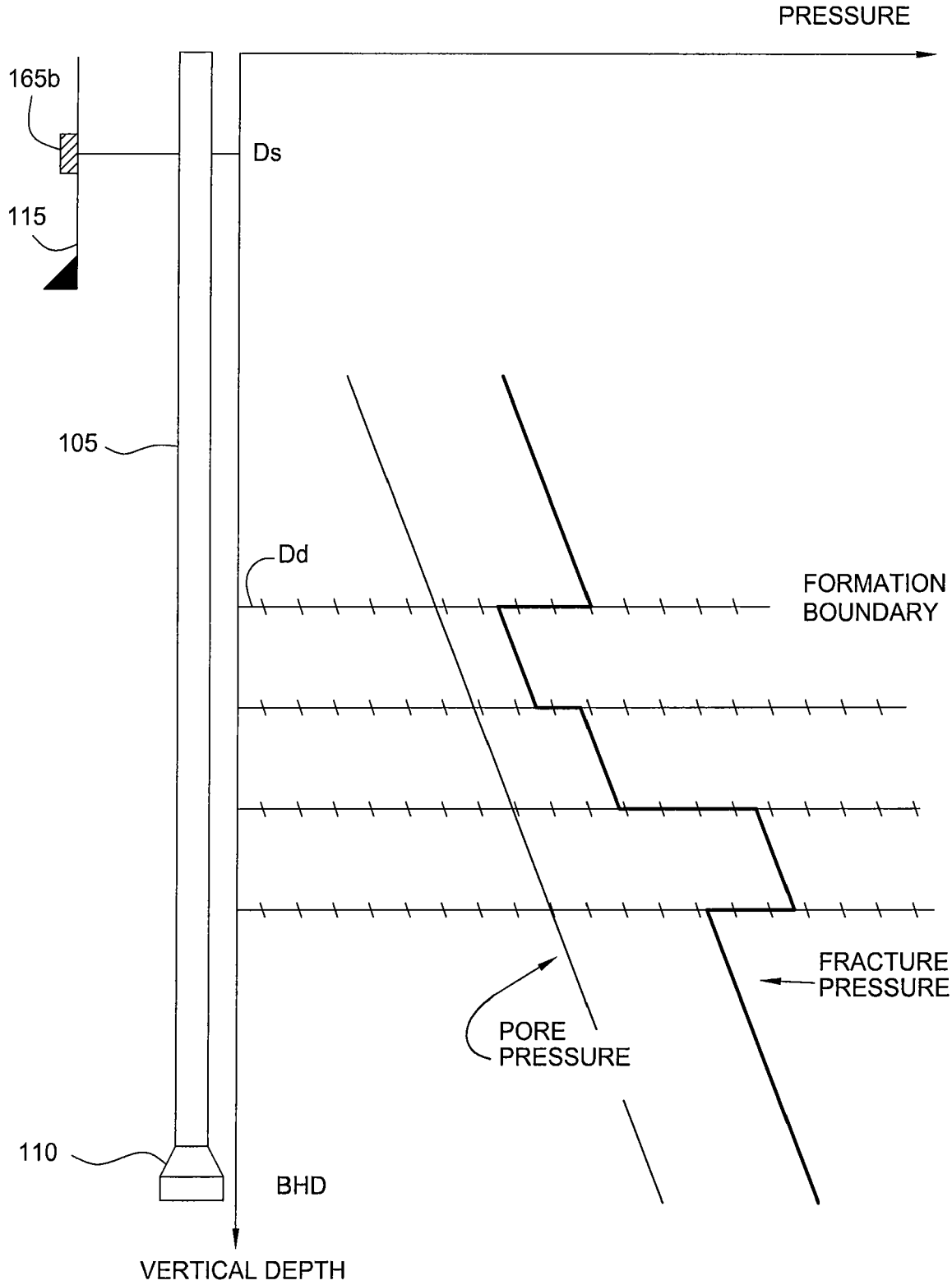
FIG. 16 is a wellbore pressure profile illustrating a desired depth of FIG. 15.

FIG. 16 is a wellbore pressure profile illustrating a desired depth of FIG. 15. The pressure sensor 165*b* is shown disposed in the casing string 115 at a depth Ds. Formation changes have caused discontinuities in the fracture pressure profile. The desired depth Dd is the depth where the fracture pressure is at a minimum and is closest to the pore pressure, thereby leaving a narrow drilling window. During a balanced/overbalanced drilling operation, it would be advantageous to maintain the annulus pressure in the narrow drilling window (the annulus pressure at the desired depth Dd is greater than or equal to the pore pressure at the desired depth and less than or equal to the fracture pressure at the desired depth Dd) for reasons discussed above. During act 1525, the SMCU 65 would calculate the annulus pressure at the desired depth Dd even when the BHD is considerably deeper than the desired depth Dd. Additionally, the SMCU 65 may monitor both the pressure at the desired depth Dd and the BHP and control the choke 30 such that the annulus pressure at the desired depth Dd is in the narrow window while maintaining the BHP in the window at the BHD. Additionally, there may be two or more desired depths between the sensor depth and the BHD. As shown, the fracture pressure profile has become irregular due to changing formations. Alternatively or in addition to, the pore pressure profile (or any of the other threshold pressures) may be become irregular because of formation changes.

Figure 17:
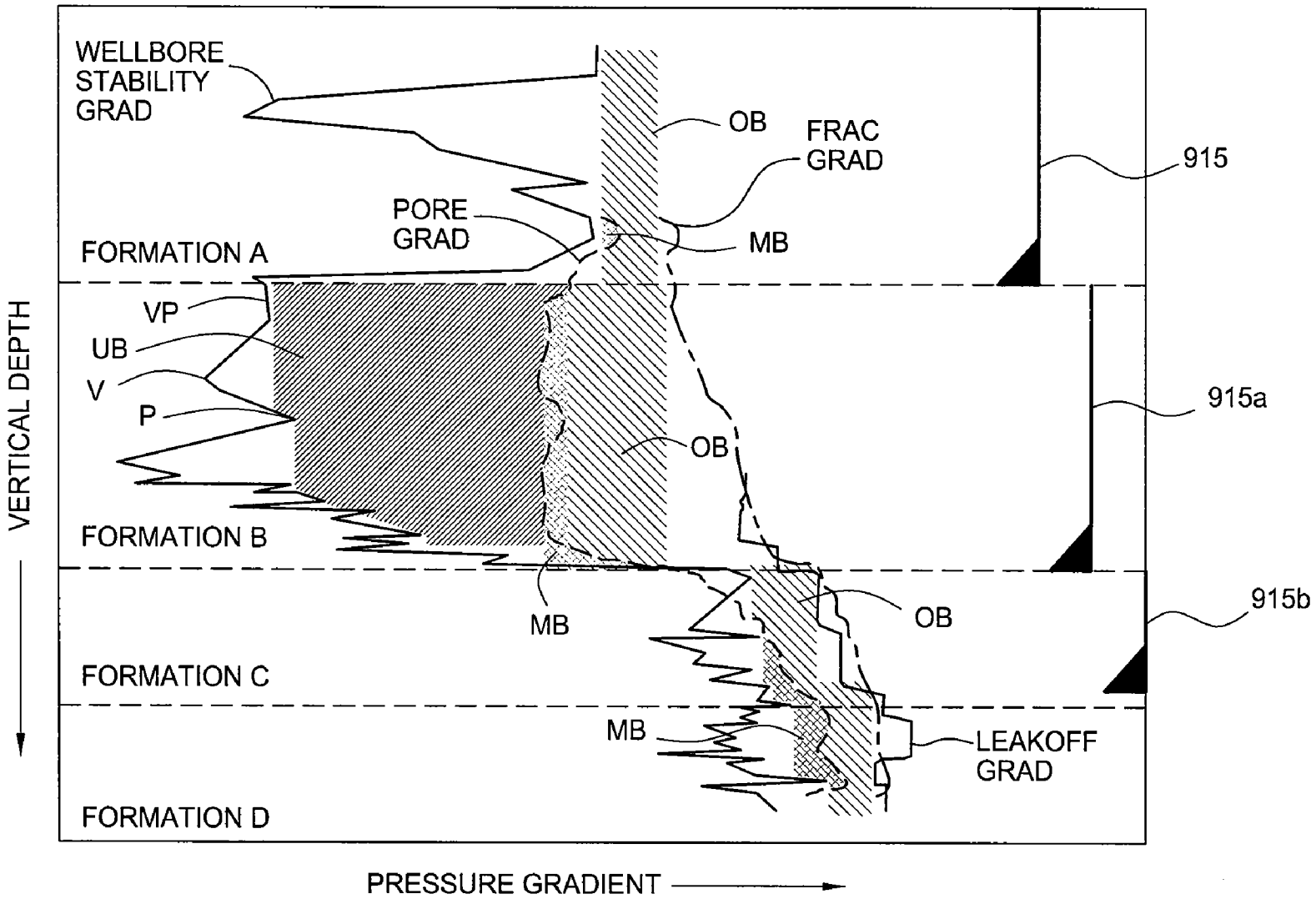
FIG. 17 is a wellbore pressure gradient profile illustrating drilling windows.

FIG. 17 is a wellbore pressure gradient profile illustrating an example drilling window (shaded) that is available using the drilling systems 200, 250, 200, 250, 300-1000, 1050, 1075, and 1100-1400. As with FIGS. 1B and 10B, this is a pressure gradient graph so vertical lines denote a linear increase of pressure with depth. The casing 915 is set at a boundary line of formation A. A first liner 915*a* is set at a boundary line of Formation B. A second liner 915*b* is set at a boundary line of Formation C. The casing 915 and the liners 915*a,b* may be configured as shown in FIG. 9, each having pressure sensors and inductive couplings. Alternatively, only the casing 915 may have a DDV or pressure sensor. Alternatively, the liners 915*a,b* may each be strings of casing extending to the surface 5, each having a DDV or pressure sensor. Alternatively, one of the liners 915*a,b* may be a string of casing and one of the liners may be a liner, each having a DDV or pressure sensor. Alternatively, tie back casing strings, each having a DDV or pressure sensor, may be used with the liners (see FIGS. 11A and 11B).

The drilling window is bounded on one side by a wellbore stability gradient and on the other side by the lesser of a fracture gradient and a leakoff gradient (when present). The drilling window includes three sub-window portions: an underbalanced portion UB, a mixed underbalanced and overbalanced portion MB, and an overbalanced portion OB. Each of the sub-portions are defined by peaks and valleys of respective boundary lines. For example, during drilling of Formation B, a noticeable valley V and peak P occur in the stability gradient bounding the UB sub-window. After setting the casing string 915, thereby isolating Formation A, the minimum UB sub-window is determined first by a fairly vertical portion VP of the stability gradient. The gradient then declines into the Valley V. However, the drilling window is not bounded by the valley V because doing so would cause the annulus pressure above the valley to decrease below the vertical portion VP, thereby risking cave-in of the wellbore. Similarly, when the peak P is encountered, it becomes a boundary for drilling at depths below the peak until a greater peak is encountered. Similar principles apply to the other boundary lines.

The drilling systems 200, 250, 200, 250, 300-1000, 1050, 1075, and 1100-1400 may be used to drill each section of the wellbore 100 in any of the available sub-windows. For example, Formation A may be drilled both in the OB and MB sub-windows. Formation B may be drilled entirely in the UB, MB, or OB sub-windows or may alternate between the three. There are advantages and disadvantages to drilling in each sub-window and these may vary for each particular wellbore 100. A software modeling package may be used to evaluate the risks and benefits of drilling a particular wellbore in a particular sub-window. These software packages will also provide economic models for each particular mode of drilling, thereby enabling engineers to make informed decisions as to which particular sub-window or combination thereof may be most beneficial.

The real time data capabilities of the drilling systems 200, 250, 200, 250, 300-1000, 1050, 1075, and 1100-1400 enable better control, thereby enabling an operator to stay at least within the drilling window, preferably a selected sub-window, especially when the windows become very narrow, for example during drilling of Formations C and D. Alternatively, a formation may be drilled outside of the windows, i.e., the BHP is maintained above the leakoff pressure and/or fracture pressure. This alternative may be desirable when drilling through hazardous formations (i.e., hydrogen sulfide) to ensure that the formation does not kick.

Figure 1A:
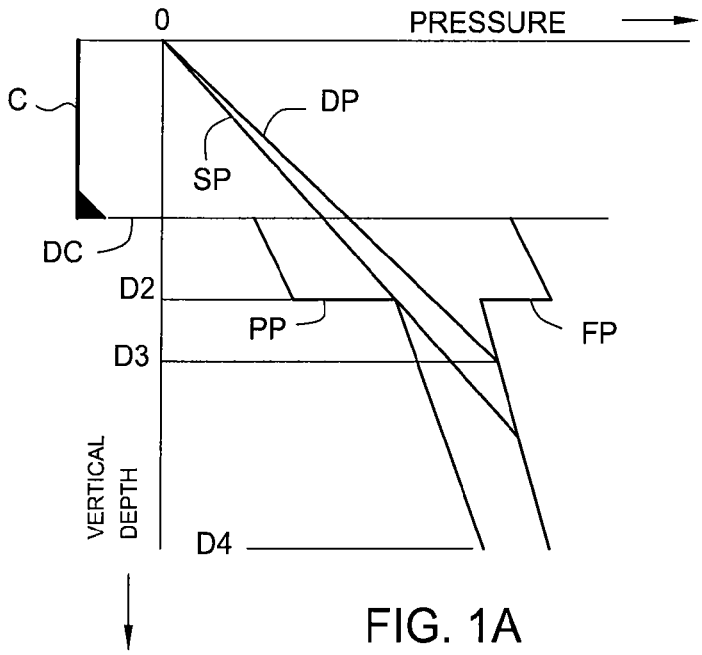
FIG. 1A (PRIOR ART)
FIG. 1A is a graphical representation of a pressure vs. depth profile for a well.

FIG. 18A is a pressure profile, similar to FIG. 1A, showing advantages of one drilling mode that may be performed by any of the drilling systems 200, 250, 200, 250, 300-1000, 1050, 1075, and 1100-1400. As compared to FIG. 1A, a lighter drilling fluid may be used. The annulus pressure may be maintained in the drilling window by application of back-pressure (CP), for example using choke valve 30 of drilling system 200. During adding or removing segments to or from the drill string, the annulus pressure may be maintained, for example, by using the three-way valve 70 and the choke 30 (SP+CP). Similar results may be obtained by using the accumulator 480 or the CCS/CFS system 350*a, b*. Using the lighter drilling fluid allows the target depth D4 to be reached without setting an intermediate string of casing.

Figure 1B:
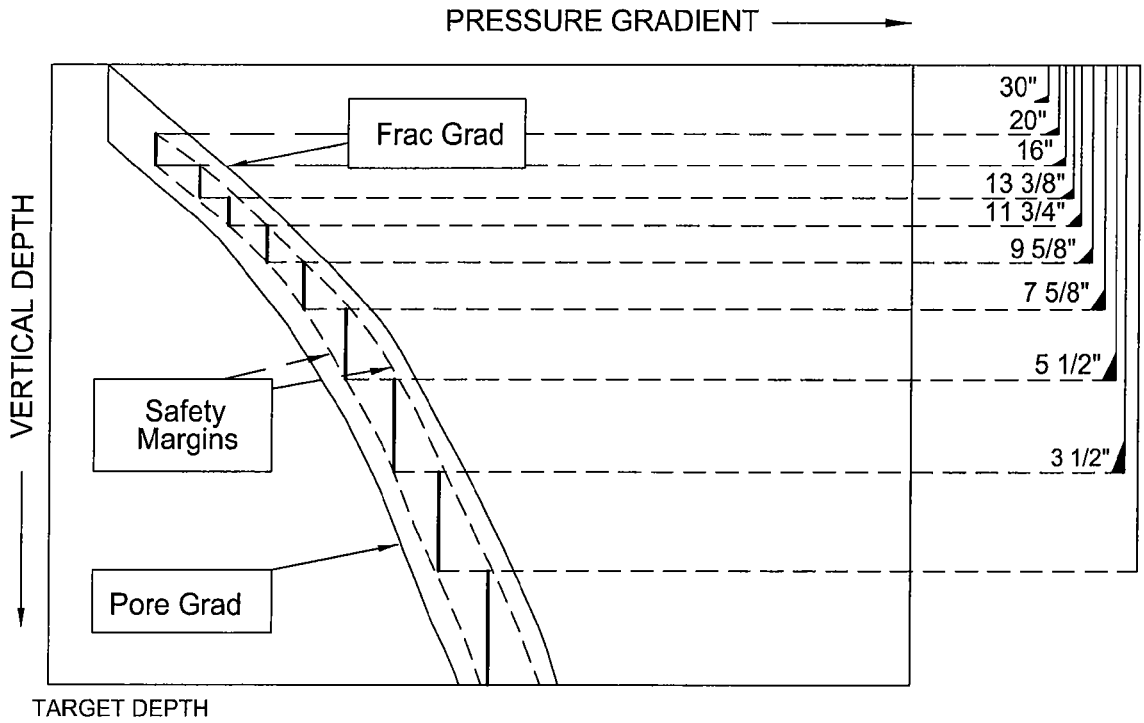
FIG. 1B (PRIOR ART)
FIG. 1B illustrates a prior art casing program for drilling a narrow-margin wellbore.

FIG. 18B is a casing program, similar to FIG. 1B, showing advantages of one drilling mode that may be performed by any of the drilling systems 200, 250, 200, 250, 300-1000, 1050, 1075, and 1100-1400. Since the static pressure SP and dynamic pressure DP of a particular drilling fluid can be equalized and the annulus pressure monitored and controlled in real time, the safety margins may be reduced, thereby greatly reducing the required number of casing strings. As shown, the target depth is achieved with a seven and five-eigths inch casing string which allows the well to be completed with an adequately sized production tubing string. Further, significant cost savings are realized by having to set fewer differently sized casing strings.

Figure 19:
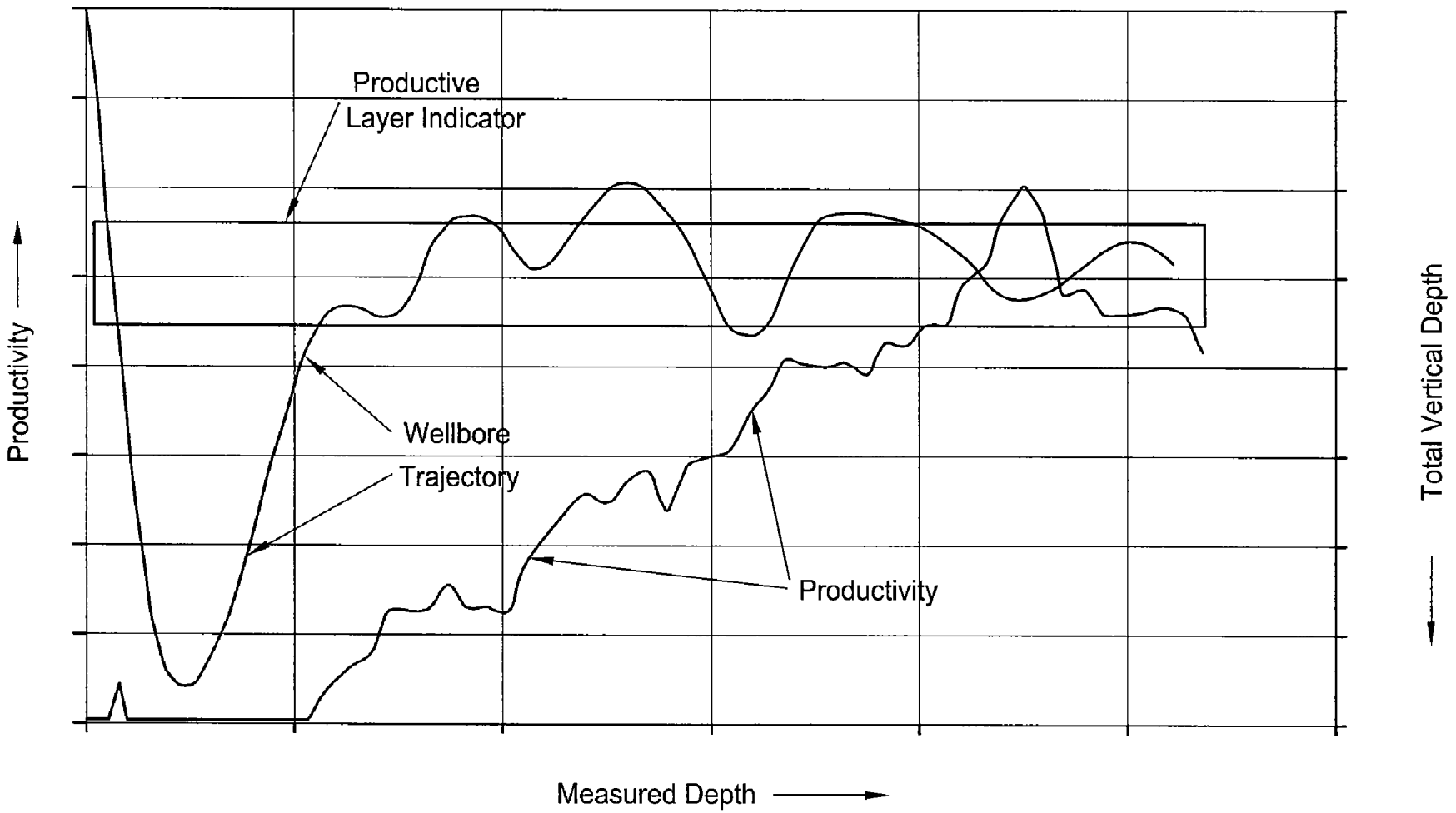
FIG. 19 illustrates a productivity graph that may be calculated and generated by the SMCU during underbalanced drilling, according to another embodiment of the present invention.

FIG. 19 illustrates a productivity graph that may be calculated and generated by the SMCU 65 during underbalanced drilling, according to another embodiment of the present invention. The graph includes a productivity curve plotted as a function of productivity (left vertical axis) against measured depth (horizontal axis). The graph may further include a wellbore trajectory curve plotted as a function of total vertical depth (right vertical axis) against measured depth. The productivity value may be calculated by the SMCU 65 using a flow rate of a formation being drilled through measured by the surface MPM 610*a* and/or the downhole MPM 1275, a pore or shut-in pressure of the formation which may be calculated using pre-existing data and/or data obtained from the LWD sonde 1395 or measured with a transient pressure test, and the BHP calculated using the annulus pressure profile and/or the BHP sensor 865. The productivity calculation allows for pseudo-quantitative and pseudo-qualitative characterization of a reservoir while underbalanced drilling. Once the productivity curve is generated over the length of the formation, the shape of the productivity curve can be compared to known shapes to determine the formation type (i.e., matrix, fracture, vulgar, channel sand, non-productive, or compartmental). The productivity curve illustrated is of the matrix type.

It can be observed the wellbore trajectory curve intersects a productive layer as identified by the productivity curve. The productivity curve may be used to geo-steer during directional (i.e., horizontal) drilling to maximize well productivity while minimizing the length of the wellbore, thereby increasing net present value. Formation factors, such as dip angle, porosity and an approximation of relative in-situ permeability may also be determined. The productivity graph may also identify sub-optimal drilling operational events that may cause undesirable formation impairment. Further, the productivity graph may be used to identify narrow formations that may otherwise have been overlooked using conventional methods.

Figure 20:
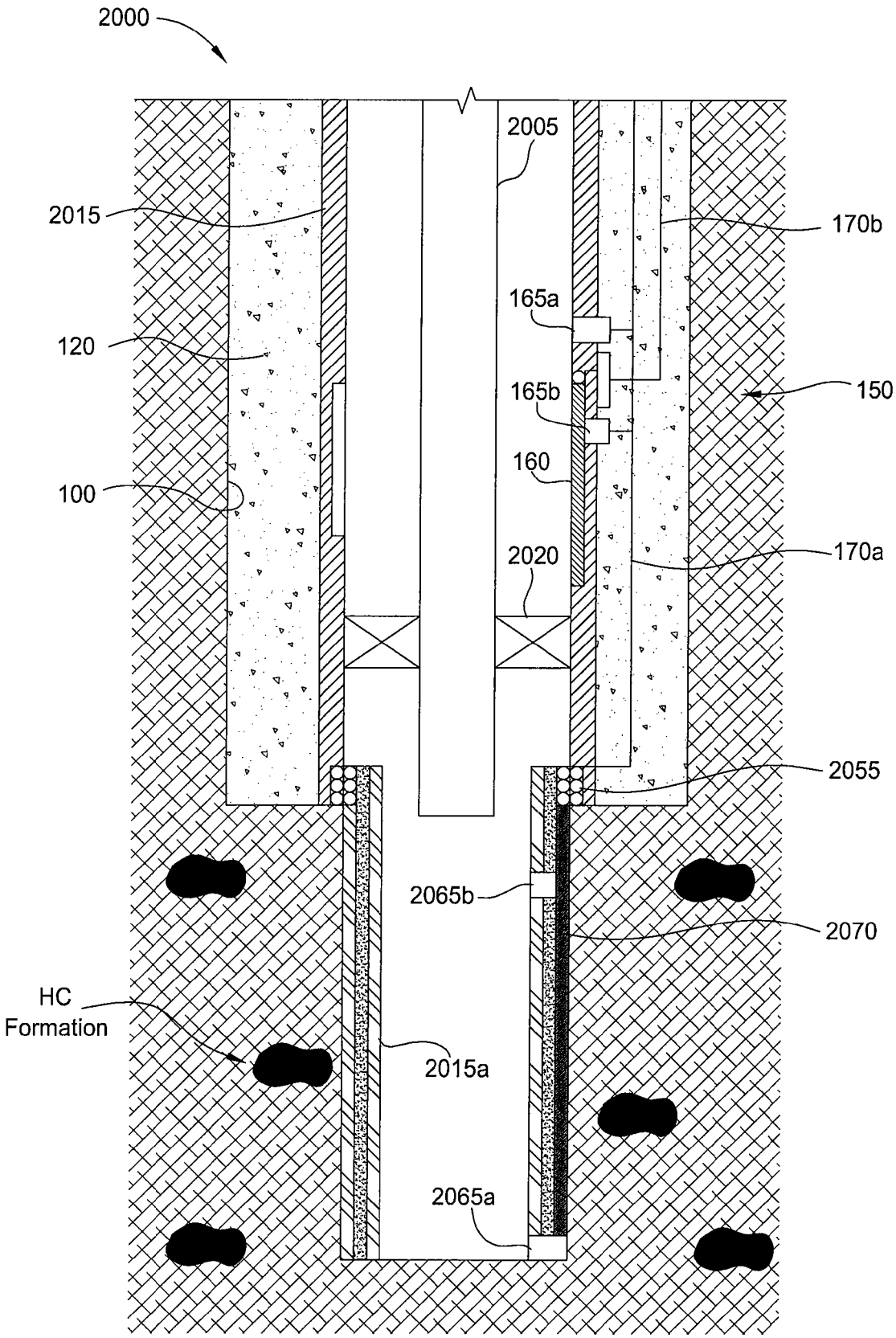
FIG. 20 illustrates a completion system compatible with any of the drilling systems of FIGS. 2, 2B, and 3-9, 10A, 10B, 10H, 11A, 11B, and 12-14, according to another embodiment of the present invention.

FIG. 20 illustrates a completion system 2000, according to another embodiment of the present invention. The completion system 2000 may be installed in wellbores 100 drilled with any of the drilling systems 200, 250, 300-1000, 1050, 1075, and 1100-1400. The wellbore has been drilled through a hydrocarbon-bearing formation (HC Formation). If the formation has been drilled underbalanced, then the completion system 2000 may also be installed underbalanced (without killing the formation). Part of an inductive coupling 2055 has been installed on the last casing string 2015. Alternatively, the casing string 2015 may be a liner string. Although only one inductive coupling 2055 is shown, a second inductive coupling may be installed as discussed above in reference to FIG. 9 (or any other alternatives discussed therewith). The casing string 2015 also includes the DDV 150. As discussed above, the DDV allows the RCD 15 to be removed when running-in equipment that will not fit through the RCD 15, i.e., expandable liner 2015*a* and an expansion tool (not shown).

The expandable liner 2015*a* has been run-in to a portion of the wellbore 100 extending through the HC Formation and expanded into engagement with the wellbore 100 using an expansion tool (not shown) carried by the run-in string. The expansion tool may be a radial expansion tool having fluid actuated rollers or a cone that is simply pushed/pulled through the liner. The expandable liner 2015*a* includes one or more pressure (or PT) sensors 2065*a, b* in fluid communication with a bore thereof. A control line 2070 disposed in a wall of the expandable liner 2015*a* provides data communication between the pressure sensors 2065*a, b* and part of the inductive coupling 2055. Alternatively, the control line 2070 may be disposed along an outer surface of the expandable liner 2015*a*. The control line 2070 may also provide power to the pressure sensors 2065*a, b*. The formation portion of the wellbore 100 may have been underreamed, such as with a bi-center or expandable bit, resulting in a diameter near an inside diameter of the casing string 2015. The expandable liner 1135*a* may be constructed from one or more layers (three as shown). The three layers include a slotted structural base pipe, a layer of filter media, and an outer protecting sheath, or "shroud". Both the base pipe and the outer shroud are configured to permit hydrocarbons to flow through perforations formed therein. The filter material is held between the base pipe 1140*a* and the outer shroud, and serves to filter sand and other particulates from entering the liner 2015*a* and a production tubular. Although a vertical completion is shown, the completion system 2000 may also be installed in a lateral wellbore.

Alternatively, a conventional solid liner (not shown, see FIG. 9) may be run-in and cemented to the HC Formation and then perforated to provide fluid communication. Alternatively, a perforated liner (and/or sandscreen) and gravel pack may be installed or the HC Formation may be left exposed (a.k.a. barefoot). Alternatively or additionally, a removable or drillable bridge plug may be set in the casing 2015 to isolate the HC Formation for running the expandable liner 915*a*. The liner run-in string may then include a retrieval tool or bit and the plug may be disengaged or drilled through to expose the HC formation. The retrieval tool and plug or bit would then be left at the bottom of the wellbore 100.

A packer 2020 has been run-in into the wellbore 100 and actuated into an engagement with an inner surface of the casing 2015. The packer 2020 may include a removable plug in the tailpipe so the HC Formation is isolated while running-in a string of production tubing 2005. The string of production tubing 2005 may then be run-in to the wellbore 100, hung from the wellhead 10, and engaged with the packer 2020 so that a longitudinal end of the production tubing 2005 is in fluid communication with the liner bore. Alternatively, the packer 2020 and the production tubing 2005 may be run-in to the wellbore during the same trip. Hydrocarbons produced from the formation enter a bore of the liner 2015*a*, travel through the liner bore and enter a bore of the production tubing 2005 for transport to the surface.

In another embodiment (not shown), a solid (non-perforated) expandable liner and a radial expansion tool may be carried by a drill string in case problem formation (i.e., a non-hydrocarbon water or salt-water bearing formation or a formation with a low leak-off or fracture pressure) is encountered while drilling. To isolate the problem formation, the liner and expansion tool may be aligned with the formation boundary and the radial expansion tool may be activated, thereby expanding a portion of the liner into engagement with the formation. The drill string and expansion tool may then be advanced/retracted (even while drilling) to expand the rest of the liner into engagement with the problem formation. The problem formation is then isolated from contamination into or production from during the drilling operation and subsequent production from other formations without requiring a separate trip. This embodiment may be compatible with any of the drilling systems 200, 250, 300-1000, 1050, 1075, and 1100-1400.

In another embodiment, a method for drilling a wellbore includes an act of drilling the wellbore by injecting drilling fluid through a tubular string disposed in the wellbore, the tubular string comprising a drill bit disposed on a bottom thereof. The drilling fluid exits the drill bit and carries cuttings from the drill bit. The drilling fluid and cuttings (returns) flow to a surface of the wellbore via an annulus defined by an outer surface of the tubular string and an inner surface of the wellbore. The method further includes an act performed while drilling the wellbore of measuring a first annulus pressure (FAP) using a pressure sensor attached to a casing string hung from a wellhead of the wellbore. The method further includes an act performed while drilling the wellbore of controlling a second annulus pressure (SAP) exerted on a formation exposed to the annulus. In one aspect of the embodiment, the pressure sensor is at or near a bottom of the casing string.

In another aspect of the embodiment, the method further includes transmitting the FAP measurement to a surface of the wellbore using a high-bandwidth medium. The pressure sensor may be in communication with a surface monitoring and control unit (SMCU) via a cable disposed along an outer surface of the casing string or within a wall of the casing string. The antenna may be attached to the casing string. The drill string may include a second pressure sensor at or near a bottom thereof configured to measure a bottom hole pressure (BHP) and a gap sub in communication with the second pressure sensor. The method may further include transmitting a BHP measurement from the drill string gap sub to the casing string antenna and relaying the BHP measurement to the surface via the cable. A liner string may be hung from the casing string at or near a bottom of the casing string. The liner string may have a second pressure sensor configured to measure a third annulus pressure (TAP). Each of the casing string and the liner may have part of an inductive coupling. The method may further include measuring the TAP with the liner sensor; transmitting the TAP measurement from the liner to the casing string via the inductive coupling; and relaying the TAP measurement to the SMCU via the cable.

In another aspect of the embodiment, the method may further include calculating the SAP using the FAP measurement. The FAP may be continuously measured and the SAP may be continuously calculated. The SAP may be calculated using at least one of a standpipe pressure and a wellhead pressure and at least one of a flow rate of drilling fluid injected into the tubular string and a flow rate of the returns. The method may further include, while drilling, measuring a bottom hole pressure (BHP); and wirelessly transmitting the BHP measurement to the casing string or to the surface of the wellbore. The tubular string may further include a pressure sensor disposed at or near a bottom thereof and a second pressure sensor longitudinally spaced at a distance from the pressure sensor.

In another aspect of the embodiment, the measuring and controlling acts are performed by a computer or microprocessor controller. In another aspect of the embodiment, the SAP is controlled by choking fluid flow of the returns. In another aspect of the embodiment, the returns enter a separator and the SAP is controlled by choking gas flow from the separator. In another aspect of the embodiment, the SAP is controlled by controlling an injection rate of the drilling fluid.

In another aspect of the embodiment, the drilling fluid is a mixture formed by mixing a liquid portion and a gas portion and the SAP is controlled by controlling a flow rate of the gas portion. The drilling fluid may be injected into the tubular string using a multiphase pump. In another aspect of the embodiment, the method further includes measuring a flow rate of a liquid portion of the returns and a flow rate of a gas portion of the returns using a multiphase meter (MPM). The MPM may be disposed in the wellbore. In another aspect of the embodiment, the method further includes calculating a productivity of a formation while drilling through the formation. The tubular string may be a drill string and the method further may further include geo-steering the drill string using the calculated productivity.

In another aspect of the embodiment, the method further includes measuring an injection rate of the drilling fluid; and comparing the injection rate to a flow rate of the returns. The tubular string may be a drill string. The drilling fluid may be injected into a first chamber of the drill string. The SAP may be controlled by injecting a fluid having a density different from a density of the drilling fluid through a second chamber of the drill string. In another aspect of the embodiment, the method further includes separating gas from the returns using a high-pressure separator and separating the cuttings from the returns using a low pressure separator. The SAP may be controlled so that the SAP is less than a pore pressure of the formation and the method further comprises recovering crude oil produced from the formation from the returns.

In another aspect of the embodiment, the tubular string is a drill string including joints of drill pipe joined by threaded connections. The method may further include adding or removing a joint of drill pipe to the drill string; and controlling the SAP while adding or removing the joint to/from the drill string. The SAP may be controlled while adding or removing the joint by pressurizing the annulus. The annulus may be pressurized by circulating fluid through a choke. The wellbore may be a subsea wellbore. A riser string may extend from a rig at a surface of the sea to or near a floor of the sea. The riser string may be in selective fluid communication with the wellbore. A bypass line may extend from a platform at a surface of the sea to or near a floor of the sea. The bypass line may be in selective fluid communication with the wellbore. The SAP may be controlled while adding or removing the joint by injecting a second fluid into the bypass line.

The SAP may be controlled while adding or removing the joint using a continuous circulation system or a continuous flow sub disposed in the drill string. The continuous circulation system may include a housing having upper and lower chambers, a gate valve operable to selectively isolate the upper chamber from the lower chamber, an upper control head operable to engage a joint to be added or removed to the drill string, and a lower control head operable to engage the drill string. The continuous flow sub may include a housing having a longitudinal bore disposed therethrough and a side port disposed through a wall thereof, a first valve operable to isolate an upper portion of the bore from a lower portion of the bore in response to drilling fluid being injected through the side port, a second valve operable to isolate the side port from the bore in response to drilling fluid being injected through the bore. The method may further include charging an accumulator while drilling. The SAP may be controlled while adding or removing the joint by pressurizing the annulus with the accumulator. The returns may enter a separator and the SAP may be controlled while adding or removing the joint by pressurizing the separator.

In another aspect of the embodiment, the SAP is controlled so that the SAP is greater than or equal to a pore pressure of the formation. In another aspect of the embodiment, the SAP is controlled so that the SAP is greater than or equal to a wellbore stability pressure (WSP) of the formation. In another aspect of the embodiment, the SAP is controlled to be within a window defined by a first threshold pressure of the formation, with or without a safety margin therefrom, and a second threshold pressure of the formation, with or without a safety margin therefrom. In another aspect of the embodiment, the SAP is a bottom hole pressure. In another aspect of the embodiment, a depth of the SAP is distal from a bottom of the wellbore. The method may further include, while drilling, calculating the SAP using the FAP; and calculating a bottom hole pressure (BHP) using the FAP.

In another aspect of the embodiment, the casing string is a tie-back casing string. The second casing string may be disposed in the wellbore. A tie-back annulus may be defined between the tie-back casing string and the second string of casing. The SAP may be controlled by injecting a second fluid having a density different from a density of the drilling fluid through the tie-back annulus. A second casing string may be disposed in the wellbore. A tie-back annulus may be defined between the tie-back casing string and the second string of casing. A mudcap may be maintained in a bore of the tie-back casing string or in the tie-back annulus, the mudcap being a fluid having a density substantially greater than a density of the drilling fluid. A plurality of pressure sensors (TBPS) may be disposed along a length of the tie-back casing string. The method may further include monitoring a level of an interface between the mudcap and the returns using the TBPS.

In another aspect of the embodiment, the casing string is cemented to the wellbore. In another aspect of the embodiment, a downhole deployment valve (DDV) is assembled as part of the casing string proximate to the sensor. The DDV may include a housing having a longitudinal bore therethrough in fluid communication with a bore of the casing string, a flapper or ball operable to isolate an upper portion of the casing string bore from a lower portion of the casing string bore, the pressure sensor in communication with the lower portion of the casing string bore, and a second pressure sensor in communication with the upper portion of the casing string bore. The casing string may be a tie-back casing string. A second casing string may be disposed in the wellbore and cemented thereto. A liner may be hung from the second casing string at or near a bottom of the second casing string. The method may further include removing the tie-back casing string from the wellbore, attaching a second liner to the first liner at or near a bottom of the first liner, cementing the second liner to the wellbore, inserting a second tie-back casing string, having a second DDV assembled as a part thereof and a second pressure sensor attached thereto proximate the second DDV, into the wellbore, and forming a seal between the second liner and the second tie-back casing string.

In another aspect of the embodiment, the tubular string is a drill string further including an equivalent circulation density reduction tool (ECDRT). The ECDRT may include a motor, a pump, and an annular seal. The drilling fluid may operate the motor. The annular seal may be engaged with the casing string and may divert the returns from the annulus and through the pump. The pump may be rotationally coupled to the motor, thereby being operated by the motor. The pump may add energy to the returns, thereby reducing an equivalent circulation density (ECD) of the returns. A second pressure sensor may be attached along the casing string so that the pressure sensor is in fluid communication with an inlet of the pump and the second pressure sensor is in fluid communication with an outlet of the pump. The method may further include measuring a third annulus pressure (TAP) using the second pressure sensor while drilling the wellbore. The method may further include monitoring operation of the ECDRT using the FAP and the TAP. The SAP may be controlled by controlling an operating parameter of the ECDRT. The ECDRT operating parameter may be an injection rate of the drilling fluid.

In another aspect of the embodiment, the tubular string is a drill string, the drill string further comprises a logging while drilling (LWD) sonde, and the method further includes determining lithology, permeability, porosity, water content, oil content, and gas content of a formation while drilling through the formation. In another aspect of the embodiment, the tubular string may include a second casing string or liner string and the method further includes hanging the second casing string or liner string from the wellhead or the casing string. The casing string may be cemented to the wellbore and may include a pressure sensor and a first part of an inductive coupling. The second casing string or liner string may further include a mud motor coupled to the drill bit, a pressure sensor attached near the bottom thereof, a cable disposed within a wall of the tubular string, the cable in communication with the pressure sensor and a second part of an inductive coupling disposed at or near a top of the tubular string. The second casing string or liner string may be hung from the casing string when the second part of the inductive coupling is in longitudinal alignment or near alignment with the first part of the inductive coupling.

In another aspect of the embodiment, a density of the drilling fluid is less than that required to maintain the formation in a balanced or an overbalanced state, and the SAP is controlled to maintain the formation in the balanced or overbalanced state. In another aspect of the embodiment, the method further includes running a sand screen into the formation; and expanding the sand screen into engagement with the formation. The casing string may be cemented to the wellbore and may include a pressure sensor and a first part of an inductive coupling. The sand screen may further include a pressure sensor, and a cable disposed along an outer surface of the liner string or within a wall of the liner string, the cable in communication with the pressure sensor and a second part of an inductive coupling disposed at or near a top of the sand screen. The sand screen may be expanded when the second part of the inductive coupling is in longitudinal alignment or near alignment with the first part of the inductive coupling.

In another aspect of the embodiment, the tubular string is a drill string and the drill string further includes a length of expandable liner and a radial expansion tool. The method may further include aligning the expandable liner with a problem formation, and expanding the liner into engagement with the problem formation, thereby isolating the problem formation.

In another embodiment, a method for drilling a wellbore includes an act of drilling the wellbore by injecting drilling fluid into a tubular string comprising a drill bit disposed on a bottom thereof. The drilling fluid is injected at a drilling rig. The method further includes an act performed while drilling the wellbore and at the drilling rig of continuously receiving a first annulus pressure (FAP) measurement measured at a location distal from the drilling rig and distal from a bottom of the wellbore. The method further includes an act performed while drilling the wellbore and at the drilling rig of continuously calculating a second annulus pressure (SAP) exerted on an exposed portion of the wellbore. The method further includes an act performed while drilling the wellbore and at the drilling rig of controlling the SAP.

In one aspect of the embodiment, the method further includes, while drilling the wellbore and at the drilling rig, intermittently receiving a bottom hole pressure (BHP) measured at a location near a bottom of the wellbore; and intermittently calibrating the calculated SAP using the BHP measurement. In another aspect of the embodiment, the wellbore may be a subsea wellbore. A riser string may extend from the rig at a surface of the sea to a wellhead of the wellbore at a floor of the sea. The riser string may be in fluid communication with the wellbore. The FAP may be measured using a pressure sensor attached to the riser string or the wellhead.

While the foregoing is directed to embodiments of the present invention, other and further embodiments of the invention may be devised without departing from the basic scope thereof, and the scope thereof is determined by the claims that follow.

The invention claimed is:

1. A method for drilling a wellbore, comprising acts of:

drilling the wellbore by injecting drilling fluid through a tubular string disposed in the wellbore, the tubular string comprising a drill bit disposed on a bottom thereof, wherein:

the drilling fluid exits the drill bit and carries cuttings from the drill bit, and the drilling fluid and cuttings (returns) flow to a surface of the wellbore via an annulus defined by an outer surface of the tubular string and an inner surface of the wellbore; and while drilling the wellbore:

measuring a first annulus pressure (FAP) using a pressure sensor attached to a casing string hung from a wellhead of the wellbore;

continuously transmitting the FAP measurement to the surface using a high-bandwidth medium;

continuously selecting at least a portion of a formation exposed to the annulus having a minimum fracture gradient relative to fracture gradients of other exposed portions or formations;

continuously calculating a second annulus pressure (SAP) exerted on the portion;

continuously comparing the SAP to a fracture pressure of the portion; and controlling the SAP to be less than the fracture pressure of the portion.

2. The method of claim 1, wherein:

the pressure sensor is in communication with a surface monitoring and control unit (SMCU) via a cable disposed along an outer surface of the casing string or within a wall of the casing string, a liner string is hung from the casing string at or near a bottom of the casing string, the liner string has a second pressure sensor configured to measure a third annulus pressure (TAP), each of the casing string and the liner have part of an inductive coupling, and the method further comprises:

measuring the TAP with the liner sensor;

transmitting the TAP measurement from the liner to the casing string via the inductive coupling; and relaying the TAP measurement to the SMCU via the cable.

3. The method of claim 1, further comprising, while drilling:

measuring a bottom hole pressure (BHP);

wirelessly transmitting the BHP measurement to the casing string or to the surface of the wellbore;

intermittently receiving the BHP measurement at the surface; and intermittently calibrating the calculated SAP using the BHP measurement.

4. The method of claim 3, wherein the tubular string further comprises a second pressure sensor disposed at or near a bottom thereof and a third pressure sensor longitudinally spaced at a distance from the second pressure sensor.

5. The method of claim 3, wherein the BHP is wirelessly transmitted using a mud pulse.

6. The method of claim 1, further comprising calculating a productivity of a formation while drilling through the formation.

7. The method of claim 1, wherein:

the tubular string is a drill string, drilling fluid is injected into a first chamber of the drill string, and the SAP is controlled by injecting a second fluid having a density different from a density of the drilling fluid through a second chamber of the drill string.

8. The method of claim 1, wherein:

the tubular string is a drill string comprising joints of drill pipe joined by threaded connections, the method further comprises:

adding or removing a joint of drill pipe to/from the drill string; and controlling the SAP while adding or removing the joint to/from the drill string.

9. The method of claim 8, wherein:

the returns enter a separator, and the SAP is controlled while adding or removing the joint by pressurizing the separator.

10. The method of claim 8, wherein the SAP is controlled while adding or removing the joint using a continuous circulation system or a continuous flow sub disposed in the drill string.

11. The method of claim 1, wherein the SAP is continuously controlled to be greater than a first threshold pressure of at least a portion of an exposed formation having a maximum first threshold gradient relative to first threshold gradients of other exposed portions or formations.

12. The method of claim 1, wherein a depth of the SAP is distal from a bottom of the wellbore.

13. The method of claim 1, wherein:

the casing string is a tie-back casing string, a second casing string is disposed in the wellbore, a tie-back annulus is defined between the tie-back casing string and the second string of casing, and the SAP is controlled by injecting a second fluid having a density different from a density of the drilling fluid through the tie-back annulus.

14. The method of claim 1, wherein:

the casing string is a tie-back casing string, a second casing string is disposed in the wellbore, a tie-back annulus is defined between the tie-back casing string and the second string of casing, and a mudcap is maintained in a bore of the tie-back casing string or in the tie-back annulus, the mudcap being a fluid having a density substantially greater than a density of the drilling fluid.

15. The method of claim 14, wherein:

a plurality of pressure sensors (TBPS) is disposed along a length of the tie-back casing string, and the method further comprises monitoring a level of an interface between the mudcap and the returns using the TBPS.

16. The method of claim 1, wherein a downhole deployment valve (DDV) is assembled as part of the casing string proximate to the sensor.

17. The method of claim 1, wherein:

the tubular string is a drill string further comprising an equivalent circulation density reduction tool (ECDRT), the ECDRT comprises a motor, a pump, and an annular seal, the drilling fluid operates the motor, the annular seal is engaged with the casing string and diverts the returns from the annulus and through the pump, the pump is rotationally coupled to the motor, thereby being operated by the motor, and the pump adds energy to the returns, thereby reducing an equivalent circulation density (ECD) of the returns.

18. The method of claim 17, wherein:

a second pressure sensor is attached along the casing string so that the pressure sensor is in fluid communication with an inlet of the pump and the second pressure sensor is in fluid communication with an outlet of the pump, and the method further comprises:

measuring a third annulus pressure (TAP) using the second pressure sensor while drilling the wellbore; and monitoring operation of the ECDRT using the FAP and the TAP.

19. The method of claim 1, wherein:

the tubular string comprises a second casing string or a liner string, and the method further comprises hanging the second casing string or liner string from the wellhead or the casing string.

20. The method of claim 1, wherein:

the method further comprises:

running a sand screen into the formation; and expanding the sand screen into engagement with the formation, the casing string is cemented to the wellbore and comprises [[a]] the pressure sensor and a first part of an inductive coupling, the sand screen comprises:

a second pressure sensor, and a cable disposed along an outer surface of the sand screen or within a wall of the sand screen, the cable in communication with the second pressure sensor and a second part of an inductive coupling disposed at or near a top of the sand screen, and the sand screen is expanded when the second part of the inductive coupling is in longitudinal alignment or near alignment with the first part of the inductive coupling.

21. The method of claim 1, wherein:

the tubular string is a drill string, the drill string further comprises a length of expandable liner and a radial expansion tool, and the method further comprises:

aligning the expandable liner with a problem formation, and expanding the liner into engagement with the problem formation, thereby isolating the problem formation.

22. The method of claim 1, wherein:

the wellbore is a subsea wellbore, a riser string extends from a rig at a surface of the sea to a wellhead of the wellbore at a floor of the sea, the riser string is in fluid communication with the wellbore, and a second pressure sensor is attached to the riser string, and the method further comprises measuring a third annulus pressure using the second pressure sensor.

23. The method of claim 1, wherein the pressure sensor is located at or near a bottom of the casing string.

24. The method of claim 1, wherein the SAP is continuously controlled.

25. A method for drilling a wellbore, comprising acts of:

drilling the wellbore by injecting drilling fluid through a tubular string disposed in the wellbore, the tubular string comprising a drill bit disposed on a bottom thereof, wherein:

the drilling fluid exits the drill bit and carries cuttings from the drill bit, the drilling fluid and cuttings (returns) flow to a surface of the wellbore via an annulus defined by an outer surface of the tubular string and an inner surface of the wellbore a pressure sensor is attached to a casing string and in communication with a surface monitoring and control unit (SMCU) via a cable disposed along an outer surface of the casing string or within a wall of the casing string, the casing string is hung from a wellhead of the wellbore, a liner string is hung from the casing string at or near a bottom of the casing string, the liner string has a second pressure sensor configured to measure a third annulus pressure (TAP), and each of the casing string and the liner have part of an inductive coupling; and while drilling the wellbore:

measuring a first annulus pressure (FAP) using the pressure sensor;

transmitting the FAP measurement to a surface of the wellbore using a high-bandwidth medium;

controlling a second annulus pressure (SAP) exerted on a formation exposed to the annulus measuring the TAP with the liner sensor;

transmitting the TAP measurement from the liner to the casing string via the inductive coupling; and relaying the TAP measurement to the SMCU via the cable.

26. A method for drilling a wellbore, comprising acts of:

drilling the wellbore by injecting drilling fluid through a tubular string disposed in the wellbore, the tubular string comprising a drill bit disposed on a bottom thereof, wherein:

the drilling fluid exits the drill bit and carries cuttings from the drill bit, the drilling fluid and cuttings (returns) flow to a surface of the wellbore via an annulus defined by an outer surface of the tubular string and an inner surface of the wellbore the tubular string is a drill string further comprising an equivalent circulation density reduction tool (ECDRT), the ECDRT comprises a motor, a pump, and an annular seal, the drilling fluid operates the motor, the annular seal is engaged with the casing string and diverts the returns from the annulus and through the pump, the pump is rotationally coupled to the motor, thereby being operated by the motor, the pump adds energy to the returns, thereby reducing an equivalent circulation density (ECD) of the returns, and a pressure sensor is attached to a casing string hung from a wellhead of the wellbore, a second pressure sensor is attached along the casing string so that the pressure sensor is in fluid communication with an inlet of the pump and the second pressure sensor is in fluid communication with an outlet of the pump; and while drilling the wellbore:

measuring a first annulus pressure (FAP) using the pressure sensor;

controlling a second annulus pressure (SAP) exerted on a formation exposed to the annulus;

measuring a third annulus pressure (TAP) using the second pressure sensor while drilling the wellbore; and monitoring operation of the ECDRT using the FAP and the TAP.

27. A method for drilling a wellbore, comprising acts of:

drilling the wellbore by injecting drilling fluid through a tubular string disposed in the wellbore, the tubular string comprising a drill bit disposed on a bottom thereof, wherein:

the drilling fluid exits the drill bit and carries cuttings from the drill bit, and the drilling fluid and cuttings (returns) flow to a surface of the wellbore via an annulus defined by an outer surface of the tubular string and an inner surface of the wellbore;

while drilling the wellbore:

measuring a first annulus pressure (FAP) using a pressure sensor attached to a casing string hung from a wellhead of the wellbore; and controlling a second annulus pressure (SAP) exerted on a formation exposed to the annulus;

running a sand screen into the formation; and expanding the sand screen into engagement with the formation, wherein:

the casing string is cemented to the wellbore and comprises [[a]] the pressure sensor and a first part of an inductive coupling, the sand screen comprises:

a second pressure sensor, and a cable disposed along an outer surface of the sand screen or within a wall of the sand screen, the cable in communication with the second pressure sensor and a second part of an inductive coupling disposed at or near a top of the sand screen, and the sand screen is expanded when the second part of the inductive coupling is in longitudinal alignment or near alignment with the first part of the inductive coupling.

* * * * *

UNITED STATES PATENT AND TRADEMARK OFFICE

CERTIFICATE OF CORRECTION

PATENT NO. : 7,836,973 B2
APPLICATION NO. : 11/850479
DATED : November 23, 2010
INVENTOR(S) : Belcher et al.

It is certified that error appears in the above-identified patent and that said Letters Patent is hereby corrected as shown below:

In the Claims:

Column 47, Claim 20, Line 2, please delete "[[a]]";

Column 49, Claim 27, Line 2, please delete "[[a]]".

Signed and Sealed this
Twenty-ninth Day of March, 2011

David J. Kappos

David J. Kappos
*Director of the United States Patent and Trademark Office*